US007956823B2

(12) United States Patent
Miyachi et al.

(10) Patent No.: US 7,956,823 B2
(45) Date of Patent: Jun. 7, 2011

(54) COLOR DISPLAY DEVICE, COLOR COMPENSATION METHOD, COLOR COMPENSATION PROGRAM, AND STORAGE MEDIUM READABLE BY COMPUTER

(75) Inventors: Koichi Miyachi, Kyoto (JP); Akihito Jinda, Nara (JP); Hidekazu Miyata, Nagoya (JP); Kazunari Tomizawa, Kyoto (JP); Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 1988 days.

(21) Appl. No.: 10/825,173

(22) Filed: Apr. 16, 2004

(65) Prior Publication Data

US 2004/0263456 A1 Dec. 30, 2004

Related U.S. Application Data

(63) Continuation-in-part of application No. 10/156,632, filed on May 28, 2002, now Pat. No. 7,071,955.

(30) Foreign Application Priority Data

| | | |
|---|---|---|
| May 30, 2001 | (JP) | 2001-163344 |
| Jan. 29, 2002 | (JP) | 2002-020599 |
| Apr. 18, 2003 | (JP) | 2003-114050 |
| Oct. 6, 2003 | (JP) | 2003-347515 |

(51) Int. Cl.
*G09G 3/28* (2006.01)

(52) U.S. Cl. ..... 345/72; 345/77; 345/690

(58) Field of Classification Search ..... 345/88, 345/690, 72, 77

See application file for complete search history.

(56) References Cited

U.S. PATENT DOCUMENTS

| | | | | |
|---|---|---|---|---|
| 3,558,806 | A | | 1/1971 | Monahan et al. |
| 5,075,767 | A | | 12/1991 | Takaragi |
| 5,128,748 | A | | 7/1992 | Murakami et al. |
| 5,231,482 | A | | 7/1993 | Murakami et al. |
| 5,268,771 | A | | 12/1993 | Murakami et al. |
| 5,390,034 | A | | 2/1995 | Murakami et al. |
| 5,412,433 | A | | 5/1995 | Holland et al. |
| 5,414,529 | A | | 5/1995 | Terada et al. |
| 5,442,375 | A | * | 8/1995 | Wojaczynski et al. ..... 345/589 |
| 5,576,849 | A | | 11/1996 | Murakami et al. |

(Continued)

FOREIGN PATENT DOCUMENTS

CN 1418003 5/2003

(Continued)

OTHER PUBLICATIONS

Korean Office Action and English translation thereof as issued on Nov. 23, 2005.

(Continued)

*Primary Examiner* — Quan-Zhen Wang
*Assistant Examiner* — Calvin C Ma
(74) *Attorney, Agent, or Firm* — Harness, Dickey & Pierce, P.L.C.

(57) ABSTRACT

A color display device determines a relationship between RGB components of an input color image signal in terms of their gradation levels, and carries out a different calculation for each input color image signal depending on which of six patterns of the relationship that the input color image signal belongs to. Further, the color display device carries out the calculation for each of the RGB components excluding a component with a smallest gradation level, using variables that vary depending on the respective gradation levels of the RGB components.

32 Claims, 25 Drawing Sheets

U.S. PATENT DOCUMENTS

| | | | | |
|---|---|---|---|---|
| 5,588,050 | A | 12/1996 | Kagawa et al. | |
| 5,619,280 | A | 4/1997 | Yamashita et al. | |
| 5,729,636 | A | 3/1998 | Kagawa et al. | |
| 5,748,802 | A * | 5/1998 | Winkelman | 382/271 |
| 5,771,108 | A | 6/1998 | Ikeda et al. | |
| 5,801,745 | A | 9/1998 | Wada et al. | |
| 5,917,959 | A | 6/1999 | Kagawa et al. | |
| 6,081,254 | A | 6/2000 | Tanaka et al. | |
| 6,101,271 | A * | 8/2000 | Yamashita et al. | 382/167 |
| 6,125,202 | A | 9/2000 | Kagawa et al. | |
| 6,259,811 | B1 | 7/2001 | Tsuji | |
| 6,480,258 | B2 * | 11/2002 | Tsuji | 355/38 |
| 6,621,497 | B1 | 9/2003 | Sugiura et al. | |
| 7,095,390 | B2 * | 8/2006 | Otobe et al. | 345/63 |
| 7,277,075 | B1 | 10/2007 | Hirano et al. | |
| 2001/0003456 | A1 | 6/2001 | Kagawa et al. | |
| 2002/0044122 | A1 * | 4/2002 | Kuwata et al. | 345/88 |
| 2002/0063670 | A1 | 5/2002 | Yoshinaga et al. | |
| 2002/0154138 | A1 | 10/2002 | Wada et al. | |
| 2003/0043165 | A1 | 3/2003 | Miyachi et al. | |
| 2003/0152265 | A1 | 8/2003 | Asamura et al. | |
| 2004/0051890 | A1 | 3/2004 | Asamura et al. | |
| 2004/0105105 | A1 * | 6/2004 | Smith | 358/1.9 |
| 2004/0223642 | A1 | 11/2004 | Asamura et al. | |
| 2005/0237288 | A1 | 10/2005 | Yoshinaga et al. | |

FOREIGN PATENT DOCUMENTS

| | | | |
|---|---|---|---|
| JP | 01-237144 | | 9/1989 |
| JP | 02-211790 | | 8/1990 |
| JP | 3-266586 | | 11/1991 |
| JP | 3-272294 | | 12/1991 |
| JP | 04-304775 | | 10/1992 |
| JP | 04-335771 | | 11/1992 |
| JP | 05-205039 | | 8/1993 |
| JP | 9-247701 | A | 9/1997 |
| JP | 10-240198 | | 9/1998 |
| JP | 11-069181 | | 3/1999 |
| JP | 11-191893 | | 7/1999 |
| JP | 2000-32267 | | 1/2000 |
| JP | 2000-112423 | | 4/2000 |
| JP | 2000-347642 | | 12/2000 |
| JP | 2001-119715 | | 4/2001 |
| JP | 2001-147666 | | 5/2001 |
| JP | 2001-169125 | | 6/2001 |
| JP | 2002-229531 | | 8/2002 |
| WO | WO 01/37249 | | 5/2001 |

OTHER PUBLICATIONS

European Search Report for corresponding European application, Jul. 13, 2001.

* cited by examiner

COLOR DISPLAY DEVICE, COLOR COMPENSATION METHOD, COLOR COMPENSATION PROGRAM, AND STORAGE MEDIUM READABLE BY COMPUTER

This Nonprovisional application is a continuation-in-part of and claims priority under 35 U.S.C. §120 on U.S. patent application Ser. No. 10/156,632 filed May 28, 2002, now U.S. Pat. No. 7,071,955 the entire contents of which are hereby incorporated herein by reference. This Nonprovisional application further claims priority under 35 U.S.C. §119(a) on Patent Application No. 2003/114050 filed in Japan on Apr. 18, 2003, and No. 2003/347515 filed in Japan on Oct. 6, 2003, the entire contents of each which are hereby incorporated by reference.

FIELD OF THE INVENTION

The present invention generally relates to a color display device. Preferably, it relates to one including a signal processing device for carrying out color compensation of color image signals.

BACKGROUND OF THE INVENTION

There are several known color compensation techniques for color image signals, for obtaining brighter colors upon display. One example of such a technique can be found in Japanese Laid-Open Patent Application Tokukaihei 03-266586/1991 (published on Nov. 27, 1991, hereinafter referred to as Document 1). In this example, color compensation is performed by using six color components of a signal: the three primary colors, R (Red), G (Green), and B (Blue); with Y (Yellow), M (Magenta), and C (Cyan) as complementary colors of those primary colors.

The color compensation of Document 1 is carried out as follows. For the RGB image signal components of a signal, the components of the three primary colors and the components of the three complementary colors are individually extracted. Then, the component of each color is multiplied by an adjustment coefficient which is determined differently for each color in advance. Further, the calculated value for color compensation is added to the original RGB signals so that new corrected color signals R'G'B'are created.

For example, a color image signal in which the respective signals of R, G, B are contained by a ratio of 0.8:1.0:0.2, respectively, is expressed as 0.8R+1.0G+0.2B. This expression can be modified as 0.2 (R+G+B)+0.6 (R+G)+0.2G. After the modification, the original signal is divided into three components: (R+G+B), (R+G) and G. Here, (R+G+B) denotes a white component and (R+G) denotes an Y component.

Since the white component is not used for calculation, the original signal is divided into an Y component and a G component. The Y component and the G component are then respectively multiplied by predetermined constants, and the respective calculation results are then added to the original RGB signals. Thereafter, the R'G'B'signal having been through color compensation, is outputted.

With reference to FIGS. 13 and 14, the following will describe a change of gradation level of a signal through the color compensation with the foregoing technology of Document 1.

FIG. 13 shows a so-called HSL color model, which indicates distributions of luminance and saturation of the color. FIG. 13(*a*) is a perspective view of the HSL (a color model expressed by Hue, Saturation and Luminance), while FIG. 13(*b*) shows a circle as an upper view of the inverted-cone-shaped HSL, and a triangle as a cross-sectional view taken along a line between a point of Y (Yellow) 1303 and a point of B (Blue) 1304. The closer to the circumference, the greater the saturation (the greater the gradation level denoting saturation), and the more upward (the center of circle 1302 is white) from the top 1301 (black) of the cone, the greater the luminance (gradation level denoting luminance).

FIG. 14 is a schematic view showing a change in gradation level of luminance and saturation of the Y component and the B component through the color compensation with the foregoing technology of Document 1. FIG. 14(*b*) shows the Y component of the input color image signal with enhanced gradation level. As shown in the Figure, in the color image signal having been through color compensation, colors are properly modified for the domain close to the center (the center denotes an achromatic color, and the color becomes more mixed from outside to inside the circle) of HSL. However, the color in the vicinity (the circumference denotes a monochromatic color, and the color becomes more monochromatic from inside to outside the circle) of the circumference of HSL may fall outside the circumference (see 1401 in FIG. 14) of the circle. For example, assuming that the maximum saturation is 255 in gradation level, and the Y component after separated from the input signal is multiplied by a constant, the obtained value may exceed the gradation level of 255. Thus, the color image signal with the color outside the range will fail to properly display an image.

As described, since the color compensation according to Document 1 is performed by calculation in which monochromatic colors and mixed colors are corrected together, it fails to obtain a desired image, or fails to create and display an image with higher quality.

More specifically, through color compensation with the foregoing technology, the calculated value may become higher than the upper limit of saturation or luminance in one or some color components. As such, color compensation fails in domains of monochromatic colors or domains close to monochromatic colors. By having the color with a color component improperly corrected, the displayed image contains both properly modified pixels and improperly modified pixels. This thus results in the displayed image becoming partially unnatural.

Further, in color compensation with the foregoing technique, the white component is not used for color conversion calculation after extracted from the input signal. Therefore, there will be an only small difference in saturation or luminance between monochromatic colors and mixed colors. Thus, monochromatic colors fail to be enhanced to generate a bright image.

SUMMARY OF THE INVENTION

An embodiment of the present invention is made in view of one or more the foregoing conventional problems, and provides a color display device which determines a relationship between the RGB components of an input color image signal in terms of their gradation levels. This is done so as to carry out a different calculation operation for each input color image signal depending on whether the input color image signal belongs to one of six patterns of the relationship. Calculation is carried out between the three components excluding a component with the smallest gradation level. This is done using variables that vary depending on values of the three gradation levels.

An embodiment of the present invention carries out color compensation of an input color signal in consideration of RGB components, YMC components, and also white component in some cases, contained in the signal. As such, it achieves a desired color conversion operation. With this arrangement, the color display device of an embodiment of the present invention is suitable for displays of, for example, mobile phones, monitors of personal computers, image display devices of liquid crystal TVs, etc.

Additional objects, features, and strengths of the present invention will be made clear by the description of the various exemplary embodiments stated below. Further, the advantages of the present invention will be evident from the following explanation of the exemplary embodiments, in reference to the drawings.

DESCRIPTION OF THE EMBODIMENTS

First Embodiment

One embodiment of the present invention will be described below with reference to FIGS. 1 through 5.

The present embodiment uses an input color signal made up of three colors, R, G and B, of N gradations (Black 0 to white (N−1)). More specifically, the input image signal is a color digital signal of 3n bits and is made up of a digital signal R of n bit and N gradation ($N=2^n$) that indicates a gradation level of red with an integer r in a range of 0 to N−1; a digital signal G of n bit and N gradation ($N=2^n$) that indicates a gradation level of green with an integer g in a range of 0 to N−1; and a digital signal B of n bit and N gradation ($N=2^n$) that indicates a gradation level of blue with an integer b in a range of 0 to N−1. Further, the gradation level of saturation is denoted by the difference between the maximum value and the minimum value of r, g and b, and the gradation level of luminance is denoted by the maximum value of r, g and b.

Figure 1:
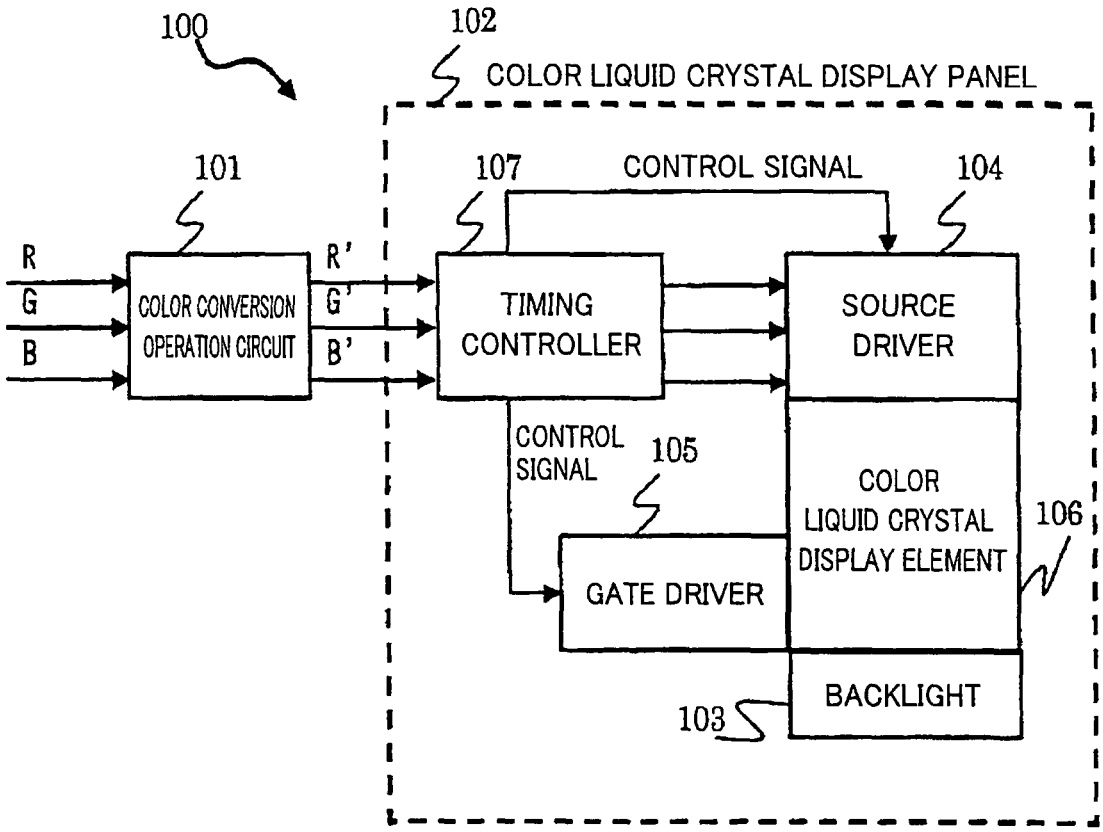
FIG. 1 is a block diagram schematically showing an arrangement of a color display device according to an embodiment of the present invention.

As shown in FIG. 1, a color display device 100 includes a color liquid crystal display panel 102 and a color conversion operation circuit 101 for processing the input color image signal RGB and outputting the processed color image signal R'G'B'to the color liquid crystal display panel 102.

The color liquid crystal display panel 102 includes a backlight 103 as a light source, a color liquid crystal display element 106 having a large number of TFTs (Thin Film Transistors) for switching a liquid crystal layer, a source driver 104 for supplying display signals to the source electrodes of the TFTs, a gate driver 105 for supplying gate voltages (scanning signals) to the gate electrodes of the TFTs, and a timing controller 107. The timing controller 107 supplies the color image signal R'G'B'to the source driver 104, and also controls the source driver 104 and the gate driver 105 by supplying a control signal thereto. Although the present example is discussed in conjunction with a liquid crystal display panel as the color display device, it should be understood that the present invention also may be used in conjunction with other display devices capable of color display, including but not limited to a cathode ray tube (CRT), a plasma display panel (PDP), etc.

The color conversion operation circuit 101 assorts input image signals into six patterns (six hue domains) depending on the level relationship between the respective gradation levels r, g and b thereof, so as to carry out different calculation operations for each input color image signal depending on whether the input color image signal belongs to which of six patterns of the relationship.

Figure 2:
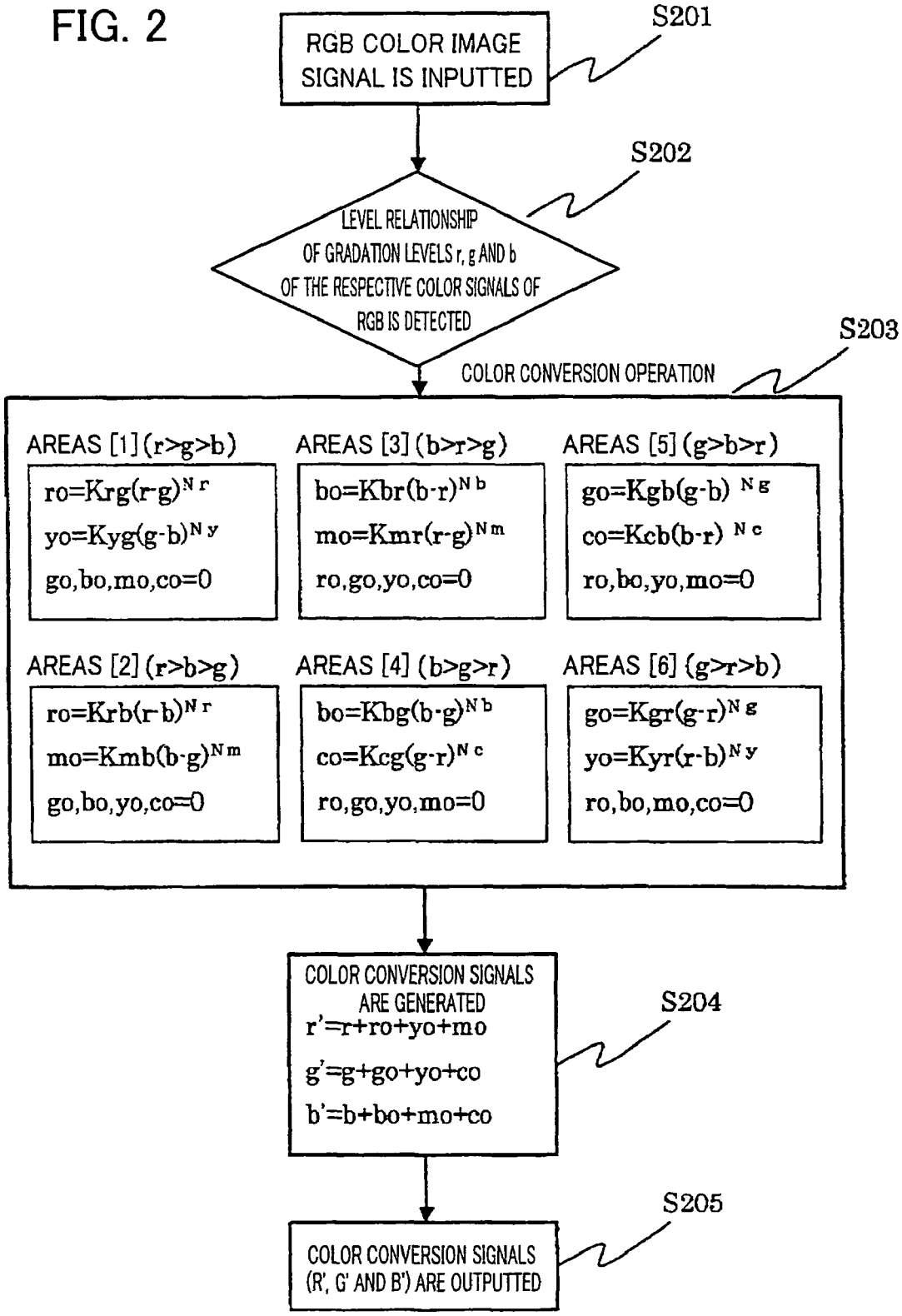
FIG. 2 is a flow chart showing a flow of color conversion operation according to the first embodiment of the present invention.

FIG. 2 shows an operation flow of the color conversion operation circuit 101. When an image signal RGB is inputted (S201), the color conversion operation circuit 101 determines the level relationship of the gradation levels r, g and b of the respective color signals in the input signal (S202). More specifically, the color conversion operation circuit 101 determines whether the input signal belongs to which of the following six patterns (six hue domains) of the relationship between the gradation values r, g and b of the respective color signals in the input signal.

[1]r>g>b
[2]r>b>g
[3]b>r>g
[4]b>g>r
[5]g>b>r
[6]g>r>b

It should be noted that the assortment of the gradation levels r, g and b into six patterns is not limited to that described below but may be other combinations. For example, the [1] through [6] may instead be r≧g, g<r, r≧b, b<r, g≧b, and b<g, as long as the respective formulas denote different ranges, i.e., their ranges are not overlapped with each other.

Next, compensation values ro, go, bo, yo, mo and co are calculated for carrying out color compensation of the respective color components: R, G, B, Y, M and C (S204).

The compensation values for the domains [1] through [6] are calculated according to the following formulas, For the domain [1] expressed as (r≧g≧b):

$$ro=Krg(r-g)^{Nr},\ yo=Kyg(g-b)^{Ny}$$

$$go=bo=mo=co=0$$

For the domain [2] denoted by (r≧b>g):

$$ro=Krb(r-b)^{Nr},\ mo=Kmb(b-g)^{Nm}$$

$$go=bo=yo=co=0$$

For the domain [3] expressed as (b>r≧g):

$$bo=Kbr(b-r)^{Nb},\ mo=Kmr(r-g)^{Nm}$$

$$ro=go=yo=co=0$$

For the domain [4] expressed as (b>g>r):

$$bo=Kbg(b-g)^{Nb},\ co=Kcg(g-r)^{Nc}$$

$$ro=go=yo=mo=0$$

For the domain [5] expressed as (g≧b>r):

$$go=Kgb(g-b)^{Ng},\ co=Kcb(b-r)^{Nc}$$

$$ro=bo=yo=mo=0$$

For the domain [6] expressed as (g>r≧b):

$$go=Kgr(g-r)^{Ng},\ yo=Kyr(r-b)^{Ny}$$

$$ro=bo=mo=co=0$$

where Krg, Krb, Kbr, Kbg, Kgb, Kgr, Kyg, Kyr, Kmb, Kmr, Kcg and Kcb are constants or variables, and Nr, Ng, Nb, Ny, Nm and Nc are constants not less than 0.

The ratio of enhancement degree of saturation between the white side and the monochrome side may be controlled by providing values to Nr, Ng, Nb, Ny, Nm and Nc, and raising the difference between r, g and b by the powers of the values. For example, when the value of Nr is larger than 1, the red on the white side (achromatic red) is more enhanced; conversely, when the value of Nr is smaller than 1, the monochrome red is more enhanced. This change in ratio of saturation is shown in FIG. 3.

Figure 3:
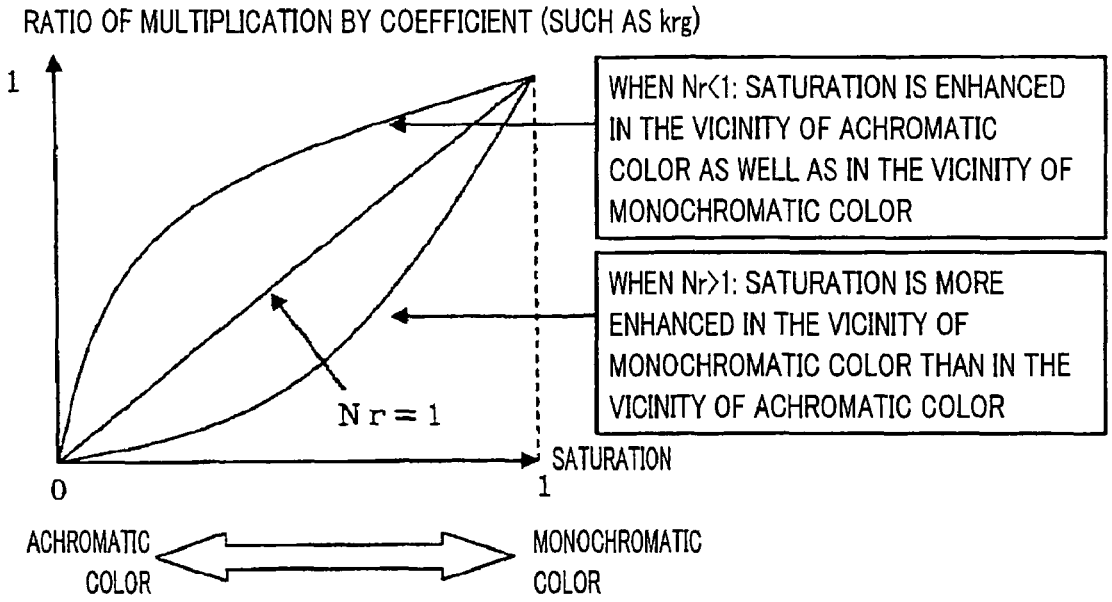
FIG. 3 is a drawing showing an example of a relationship between saturation and coefficient in calculation to obtain a compensation value.

In the case where Nr=1, for example, the compensation value ro of r in the domain [1] becomes ro=Krg (r−g) and linearly changes according to the difference between r and g, as shown in FIG. 3. On the other hand, in the case where Nr>1, the degree of saturation is more enhanced in the vicinity of monochromatic color compared to that in the vicinity of achromatic color, as shown in FIG. 3. Further, in the case where Nr<1, the degree of saturation is more enhanced in the vicinity of achromatic color compared to that in the vicinity of monochromatic color, as shown in FIG. 3.

By thus setting up each value of Nr, Ng, Nb, Ny, Nm and Nc upon calculation of compensation values, it is possible to independently and finely control r, g, b, y, m and c.

The following describes a preferable example for setting the value of Nb. In view of a tendency such that the degree of enhancement of saturation is low when the difference between the rgb values of an input image signal is small and an input image signal is close to achromatic color; a condition Nb<1 is satisfied so that the compensation value bo for performing the color compensation above increases, and the saturation near achromatic color can be effectively enhanced. It is desirable to set Ng, Nc, and Nm to be not more than 1 as well.

However, it is not desirable to set Nr and Ny to be not more than 1, as the Nr and Ny are coefficients for determining the color compensation values ro and yo which greatly affect in expressing a flesh color as an achromatic color.

More specifically, if a flesh color is enhanced in saturation as in the manner above, the flesh color becomes deeper when appeared in the display panel. As such, it may appear to a user as "a deep flesh color with heavy makeup" since flesh color is reproduced directly to some extent in the displayed image when reproduced with a display panel having a wide color reproduction range.

This problem may be solved by setting small values for the coefficients Krg-Krb-Kyg-Kyr. However, if these coefficients are set small, then the degree of saturation of a red for expressing an "apple" or an yellow for expressing a "mandarin orange" will not be enhanced.

Thus, it is better for monochromatic colors, i.e., red or yellow, to enhance in saturation as much as possible, whereas achromatic colors, i.e., flesh color, should be minimally enhanced.

Figure 15:
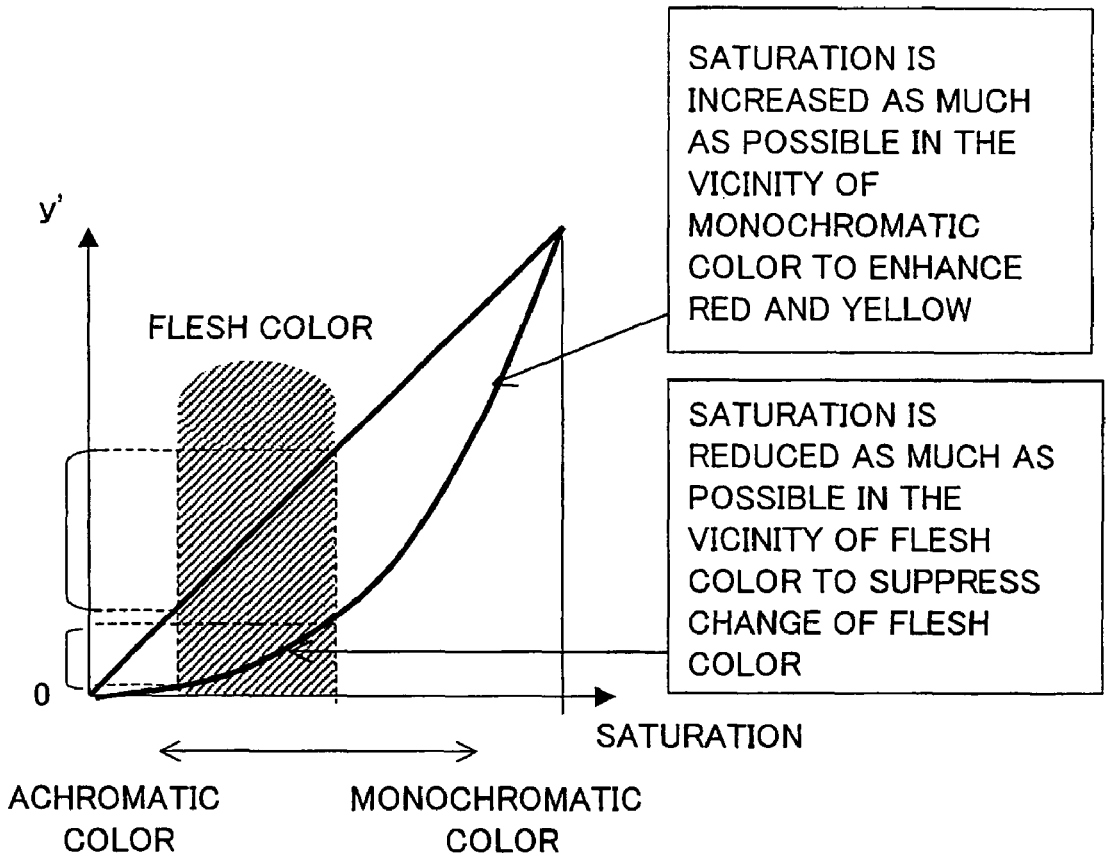
FIG. 15 is a drawing showing an example of a relationship between saturation and coefficient in calculation to obtain a compensation value.

Then, as shown in FIG. 15, it is possible to enhance red or yellow in saturation as much as possible. Further, this should be done while minimally enhancing achromatic colors, i.e., flesh color. These should be minimally enhanced by setting Nr and Ny to be not more than 1.

Moreover, if Nr and Ny are set larger than 1 as shown in FIG. 15, the saturation of other colors than flesh color may not fully be enhanced. In view of this, it is desirable to set coefficients Krg, Krb, Kyg and Kyr twice as great as other coefficients Kbr, Kbg, Kgb, Kgr, Kmb, Kmr, Kcg and Kcb.

Further, in the actual operation, it is necessary to perform the color compensation in consideration of coefficients Krg-Krb-Kyg-Kyr. The following will explain changes in enhancement degree of saturation when taking these coefficients into consideration with reference to the HSL color model of FIG. 16.

Figure 16:
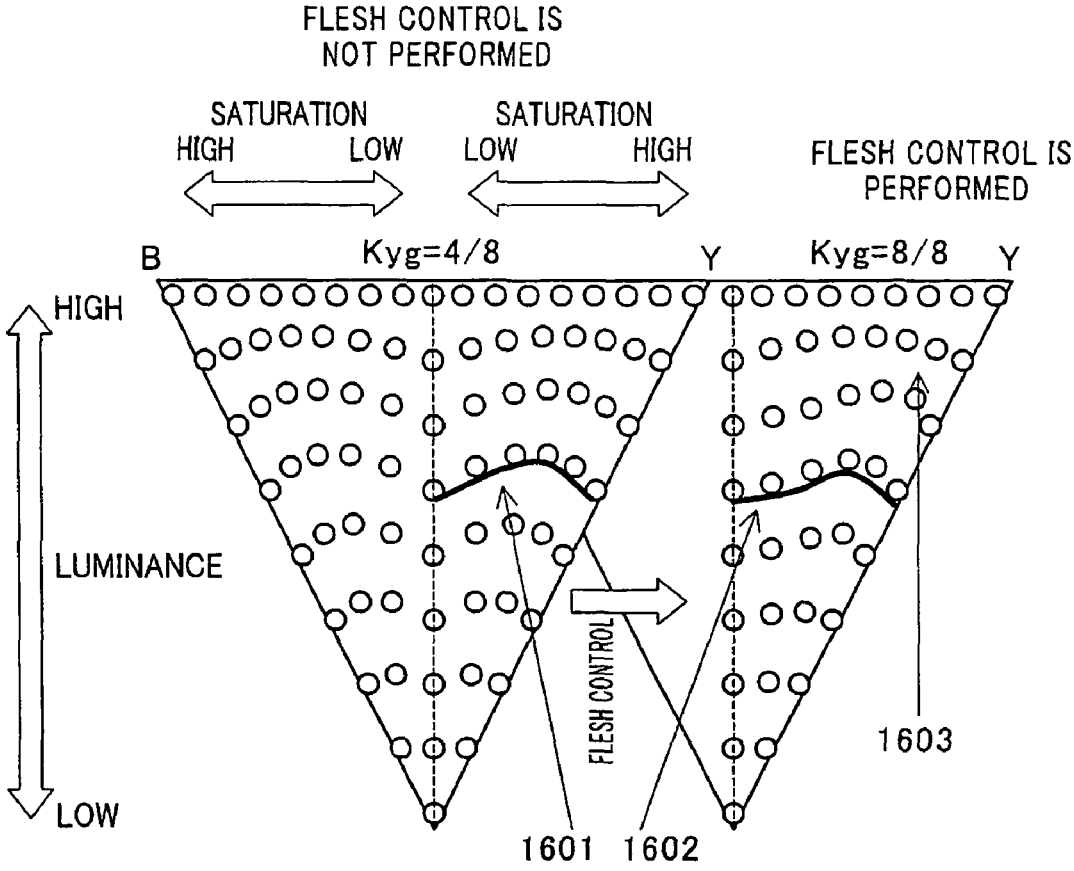
FIG. 16 is a cross-sectional view of a HSL color model for showing a change of gradation level with or without flesh color control.

As shown in FIG. 16, comparison of a domain 1601 with a domain 1602 indicates that change of luminance in colors in the vicinity of flesh color is reduced when flesh color is controlled by setting Nr and Ny not more than 1. Moreover, referring to the domain 1603 in the color model with the flesh color control, it turns out that the degree of saturation is enhanced in the vicinity of monochromatic color as much as the case without flesh color control.

The foregoing variables may be expressed as follows:

$$Krg=Cr\cdot frg(r,g),\ Krb=Cr\cdot frb(r,b)$$

$$Kgr=Cg\cdot fgr(g,r),\ Kgb=Cg\cdot fgb(g,b)$$

$$Kbr=Cb\cdot fbr(b,r),\ Kbg=Cb\cdot fbg(b,g)$$

$$Kyg=Cy\cdot fyg(r,b),\ Kmb=Cm\cdot fmb(r,g)$$

$$Kmr=Cm\cdot fmr(b,g),\ Kcg=Cc\cdot fcg(b,r)$$

$$Kcb=Cc\cdot fcb(g,r),\ Kyr=Cy\cdot fyr(g,b)$$

where, Cr, Cb, Cg, Cy, Cm and Cc are constants, frg, frb, fgr, fgb, fbr, fbg, fyg, fmb, fmr, fcg, fcb, fyr are functions which respectively change depending on the values of r, g and b in the corresponding bracket, and r, g and b are variables obtained by dividing original gradation levels of the RGB components of the input color image signal by a maximum gradation value N−1.

Further, assuming that the coefficients Krg, Krb, Kbr, Kbg, Kgb, Kgr, Kyg, Kyr, Kmb, Kmr, Kcg and Kcb are variables, the coefficients may be expressed as follows:

$$Krg=Cr\cdot far(r)\cdot fag(g),\ Krb=Cr\cdot far(r)\cdot fab(b)$$

$$Kgr=Cg\cdot fag(g)\cdot far(r),\ Kgb=Cg\cdot fag(g)\cdot fab(b)$$

$$Kbr=Cb\cdot fab(b)\cdot far(r),\ Kbg=Cb\cdot fab(b)\cdot fag(g)$$

$$Kyg=Cy\cdot far(r)\cdot fab(b),\ Kmb=Cm\cdot far(r)\cdot fag(g)$$

$$Kmr=Cm\cdot fab(b)\cdot fag(g),\ Kcg=Cc\cdot fab(b)\cdot far(r)$$

$$Kcb=Cc\cdot fag(g)\cdot far(r),\ Kyr=Cy\cdot fag(g)\cdot fab(b)$$

where Cr, Cb, Cg, Cy, Cm and Cc are constants, far, fab, fag, fay, fam, fac are functions which respectively change depending on the values of r, g and b in the corresponding bracket, and r, g and b are variables obtained by dividing original gradation levels of the RGB components of the input color image signal by a maximum gradation value N−1. Further, it is preferable that the coefficients far (r), fag (g), and fab (b) are continuous functions which gives 0 when r, g, b ($0 \leqq r, g, b \leqq 1$) are 0 or 1.

As a specific example, the functions may be expressed as follows:

| | |
|---|---|
| $Krg = Cr \cdot \alpha r \cdot \alpha g$, | $Krb = Cr \cdot \alpha r \cdot \alpha b$ |
| $Kgr = Cg \cdot \alpha g \cdot \alpha r$, | $Kgb = Cg \cdot \alpha g \cdot \alpha b$ |
| $Kbr = Cb \cdot \alpha b \cdot \alpha r$, | $Kbg = Cb \cdot \alpha b \cdot \alpha g$ |
| $Kyg = Cy \cdot \alpha r \cdot \alpha b$, | $Kmb = Cm \cdot \alpha r \cdot \alpha g$ |
| $Kmr = Cm \cdot \alpha b \cdot \alpha g$, | $Kcg = Cc \cdot \alpha b \cdot \alpha r$ |
| $Kcb = Cc \cdot \alpha g \cdot \alpha r$, | $Kyr = Cy \cdot \alpha g \cdot \alpha b$ |

where Cr, Cb, Cg, Cy, Cm and Cc are constants.

Further, the foregoing αr, αg and αb may be functions (weighting function) which change depending on the gradation levels r, g and b, and are expressed as:

| | |
|---|---|
| $\alpha r = f_0 \times r^k$ | $(0 \leqq r < Mr)$ |
| $\alpha r = f_1 \times (1 - r)^k$ | $(Mr \leqq r \leqq 1)$ |
| $\alpha g = g_0 \times g^k$ | $(0 \leqq g < Mg)$ |
| $\alpha g = g_1 \times (1 - g)^k$ | $(Mg \leqq g \leqq 1)$ |
| $\alpha b = h_0 \times b^k$ | $(0 \leqq b < Mb)$ |
| $\alpha b = h_1 \times (1 - b)^k$ | $(Mb \leqq b \leqq 1)$ |

where, $f_0$, $f_1$, $g_0$, $g_1$, $h_0$, $h_1$, Mr, Mg, Mb, and k are constants, and r, g, and b are obtained by dividing original gradation levels of the RGB components of the input color image signal by a maximum gradation value N−1. These αr, αg and αb are functions where the values of gradation levels r, g and b (obtained by dividing original gradation levels of the RGB components of the input color image signal by a maximum gradation value N−1, and is standardized as 1) monotonically increase in a range of not less than 0 and less than M (M is an integer from 0 to 1), and monotonically decrease in a range of not less than M and less than 1.

By thus carrying out weighting with a coefficient monotonically increase or monotonically decrease depending on the gradation level of the input signal, it is possible to carry out color compensation in which saturation of mixed color is enhanced while saturation of the domain in the vicinity of monochromatic color is reduced.

More specifically, the functions αr, αg and αb may be expressed as follows:

| | | |
|---|---|---|
| $\alpha r = 2 \times r$ | $(0 \leqq r < 0.5)$ | (1) |
| $\alpha r = 2 \times (1 - r)$ | $(0.5 \leqq r \leqq 1)$ | (2) |
| $\alpha g = 2 \times g$ | $(0 \leqq g < 0.5)$ | (3) |
| $\alpha g = 2 \times (1 - g)$ | $(0.5 \leqq g \leqq 1)$ | (4) |
| $\alpha b = 2 \times b$ | $(0 \leqq b < 0.5)$ | (5) |
| $\alpha b = 2 \times (1 - b)$ | $(0.5 \leqq b \leqq 1)$ | (6) |

where r, g and b are functions obtained by dividing original gradation levels of the RGB components of the input color image signal by a maximum gradation value N−1, and then are standardized.

Further, they may also be denoted as follows:

| | | |
|---|---|---|
| $\alpha r = 4 \times r$ | $(0 \leqq r < 0.25)$ | (1)' |
| $\alpha r = 4/3 \times (1 - r)$ | $(0.25 \leqq r \leqq 1)$ | (2)' |
| $\alpha g = 4 \times g$ | $(0 \leqq g < 0.25)$ | (3)' |
| $\alpha g = 4/3 \times (1 - g)$ | $(0.25 \leqq g \leqq 1)$ | (4)' |

-continued

| | | |
|---|---|---|
| $\alpha b = 4 \times b$ | $(0 \leqq b < 0.25)$ | (5)' |
| $\alpha b = 4/3 \times (1 - b)$ | $(0.25 \leqq b \leqq 1)$ | (6)' |

where r, g and b are functions obtained by dividing original gradation levels of the RGB components of the input color image signal by a maximum gradation value N−1, and then are standardized.

The foregoing Expressions (1) through (6), and (1)'through (6)'use linear functions. However, the present invention, in at least one embodiment, also allows the use of exponential functions or trigonometric functions. Further, the range of the domain where mixed color monotonously increases may be controlled by changing the threshold of 0.5 for dividing the domain of condition to 0.25 or 0.7.

Based on the compensation values ro, go, bo, yo, mo, and co thus obtained, color image signals R'G'B'after color conversion (having gradation levels r', g', and b', respectively) are calculated according to following Expressions (7) through (9) (S204). The resulting values are then outputted to the color liquid crystal display panel 102 (S205).

$$r'=r+ro+yo+mo \quad (7)$$

$$g'=g+go+yo+co \quad (8)$$

$$b'=b+bo+mo+co \quad (9)$$

The respective output signals r', g', and b'for the foregoing six domains [1] through [6] may be expressed as follows by incorporating the above-mentioned Expressions for calculating the respective compensation values for the domains [1] through [6], For the domain [1] expressed as (r≧g≧b):

$$r'=r+ro+yo$$

$$g'=g+yo$$

$$b'=b$$

For the domain [2] expressed as (r≧b>g):

$$r'=r+ro+mo$$

$$g'=g$$

$$b'=b+mo$$

For the domain [3] expressed as (b>r≧g):

$$r'=r+mo$$

$$g'=g$$

$$b'=b+bo+mo$$

For the domain [4] expressed as (b>g>r):

$$r'=r$$

$$g'=g+co$$

$$b'=b+bo+co$$

For the domain [5] expressed as (g≧b>r):

$$r'=r$$

$$g'=g+go+co$$

$$b'=b+co$$

For the domain [6] expressed as (g>r≧b):

$$r'=r+yo$$

$$g'=g+go+yo$$

$$b'=b.$$

As described, the foregoing Expressions are to individually perform color compensation for two color components of the three color components of RGB, except for the smallest component. More specifically, the greatest component in gradation level among the three components of RGB is compensated by using both the compensation value of the greatest component and the compensation value of the complementary color of the greatest component and the second greatest component.

Further, the second greatest component in gradation level among the RGB components is compensated by using the compensation value of complementary color of the greatest component and the second greatest component. For example, when an input signal of the domain [1] is inputted, color compensation is performed with respect to the greatest signal R and the second greatest signal G with a manner such that the signal R is compensated by using the compensation value ro of a component R, and the compensation value yo of an Y component of the complementary color Y; and the signal G is compensated by using the compensation value yo of Y component.

Figure 4:
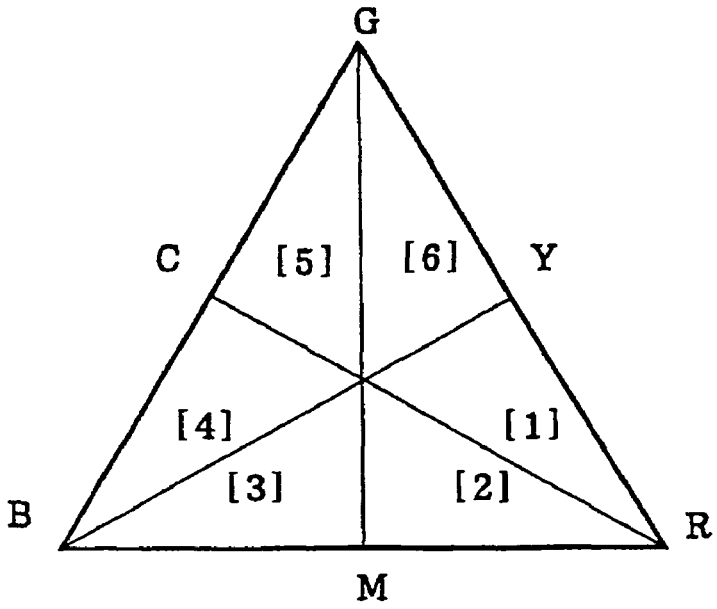
FIG. 4 is a drawing showing six color domains of an embodiment of the present invention in the form of a color triangle.

The process of the color conversion by the above operation expression will be schematically explained below with reference to FIGS. 4 and 5. FIG. 4 is a schematic view in which the foregoing six patterns are expressed as a Maxwell's color triangle. The foregoing six patterns [1] through [6] correspond to the domains [1] through [6] in the color triangle, respectively.

A color triangle is made by allotting the three primary colors of red (R), green (G), and blue (B) to each vertex of an equilateral triangle, so as to show hues made by mixture of three primary colors. The hues are shown as different positions in a coordinate system.

The intersection of three lines connecting each vertex and the middle point of each side expresses white, and the middle point of the line connecting R and G expresses yellow (Y) as complementary color which contains of R component and G component in equal amount. Similarly, the middle point of the line connecting R and B expresses magenta (M) as complementary color which contains R component and B component in equal amount, and the middle point of the line connecting B and G expresses the cyan (C) as complementary color which contains B component and G component in equal amount. Further, the gradation level becomes higher from the intersection to the vertex R, and the vividness (saturation) of a color becomes stronger from the intersection to the vertex R. The same holds true with regard to G, B, Y, M, and C.

Figure 5:
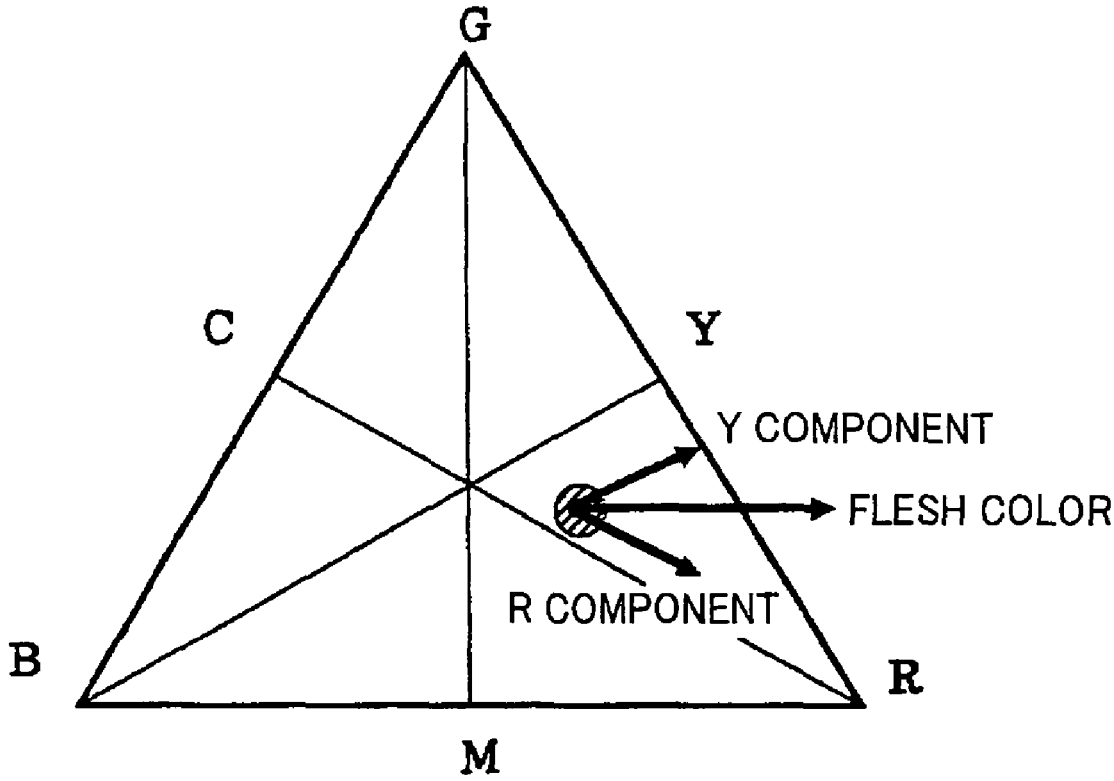
FIG. 5 is a drawing showing the color triangle in which a signal component of flesh color is being divided into a R component and an Y component.

FIG. 5 shows an example of the color triangle, showing a pixel in an image of a people's face. The position of the pixel on the color triangle changes depending on the shooting circumstances, the individual difference, and the race etc. However, in this example, the flesh color of the inputted image belongs to the domain [1], and is mainly expressed with the yellow (Y) component and the red (R) component.

When a color display device displays an image taken by a digital camera, or a picture of television broadcasting, the image or the picture are displayed in some cases with color conversion so as to increase saturation and/or luminance to be greater than the original image in order to obtain more colorful picture or more vivid colors. People's eyes generally have a characteristic to immediately notice a delicate change of the flesh color of people's face. Therefore, if the saturation is uniformly performed by the same degree with respect to an input image signal with no amount of the type of color, it will appear that only the flesh color of people's face is excessively enhanced compared with the background etc., thus resulting in an unnatural picture.

Then, in order to suppress such defect, the coefficients Krg, Krb, Kyg and Kyr relating to r'and y'are controlled independently, and are set smaller than other coefficients. As a result, the enhancement of saturation is suppressed only in the domain [1], while maintaining the same degree of saturation in other domains, thus suppressing enhancement of saturation of the flesh color. Further, in this manner, enhancement of saturation may not sufficiently work to other colors than the flesh color, such as red or yellow. However, this problem can be solved by enhancing only the monochrome side of the red or yellow by increasing the constants of Nr and Ny.

Moreover, as another method of suppressing the above-mentioned defect, the foregoing coefficients Krg, Krb, Kbr, Kbg, Kgb, Kgr, Kyg, Kmb, Kmr, Kcg, Kcb, and Kyr may satisfy Krg=Krb=Kbr=Kbg=Kgb=Kgr=C (C is a constant), and Kyg=Kmb=Kmr=Kcg=Kcb=Kyr=C/2. That is, the coefficients for compensating YMC components are set smaller than the coefficients for compensating RGB components. In this manner, it is possible to suppress the Y component. Further, the same value may be set for each value of the coefficient for compensating YMC components, as well as each value of the coefficients for compensating RGB components. In this manner, enhancement degree of saturation may be uniformed in the three primary colors RGB and the complementary colors YMC.

Furthermore, as another possible method, the coefficients Krg, Krb, Kbr, Kbg, Kgb, Kgr, Kyg, Kmb, Kmr, Kcg, Kcb and Kyr are expressed as variables by using the above-mentioned weighting functions, and each value of Cr, Cg, Cb, Cy, Cm, and Cc is set to satisfy Cr=Cg=Cb=C and Cb=Cy=Cm=C/2 (C is a constant), and then calculation is carried out according to the foregoing Expressions (7) through (9). In this case, since calculation is performed with the variables which change according to the gradation level, the gradation level after the calculation will not exceed the maximum gradation level.

For example, when calculation is performed by using conventional constants with respect to an input signal R ((r, g, b)=(200/255, 0, 0)) as a monochromatic color having the maximum gradation of 255, the calculation comes out as=(r, g, b)=(300/255, 0, 0). Since a larger value than 255 gradation is subjected to clipping due to the restriction based on 8-bit digital circuitry, the resulting display becomes (r, g, b)=(255/255, 0, 0). On the other hand, when calculation for color compensation is performed using the different constants for the respective six domains, the display result becomes (r, g, b)=(200/255, 0, 0). In this case, the value after the calculation stays the same as before, and thus the saturation is not enhanced. However, this is based on the idea that the degree of enhancement should be set small or it should not be enhanced at all in the case of a signal with high saturation or high luminance, so as not to damage expression of the entire view of the image. Therefore, in this manner, it is possible to individually control the RGB components and the YMC components, and to prevent the gradation level from exceeding the maximum value, thus displaying a picture with the colors desirably compensated.

Incidentally, the foregoing calculation operation in the color conversion processing circuit 101 may be performed by software which enforces a program with a CPU included in the color display 100. Alternatively, it may also be performed by hardware using logic circuits including but not limited to FPGA and/or ASIC.

When the calculation is performed by software, the program can be mounted to a computer (including, but not limited to any type of personal computer device) by which the program is enforced. Moreover, since operation time will be shorter with the use of hardware, it is suitable for a display requiring high-speed processing within one frame (16.7 ms), such as a liquid crystal television for displaying TV programs.

However, on the other hand, since the calculation becomes more complicated when carried out by hardware, the number of logics increases. In this case, the structure of hardware may be simplified by expressing each of the coefficients Krg, Krb, Kbr, Kbg, Kgb, Kgr, Kyg, Kmb, Kmr, Kcg, Kcb and Kyr in the form of 1/(integer power of 2), since this color image signal is a binary digital signal, and the calculation for multiplying the digital signal by 1/(integer power of 2) can easily performed by shift.

Moreover, the structure of hardware may be simplified by using the same value for each compensation coefficient of six-color components. More specifically, the number of logics for calculating the compensation values of six-color components can be reduced by satisfying Krg=Krb=Cr, Kgr=Kgb=Cg, Kbr=Kbg=Cb, Kyg=Kyr=Cy, Kmb=Kmr=Cm, and Kcg=Kcb=Cc.

Moreover, if the same value is set for the coefficients of the three primary colors RGB and the three complementary colors YMC such as in the case of Cr=Cg=Cb=Crgb or Cy=Cm=Cc=Cymc, the structure of hardware can be further simplified.

Further, since this saturation enhancement method of the present embodiment allows fine control of enhancement degree of saturation, it can also be suitably used for mobile phones including half-transmission liquid crystal with low contrast, and/or for other liquid crystal devices including but not limited to liquid crystal display televisions with high contrast. In these cases, the parameter of enhancement degree of saturation may be set up beforehand, or may otherwise allow a user to arbitrary and desirably set up upon actual usage.

EXAMPLE 1

The following describes an example based on the present embodiment. In this example, color compensation is carried out with reference to the foregoing formulas (1) through (9) with respect to an image of one's face received from television broadcasting. Each of the input color image signals RGB is an 8-bit signal (n=8) of 256 gradation (N=256). Further, by using the weighting functions (1) through (6) above, the foregoing coefficients satisfy Cr=Cg=Cb=0.5, Cy=Cm=Cc=0.25, and Nr=Ng=Nb=Ny=Nm=Nc=1.

When an image is sent, the display device performs color compensation individually for each signal corresponding to the pixels of the display device. The following explains process of color compensation in the case of compensating a signal of a pixel expressing flesh color of the face. This signal includes RGB components expressed as (r, g, b)=(192/255, 160/255, 128/255).

The first step is performed to determine a relationship of the RGB components in terms of their gradation level. In this example, it is determined that the level relationship is r>g>b, meaning that the signal belongs to the domain [1]. The gradation values in the domain [1] are expresses as follows according to the above-mentioned Expressions.

$$r'=r+ro+yo$$

$$g'=g+yo$$

$$b'=b$$

$$r'=r+ro+yo$$

$$g'=g+yo$$

$$b'=b$$

Further, referring to r=192/255, g=160/255, b=128/255, in the domains (1) through (6), r, g, b are calculated by using (2), (4) and (6), as follows.

$$ro=Krg(r-g)$$

$$yo=Kyg(g-b)$$

Further, Krg and Kyg are expressed as follows.

$$Krg=Crx2(1-r)\times 2(1-g)$$

$$Kyg=Cyx2(1-r)\times 2(1-b)$$

Accordingly, with the values of r, g and b above, the gradation levels of the R'G'B'components after color conversion may be modified as follows.

$$r'=r+ro+yo=210/255$$

$$g'=g+yo=167/255$$

$$b'=b=128/255$$

Further, following explains the case of compensating a signal for expressing a pixel of a landscape image made of a large amount of B component. This signal includes RGB components expressed as=(r, g, b)=(128/255, 160/255, 192/255). The calculation is performed as in the case above, and the gradation levels of the R'G'B'components after color conversion are modified as=(r', g', b')=(128/255, 167/255, 210/255). This series of calculations are performed with respect to the all pixels of the input image, and the signal R'G'B'as the calculation result is displayed on the display panel 102.

Figure 6:
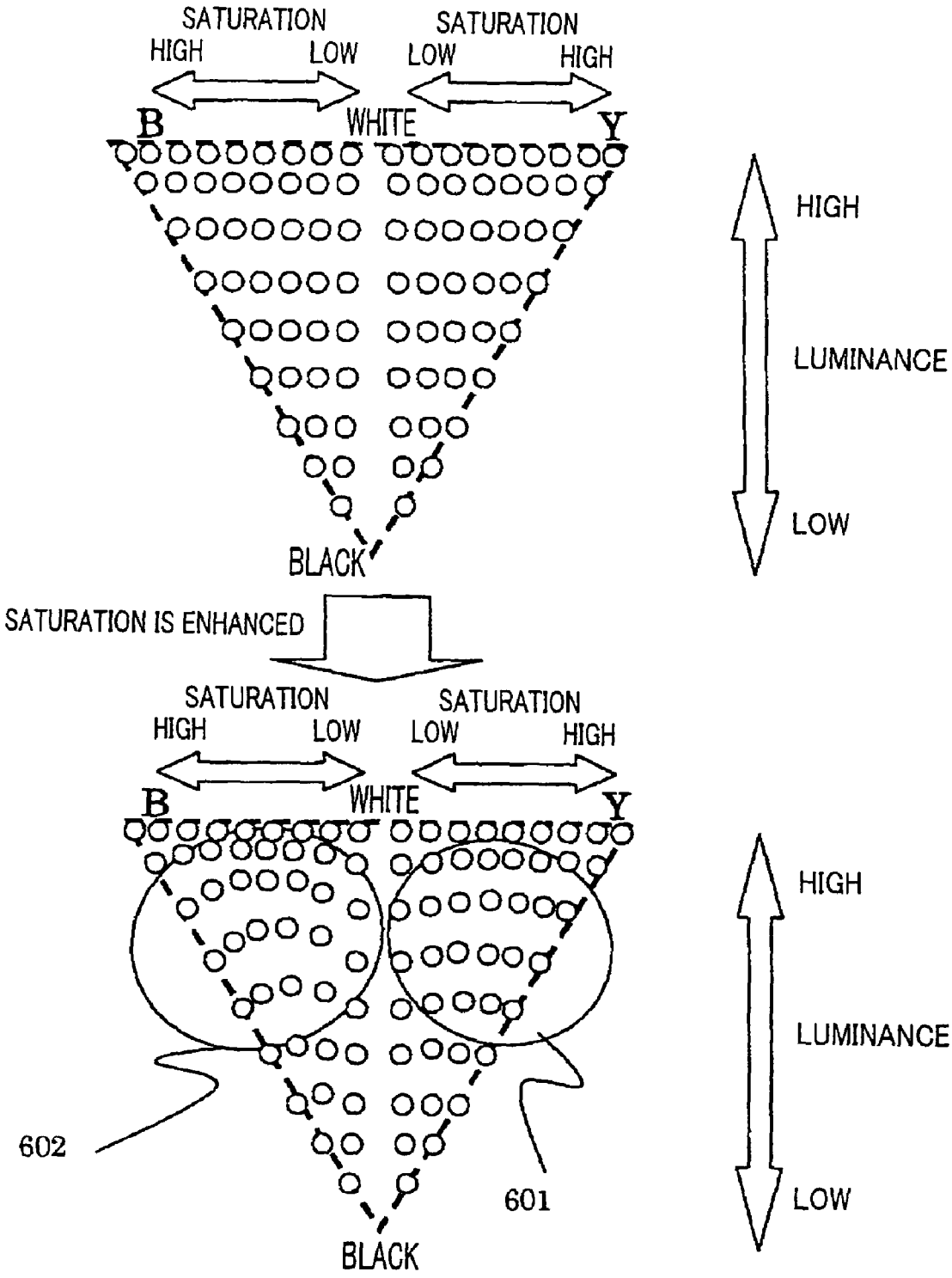
FIG. 6 is a cross-sectional view of a HSL color model for showing a change of gradation level of a signal before and after the color compensation operation in the first embodiment of the present invention.

FIG. 6 is a schematic cross-sectional view of a HSL color model, showing a process of a change in gradation level of the B component and the Y component of the input image of the present Example. As shown in FIG. 6, it can be seen that the enhancement degree (602) of saturation of the Y component for expressing the flesh color of people's face is suppressed compared with the enhancement degree (601) of saturation of the B component included in a background view etc.

That is, in the present Example, the enhancement of saturation was fully carried out with respect to the domain requiring greater saturation, such as a background view, while suppressing the enhancement of saturation of a color not requiring greater saturation. Further, since variables ware used for the color compensation calculation, each gradation level after color compensation does not fall outside the HSL, thus carrying out the color compensation without exceeding the maximum saturation and luminance.

Moreover, this Example also proved that the displayed image has no defects of a discontinuous line even in the vicinity of borderlines for dividing domains [1] through [6], since the color compensation according to the present embodiment is performed by enhancing saturation from an achromatic color toward a monochrome color.

Second Embodiment

Figure 7:
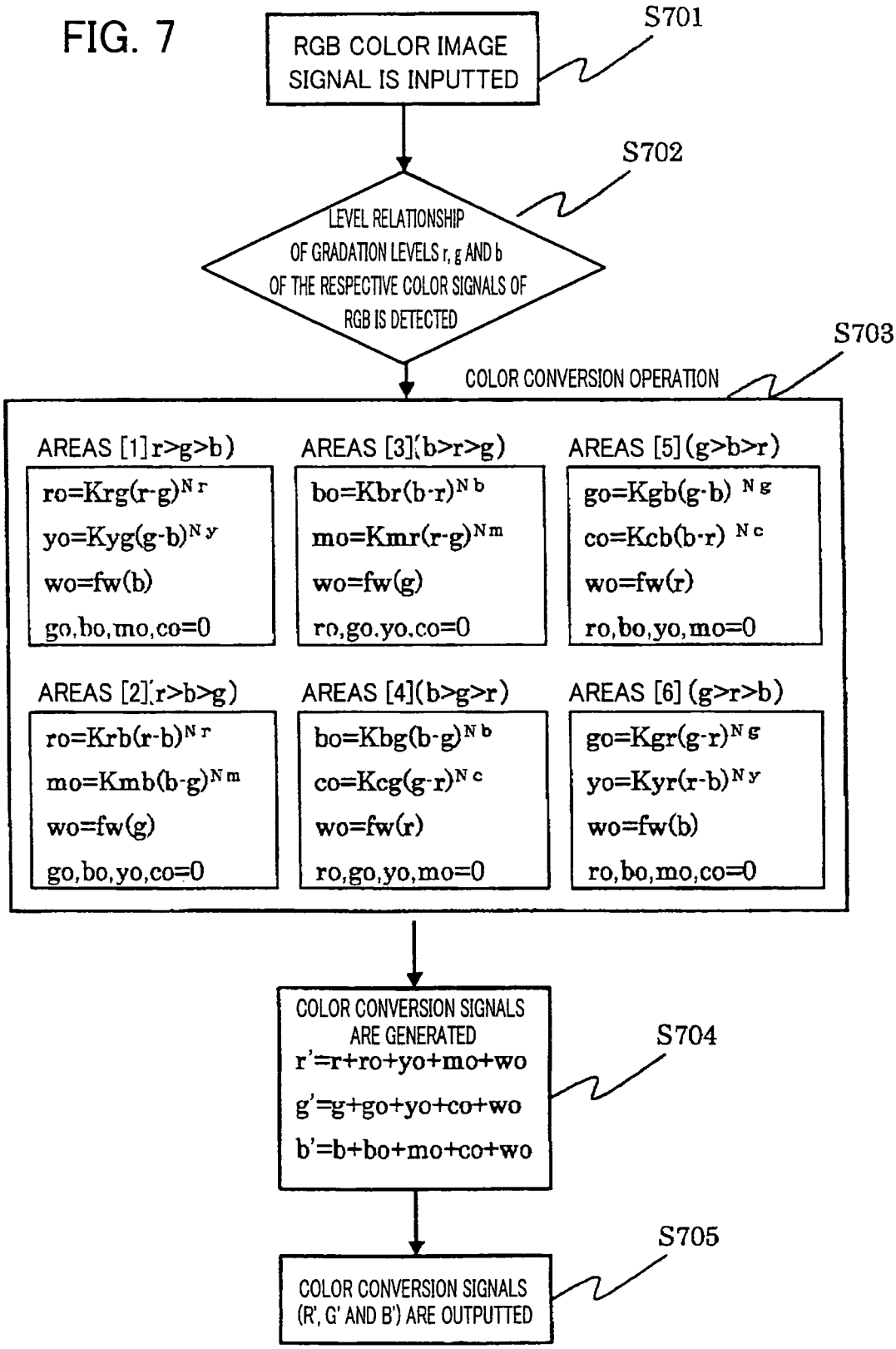
FIG. 7 is a flow chart showing a flow of color conversion operation according to the second embodiment of the present invention.
Figure 8:
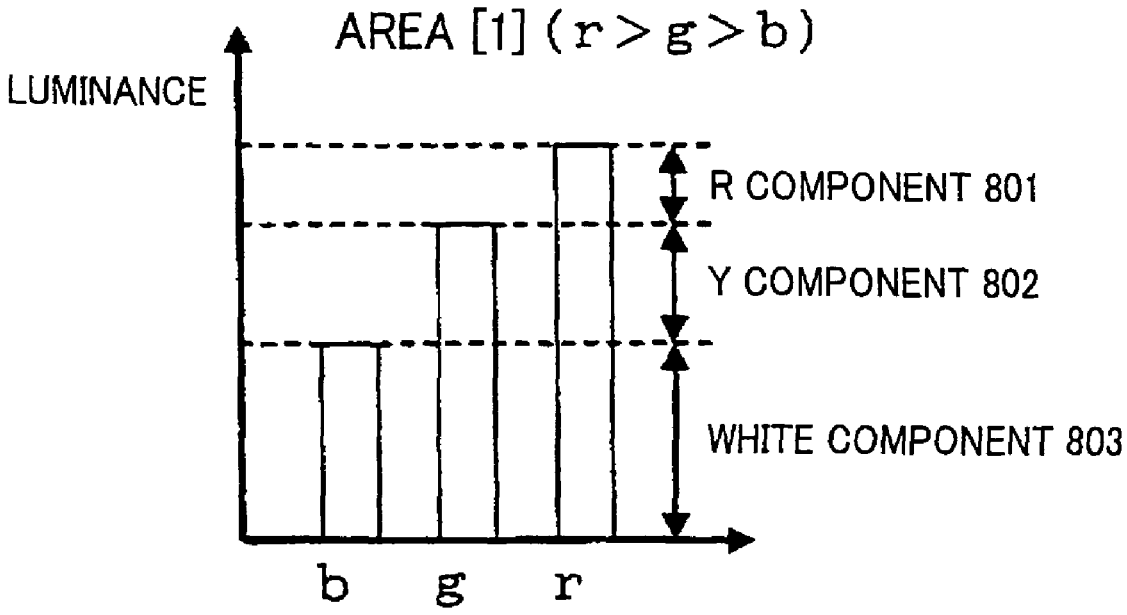
FIG. 8 is a schematic view showing an example of extraction of the color components from an input signal for carrying out color collection calculation.
Figure 9:
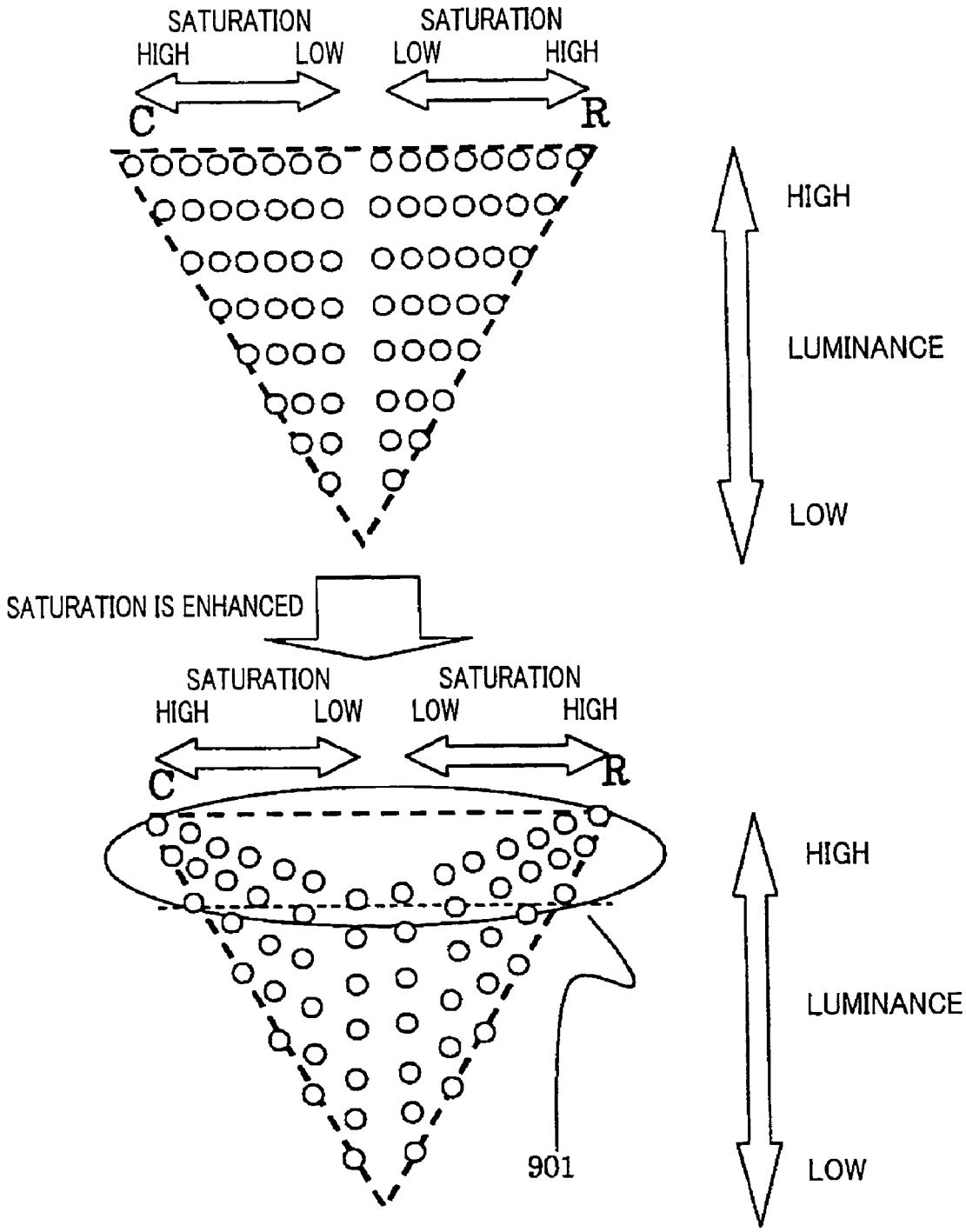
FIG. 9 is a cross-sectional view of a HSL color model for showing a change of gradation level of a signal before and after the color compensation operation in the second embodiment of the present invention.

The following will explain another embodiment of the present invention with reference to FIGS. 7 through 9. In comparison with the first embodiment, the color conversion operation circuit 101 carries out different operation in which the calculation is carried out with the account of white component of the input color signal as well as the six components RGBYMC. Since this embodiment has a similar structure to the first embodiment, materials having the equivalent functions as those shown in the drawings pertaining to the first embodiment above will be given the same reference symbols, and explanation thereof will be omitted here for ease of explanation.

FIG. 7 shows an operation flow of the color conversion operation circuit 101. When an image signal RGB is inputted (S701), the color conversion operation circuit 101 determines the level relationship among the gradation levels r, g and b of the respective color signals in the input signal (S702). More specifically, the color conversion operation circuit 101 detects which pattern of the six patterns: [1]=r>g>b, [2]=r>b>g, [3]=b>r>g, [4]=b>g>r, [5]=g>b>r and [6]=g>r>b corresponds to the pattern of the gradation values r, g and b of the input signal.

Next, compensation values ro, go, bo, yo, mo and co are calculated for carrying out color compensation of the respective color components: R, G, B, Y, M and C (S704). Here, wo expresses a white component of the input color signal. The compensation values of the respective domains [1] through [6] are calculated according to the following Expressions.

For the domain [1] expressed as (r≧g≧b):

$$ro=Krg(r-g)$$

$$yo=Kyg(g-b)$$

$$wo=fw(b)$$

$$go=bo=mo=co=0$$

For the domain [2] expressed as (r≧b>g):

$$ro=Krb(r-b)$$

$$mo=Kmb(b-g)$$

$$wo=fw(g)$$

$$go=bo=yo=co=0$$

For the domain [3] expressed as (b>r≧g):

$$bo=Kbr(b-r)$$

$$mo=Kmr(r-g)$$

$$wo=fw(g)$$

$$ro=go=yo=co=0$$

For the domain [4] expressed as (b>g>r):

$$bo=Kbg(b-g)$$

$$co=Kcg(g-r)$$

$$wo=fw(r)$$

$$ro=go=yo=mo=0$$

For the domain [5] expressed as (g≧b>r):

$$go=Kgb(g-b)$$

$$co=Kcb(b-r)$$

$$wo=fw(r)$$

$$ro=bo=yo=mo=0$$

For the domain[6] expressed as (g>r≧b):

$$go=Kgr(g-r)$$

$$yo=Kyr(r-b)$$

$$wo=fw(b)$$

$$ro=bo=mo=co=0$$

where Krg, Krb, Kbr, Kbg, Kgb, Kgr, Kyg, Kyr, Kmb, Kmr, Kcg and Kcb are constants or variables, and fw(X) (X is one of r, g and b) is a function which changes depending on the values of r, g and b.

The function fw(x) may be expressed as, for example:

$$fw(X)=CwX^{Z}$$

where Cw and Z are constants, and X is one of the r, g and b.

Otherwise, the function fw(x) may be expressed as:

$$fw(X)=Cw_0X(_0\leqq X<Mw)$$

$$fw(X)=Cw_1(1-X)(Mw\leqq X\leqq_1)$$

where $Cw_0$, $Cw_1$, Mw are constants.

Further, the foregoing coefficients Krg, Krb, Kbr, Kbg, Kgb, Kgr, Kyg, Kyr, Kmb, Kmr, Kcg and Kcb may be constants or variables. If they are variables, the variables adopted in the first embodiment may be used to obtain the same effect. That is, the variables may be expressed, for example, as follows:

$$Krg=Cr\cdot far(r)\cdot fag(g),\ Krb=Cr\cdot far(r)\cdot fab(b)$$

$$Kgr=Cg\cdot fag(g)\cdot far(r),\ Kgb=Cg\cdot fag(g)\cdot fab(b)$$

$$Kbr=Cb\cdot fab(b)\cdot far(r),\ Kbg=Cb\cdot fab(b)\cdot fag(g)$$

$$Kyg=Cy\cdot far(r)\cdot fab(b),\ Kmb=Cm\cdot far(r)\cdot fag(g)$$

$$Kmr=Cm\cdot fab(b)\cdot fag(g),\ Kcg=Cc\cdot fab(b)\cdot far(r)$$

$$Kcb=Cc\cdot fag(g)\cdot far(r),\ Kyr=Cy\cdot fag(g)\cdot fab(b)$$

where, Cr, Cb, Cg, Cy, Cm and Cc are constants, far, fab, fag, fay, fam and fac are functions which respectively change depending on the values of r, g and b in the corresponding bracket, and r, g and b are variables obtained by dividing original gradation levels of the RGB components of the input color image signal by a maximum gradation value N−1. Further, the coefficients far (r), fag (g), and fab (b) may be expressed as continuous functions which gives 0 when r, g, b (0≦r, g, b≦1) are 0 or 1. Further, the variables may be expressed as:

| | |
|---|---|
| $Krg = Cr \cdot \alpha r \cdot \alpha g$, | $Krb = Cr \cdot \alpha r \cdot \alpha b$ |
| $Kgr = Cg \cdot \alpha g \cdot \alpha r$, | $Kgb = Cg \cdot \alpha g \cdot \alpha b$ |
| $Kbr = Cb \cdot \alpha b \cdot \alpha r$, | $Kbg = Cb \cdot \alpha b \cdot \alpha g$ |
| $Kyg = Cy \cdot \alpha r \cdot \alpha b$, | $Kmb = Cm \cdot \alpha r \cdot \alpha g$ |
| $Kmr = Cm \cdot \alpha b \cdot \alpha g$, | $Kcg = Cc \cdot \alpha b \cdot \alpha r$ |
| $Kcb = Cc \cdot \alpha g \cdot \alpha r$, | $Kyr = Cy \cdot \alpha g \cdot \alpha b$ |

where Cr,Cb,Cg,Cy,Cm and Cc are constants. The αr, αg and αb may be expressed as follows:

| | |
|---|---|
| $\alpha r = f_0 \times r^k$ | $(0 \leqq r < Mr)$ |
| $\alpha r = f_1 \times (1 - r)^k$ | $(Mr \leqq r \leqq 1)$ |
| $\alpha g = g_0 \times g^k$ | $(0 \leqq g < Mg)$ |
| $\alpha g = g_1 \times (1 - g)^k$ | $(Mg \leqq g \leqq 1)$ |
| $\alpha b = h_0 \times b^k$ | $(0 \leqq b < Mb)$ |
| $\alpha b = h_1 \times (1 - b)^k$ | $(Mb \leqq b \leqq 1)$ |

where $f_0$, $f_1$, $g_0$, $g_1$, $h_0$, $h_1$, Mr, Mg, Mb and k are constants, and r, g and b are variables obtained by dividing original gradation levels of the RGB components of the input color image signal by a maximum gradation value N−1. Further, more specifically, αr, αg and αb may be expressed as:

| | | |
|---|---|---|
| $\alpha r = 2 \times r$ | $(0 \leqq r < 0.5)$ | (1) |
| $\alpha r = 2 \times (1 - r)$ | $(0.5 \leqq r \leqq 1)$ | (2) |
| $\alpha g = 2 \times g$ | $(0 \leqq g < 0.5)$ | (3) |
| $\alpha g = 2 \times (1 - g)$ | $(0.5 \leqq g \leqq 1)$ | (4) |
| $\alpha b = 2 \times b$ | $(0 \leqq b < 0.5)$ | (5) |
| $\alpha b = 2 \times (1 - b)$ | $(0.5 \leqq b \leqq 1)$ | (6) |

where r, g and b are variables obtained by dividing original gradation levels of the RGB components of the input color image signal by a maximum gradation value N−1. Otherwise, αr, αg and αb may further be expressed as follows:

| | | |
|---|---|---|
| $\alpha r = 4 \times r$ | $(0 \leqq r < 0.25)$ | (1)' |
| $\alpha r = 4/3 \times (1 - r)$ | $(0.25 \leqq r \leqq 1)$ | (2)' |
| $\alpha g = 4 \times g$ | $(0 \leqq g < 0.25)$ | (3)' |
| $\alpha g = 4/3 \times (1 - g)$ | $(0.25 \leqq g \leqq 1)$ | (4)' |
| $\alpha b = 4 \times b$ | $(0 \leqq b < 0.25)$ | (5)' |
| $\alpha b = 4/3 \times (1 - b)$ | $(0.25 \leqq b \leqq 1)$ | (6)' |

where r, g and b are variables obtained by dividing original gradation levels of the RGB components of the input color image signal by a maximum gradation value N−1.

Next, based on the compensation values ro, go, bo, yo, mo, co and wo thus obtained, color image signals R'G'B'after color conversion (having gradation levels r', g', and b', respectively) are calculated according to following Expressions (10) through (12) (S704). The resulting values are then outputted to the color liquid crystal display panel 102 (S705).

$$r'=r+ro+yo+mo+wo \quad (10)$$

$$g'=g+go+yo+co+wo \quad (11)$$

$$b'=b+bo+mo+co+wo \quad (12)$$

As described, with the foregoing Expressions, color compensation is performed by dividing the three color components of RGB into six hue domains according to the level relationship of them, and obtains three primary color components RGB, complementary color components YMC and a white component W, each of which are then multiplied by a coefficient. Then, the original primary three color components RGB are modified through addition/subtraction according to the result of multiplication.

FIG. 8 schematically shows the respective color components for color compensation extracted from an input color signal in the case where the input signal of the domain [1] is inputted. The extracted values here are (r−g) for the R component 801, (g−b) for the Y component 802, and b for the W component 803.

More specifically, the primary color components are compensated based on the difference between the greatest component and the second greatest component of the input three primary color components RGB. Further, the complementary color components are compensated based on the difference between the second greatest component and the smallest component of the input three primary color components RGB. Still further, the white component is compensated based on the smallest component of the input three primary color components RGB.

As can be seen in the calculation results of the Expressions (1) through (6), and (10) through (12), the luminance level in a domain close to an achromatic color may be reduced when the function fw(X) is a function returning a negative value under X=r, g, b. Consequently, the monochromatic colors have greater luminance than that of mixed colors, and the saturation of monochromatic colors is visually enhanced. This thus creates a more bright and vivid picture than the original picture.

Further, by setting different values for the six colors components, it is possible to obtain particular brightness for a specific color. For example, by setting the coefficients Krg and Krb for compensating red color to be greater than the other coefficients, only the red color will be more brightly displayed, thus creating a picture having bright colors.

EXAMPLE 2

The following describes an example based on the present embodiment. In this example, color compensation is carried out with reference to the foregoing formulas (1) through (6), and (10) through (12), with respect to an image of a landscape received from television broadcasting. Each of the input color image signals RGB is an 8-bit signal (n=8) of 256 gradation (N=256). Further, by using the weighting functions (1) through (6) above, the foregoing coefficients satisfy Cr=Cg=Cb=0.5, Cy=Cm=Cc=0.25, and fw (X)=−0.0625·X.

When an image is sent, the display device performs color compensation individually for each signal corresponding to the pixels of the display device. The following explains process of color compensation in the case of an achromatic signal of a pixel with the RGB components expressed as (r, g, b)=(255/255, 255/255, 255/255). First of all, according to the above-mentioned Expressions (1) through (6), a relation where ro=go=bo=yo=mo=co=0 is found. Then, with reference to the Expressions (10) through (12), the following Expressions are further found.

$$r'=r+ro+yo$$

$$g'=g+yo$$

$$b'=b$$

Further, referring to the relation where wo=−0.125×255/255=−16/255 (the formula below the decimal point is omitted), a relation where (r', g', b')=(239/255, 239/255, 239/255) is found. As described, in the case of an achromatic signal, no positive compensation values are contained, as the compensation values ro, go, bo, yo, mo and co all become 0. Accordingly, the negative compensation value of the white component will become more effective. Thus, luminance level after the color compensation can be reduced.

Furthermore, the following describes the case of compensating a monochromatic red signal of a pixel in the landscape image. The signal includes the RGB components expressed as=(r, g, b)=(255/255, 0, 0). In this case, the compensation values ro, go, bo, yo, mo and co all become 0. Further, since the smallest value of the rgb components is 0, wo also becomes 0.

Accordingly, the compensation comes out as (r', g', b')=(255/255, 0, 0). As described, in the case of a monochromatic signal, gradation level will be maintained as a high value since there is no influence of the negative compensation value of the white component.

Similarly, in the case of compensating a mixed color signal (a signal between an achromatic color and a monochromatic color) of a pixel in the landscape image and including the RGB components expressed as (r, g, b)=(192/255, 160/255, 128/255), the calculation is performed as in the case above, and the result comes out as (r', g', b')=(202/255, 159/255, 120/255). As can be seen in this example, a mixed color is under influence of both the negative compensation value of the white component and the positive compensation value of the primary color component and the complementary color component. The level of influence depends on the values of rgb of the input signal.

The color compensation is carried out by lowering the gradation level in a domain close to achromatic color, and by increasing the gradation level in a domain close to monochromatic color. This series of calculations are performed with respect to the all pixels of the input image, and the signal R'G'B'as the calculation result is displayed on the display panel 102.

FIG. 9 is a schematic cross-sectional view of a HSL color model, showing a process of a change in gradation level of the R component and the C component when the saturation is enhanced by the foregoing calculations. It can be seen in FIG. 9 that the distribution of gradation level through the saturation enhancing process forms a V-shape (901 in FIG. 9), extending from the white component to reach the vertexes of the R and C components. This distribution form results from subtraction of the white component from the coefficient fw (x) above by a function returning a negative value. In this manner, by reducing the white component after the color compensation, the enhancement of saturation becomes stronger for monochromatic colors compared with mixed colors.

Third Embodiment

Figure 17:
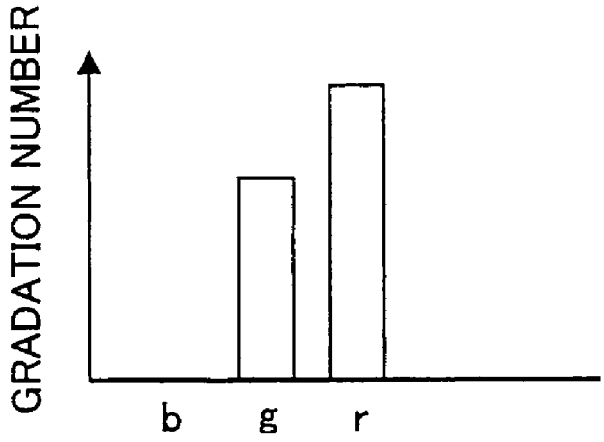
FIG. 17(*a*) shows a graph with the minimum luminance=0, and FIG. 17(*b*) shows a graph with the maximum luminance close to the maximum gradation value.
Figure 17:
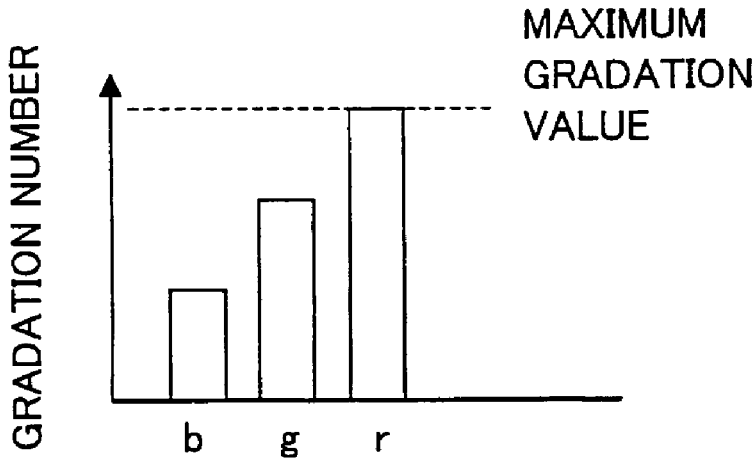
Figure 18:
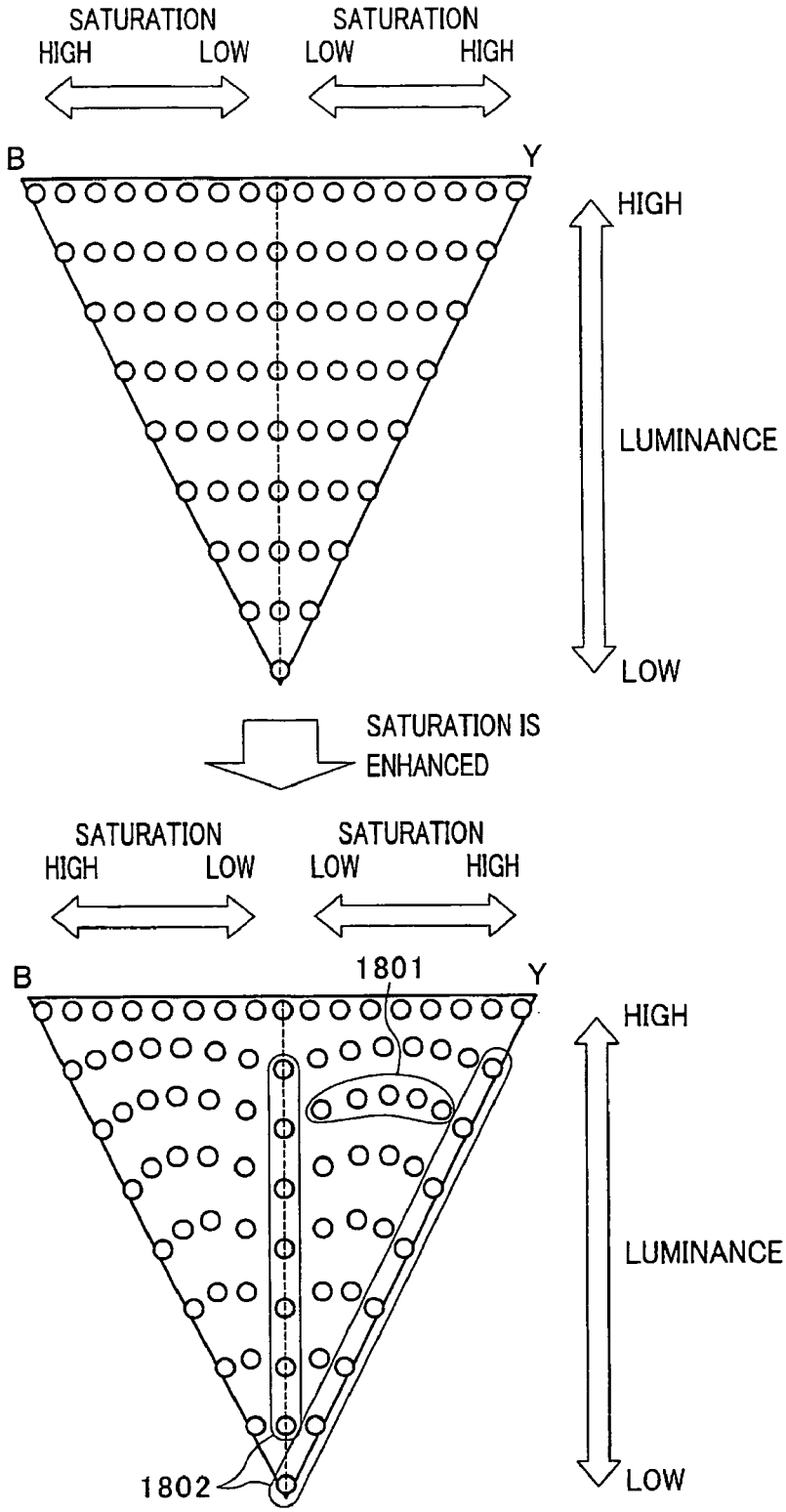
FIG. 18 is a cross-sectional view of a HSL color model for showing a change of gradation level of a signal before and after the color compensation operation with a weighting function according to the third embodiment of the present invention.

The following will explain still another embodiment of the present invention with reference to FIGS. 17 and 18. In comparison with the first and second embodiments, the color conversion operation circuit 101 of the present embodiment carries out different operation in which the calculation is carried out by taking the minimum luminance and the maximum luminance into account. Otherwise, the display device according to the present embodiment has the same structure as that of the color display device 100 of the first embodiment, and therefore, materials having the equivalent functions as those shown in the drawings pertaining to the first embodiment above will be given the same reference symbols, and explanation thereof will be omitted here for ease of explanation.

As a feature of the present embodiment, the coefficients Krg, Krb, Kbr, Kbg, Kgb, Kgr, Kyg, Kyr, Kmb, Kmr, Kcg and Kcb (weighting functions) are decided based on one of the R, G and B component having the maximum luminance and the one of them having the minimum luminance. The following explains a theory of this manner for setting the weighting functions based on the R, G or B component having the maximum luminance or the minimum luminance with an example in which an input image signal belongs to the domain [1] (r≧g≧b).

As shown in FIG. 17(*a*), when the value of b as the minimum luminance is 0, the value of b should not be enhanced since a monochromatic color already has the strongest saturation and therefore requires no more enhancement. Further, as shown in FIG. 17(*b*), when the value of r comes closer to 255/255 gradation, addition of ro or yo to the inputted r component will result in a value (output image signal r') larger than 255/255 gradation, thus degradation the gradation expression since by causing color saturation.

In view of this problem, the weighting functions are decided based on the R, G or B component having the minimum luminance (b) or the maximum luminance (r). Accordingly, the weighting function is reduced when the value of r comes closer to 255/255 gradation and when the value of r comes closer to 0.

As a specific example, the coefficients Krg, Krb, Kbr, Kbg, Kgb, Kgr, Kyg, Kyr, Kmb, Kmr, Kcg and Kcb for obtaining the compensation values ro, go, bo, yo, mo and co, as in the step S204 of the first embodiment, are calculated according to the following Expressions, $$Krg=Cr\cdot frg(r,b),Krb=Cr\cdot frb(r,g)$$

$$Kgr=Cg\cdot fgr(g,b),Kgb=Cg\cdot fgb(g,r)$$

$$Kbr=Cb\cdot fbr(b,g),Kbg=Cb\cdot fbg(b,r)$$

$$Kyg=Cy\cdot fyg(r,b),Kmb=Cm\cdot fmb(r,g)$$

$$Kmr=Cm\cdot fm\ r(b,g),Kcg=Cc\cdot fcg(b,r)$$

$$Kcb=Cc\cdot fcb(g,r),Kyr=Cy\cdot fyr(g,b)$$

where, Cr, Cb, Cg, Cy, Cm and Cc are constants, frg, frb, fgr, fgb, fbr, fbg, fyg, fmb, fmr, fcg, fcb, fyr are functions which respectively change depending on the values of r, g and b in the corresponding bracket, and r, g and b are obtained by dividing the original gradation levels of the R, G and B components of the input image signal by the maximum gradation value N−1.

The coefficients may also be expressed as:

$$Krg=Cr\cdot fa\ r(r)\cdot fag(b),Krb=Cr\cdot far(r)\cdot fab(g)$$

$$Kgr=Cg\cdot fag(g)\cdot far(b),Kgb=Cg\cdot fag(g)\cdot fab(r)$$

$$Kbr=Cb\cdot fab(b)\cdot far(g),Kbg=Cb\cdot fab(b)\cdot fag(r)$$

$$Kyg=Cy\cdot fa\ r(r)\cdot fab(b),Kmb=Cm\cdot far(r)\cdot fag(g)$$

$$Kmr=Cm\cdot fab(b)\cdot fag(g),Kcg=Cc\cdot fab(b)\cdot far(r)$$

$$Kcb=Cc\cdot fag(g)\cdot far(r),Kyr=Cy\cdot fag(g)\cdot fab(b)$$

where, Cr, Cb, Cg, Cy, Cm and Cc are constants, frg, frb, fgr, fgb, fbr, fbg, fyg, fmb, fmr, fcg, fcb, fyr are functions which respectively change depending on the values of R, G and B in the corresponding bracket, and r, g and b are variables obtained by dividing original gradation levels of the RGB components of the input color image signal by a maximum gradation value N−1.

By thus setting the coefficients, the weighting functions are decided based on one of the R, G and B component having the maximum luminance and the one of them having the minimum luminance.

For example, in the case of an input signal belonging to the domain [1], the color is compensated by using the coefficients Krg and Kyg. As can be seen in the Expressions above, the weighting functions Krg and Kyg are both decided based on the r component having the maximum luminance and the b component having the minimum luminance in the domain [1]. On this account, the weighting function is reduced when the value of the color component having the maximum luminance comes closer to the maximum gradation value, and when the value of the color component having the minimum luminance comes closer to 0.

This method prevents defect of color saturation in the case where an output color image signal has a greater gradation level than the maximum gradation value, and also prevents enhancement of saturation when the input signal is a monochromatic color, thus outputting (displaying) a color image with appropriate gradation.

Further, it is preferable that the functions far, fab and fag are continuous functions which return 0 when the values of r, g and b are 0 or 1 (under (0≦r, g, b≦1). In this case, the weighting function becomes 0 when the value of the maximum luminance comes closer to the maximum gradation value, and when the value of the minimum luminance comes closer to 0. Accordingly, it is possible to more securely prevent the defect of color saturation, and also more securely prevent enhancement of saturation when the input signal is a monochromatic color, thus securely outputting (displaying) a color image with appropriate gradation.

As a specific example, the functions may be expressed as follows:

| | |
|---|---|
| $Krg = Cr \cdot \alpha r \cdot \alpha b$, | $Krb = Cr \cdot \alpha r \cdot \alpha g$ |
| $Kgr = Cg \cdot \alpha g \cdot \alpha b$, | $Kgb = Cg \cdot \alpha g \cdot \alpha r$ |
| $Kbr = Cb \cdot \alpha b \cdot \alpha g$, | $Kbg = Cb \cdot \alpha b \cdot \alpha r$ |
| $Kyg = Cy \cdot \alpha r \cdot \alpha b$, | $Kmb = Cm \cdot \alpha r \cdot \alpha g$ |
| $Kmr = Cm \cdot \alpha b \cdot \alpha g$, | $Kcg = Cc \cdot \alpha b \cdot \alpha r$ |
| $Kcb = Cc \cdot \alpha g \cdot \alpha r$, | $Kyr = Cy \cdot \alpha g \cdot \alpha b$ |
| $\alpha r = f_0 \times r^k$ | $(0 \leqq r < Mr)$ |
| $\alpha r = f_1 \times (1 - r)^k$ | $(Mr \leqq r \leqq 1)$ |
| $\alpha g = g_0 \times g^k$ | $(0 \leqq g < Mg)$ |
| $\alpha g = g_1 \times (1 - g)^k$ | $(Mg \leqq g \leqq 1)$ |
| $\alpha b = h_0 \times b^k$ | $(0 \leqq b < Mb)$ |
| $\alpha b = h_1 \times (1 - b)^k$ | $(Mb \leqq b \leqq 1)$ |

where, Cr, Cb, Cg, Cy, Cm and Cc are constants, and r, g and b are obtained by dividing the original gradation levels of the R, G and B components of the input image signal by the maximum gradation value N−1.

Further, the foregoing αr, αg and αb may be variables expressed as:

| | |
|---|---|
| $\alpha r = f_0 \times r^k$ | $(0 \leqq r < Mr)$ |
| $\alpha r = f_1 \times (1 - r)^k$ | $(Mr \leqq r \leqq 1)$ |
| $\alpha g = g_0 \times g^k$ | $(0 \leqq g < Mg)$ |
| $\alpha g = g_1 \times (1 - g)^k$ | $(Mg \leqq g \leqq 1)$ |
| $\alpha b = h_0 \times b^k$ | $(0 \leqq b < Mb)$ |
| $\alpha b = h_1 \times (1 - b)^k$ | $(Mb \leqq b \leqq 1)$ |

where, $f_0$, $f_1$, $g_0$, $g_1$, $h_0$, $h_1$, Mr, Mg, Mb, and k are constants, and r, g and b are obtained by dividing the original gradation levels of the R, G and B components of the input image signal by the maximum gradation value N−1.

More specifically, the foregoing αr, αg and αb may be functions expressed as:

| | | |
|---|---|---|
| $\alpha r = 2 \times r$ | $(0 \leqq r < 0.5)$ | (21) |
| $\alpha r = 2 \times (1 - r)$ | $(0.5 \leqq r \leqq 1)$ | (22) |
| $\alpha g = 2 \times g$ | $(0 \leqq g < 0.5)$ | (23) |
| $\alpha g = 2 \times (1 - g)$ | $(0.5 \leqq g \leqq 1)$ | (24) |
| $\alpha b = 2 \times b$ | $(0 \leqq b < 0.5)$ | (25) |
| $\alpha b = 2 \times (1 - b)$ | $(0.5 \leqq b \leqq 1)$ | (26) |

where r, g and b are obtained by dividing the original gradation levels of the R, G and B components of the input image signal by the maximum gradation value N−1.

Further, the coefficients Krg, Krb, Kbr, Kbg, Kgb, Kgr, Kyg, Kyr, Kmb, Kmr, Kcg and Kcb may be variables expressed as follows:

$$Krg=Cr\cdot fmax(r)\cdot fmin(b), Krb=Cr\cdot fmax(r)\cdot fmin(g)$$

$$Kgr=Cg\cdot fmax(g)\cdot fmin(b), Kgb=Cg\cdot fmax(g)\cdot fmin(r)$$

$$Kbr=Cb\cdot fmax(b)\cdot fmin(g), Kbg=Cb\cdot fmax(b)\cdot fmin(r)$$

$$Kyg=Cy\cdot fmax(r)\cdot fmin(b), Kmb=Cm\cdot fmax(r)\cdot fmin(g)$$

$$Kmr=Cm\cdot fmax(b)\cdot fmin(g), Kcg=Cc\cdot fmax(b)\cdot fmin(r)$$

$$Kcb=Cc\cdot fmax(g)\cdot fmin(r), Kyr=Cy\cdot fmax(g)\cdot fmin(b)$$

where, Cr, Cb, Cg, Cy, Cm and Cc are constants, fmax and fmin are functions which respectively change depending on the values of r, g and b in the corresponding bracket, and r, g and b are obtained by dividing the original gradation levels of the R, G and B components of the input image signal by the maximum gradation value N−1.

These weighting functions are decided based on one of the R, G and B component having the maximum luminance and the one of them having the minimum luminance. On this account, as described above, it is possible to prevent the defect of color saturation in the case where an output color image signal has a greater gradation level than the maximum gradation value, and also to prevent enhancement of saturation when the input signal is a monochromatic color, thus outputting (displaying) a color image with appropriate gradation.

Further, it is preferable that the function fmax is a continuous function which gives 0 when the values of r, g and b are 0 or 1 (under (0≦r, g, b≦1) and that the function fmin is a continuous function which gives 0 when the values of r, g and b are 0. In this case, the weighting function becomes 0 when the value of the maximum luminance comes closer to the maximum gradation value, and when the value of the minimum luminance comes closer to 0. Accordingly, it is possible to more securely prevent the defect of color saturation, and also more securely prevent enhancement of saturation when the input signal is a monochromatic color, thus securely outputting (displaying) a color image with appropriate gradation.

As a specific example, the functions may be expressed as follows:

| | |
|---|---|
| $Krg = Cr \cdot Sr \cdot Tb$, | $Krb = Cr \cdot Sr \cdot Tg$ |
| $Kgr = Cg \cdot Sg \cdot Tb$, | $Kgb = Cg \cdot Sg \cdot Tr$ |
| $Kbr = Cb \cdot Sb \cdot Tg$, | $Kbg = Cb \cdot Sb \cdot Tr$ |
| $Kyg = Cy \cdot Sr \cdot Tb$, | $Kmb = Cm \cdot Sr \cdot Tg$ |
| $Kmr = Cm \cdot Sb \cdot Tg$, | $Kcg = Cc \cdot Sb \cdot Tr$ |
| $Kcb = Cc \cdot Sg \cdot Tr$, | $Kyr = Cy \cdot Sg \cdot Tb$ |
| $Tr = r^k$ | |
| $Sr = (1 - r)^k$ | |
| $Tg = g^k$ | |
| $Sg = (1 - g)k$ | |
| $Tb = b^k$ | |
| $Sb = (1 - b)^k$ | |

where, Cr, Cb, Cg, Cy, Cm and Cc are constants, and r, g and b are obtained by dividing original gradation levels of the RGB components of the input color image signal by a maximum gradation value N−1.

Further, the coefficient k is preferably set as 1, since the process for calculating the weighting functions can be simplified on condition where k=1, thus simplifying internal operation of the color conversion operation circuit 101.

The following explains with reference to a HSL color model the color compensation effect using weighting functions decided in the foregoing manner according to the maximum luminance and the maximum gradation value.

As shown in FIG. 18, through the foregoing saturation enhancement operation using weighting functions, it can be seen that the neutral color surrounded by the domain 1801 is moved toward greater luminance and a more intense saturation. Along this line, it is understood that the use of the foregoing weighting function increases luminance and saturation. Meanwhile, it also can be seen that the monochromatic colors and the achromatic colors, which are expressed as the domain 1802, show no changes in luminance through the foregoing saturation enhancement operation.

Fourth Embodiment

Figure 19:
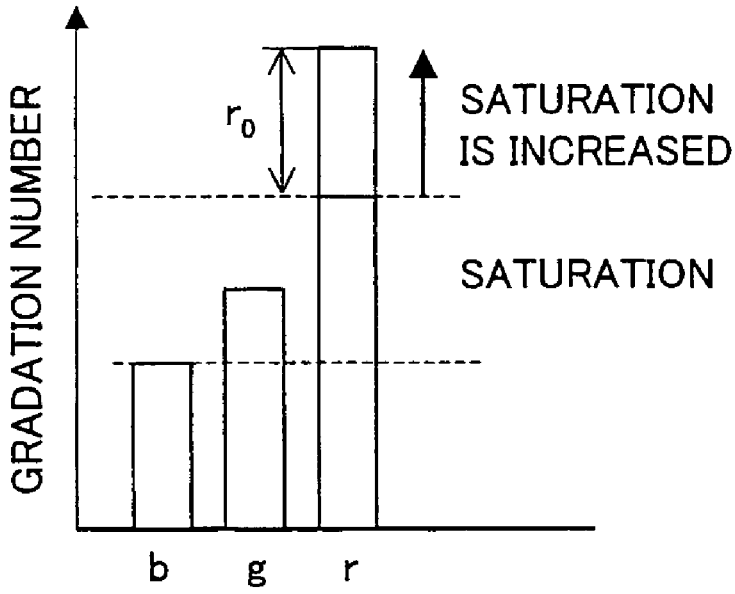
FIG. 19 shows a graph where the maximum luminance is increased in the color compensation according to the fourth embodiment of the present invention.
Figure 20:
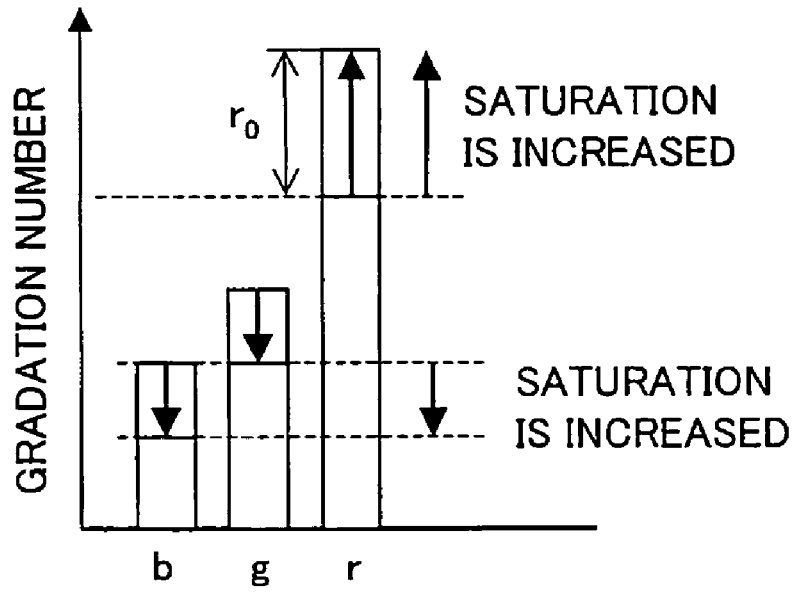
FIG. 20 shows a graph where the maximum luminance is increased and also the minimum luminance is decreased in the color compensation according to the fourth embodiment of the present invention.

The following will explain yet another embodiment of the present invention with reference to FIGS. 19 and 20. In comparison with the described embodiments above, in the present embodiment, the color conversion operation circuit 101 carries out efficient color compensation operation by reducing the minimum value of RGB. Otherwise, the display device according to the present embodiment has the same structure as that of the color display device 100 of the foregoing embodiments, and therefore, materials having the equivalent functions as those shown in the drawings pertaining to the first embodiment above will be given the same reference symbols, and explanation thereof will be omitted here.

As mentioned above, the saturation is defined as the difference between the maximum value and the minimum value of the respective gradation levels for expressing R, G and B. Thus, saturation can be enhanced by either increasing the maximum value or by reducing the minimum value in the respective gradation levels of R, G and B.

In the described embodiments above, the saturation is enhanced by increasing the maximum value. For example, when an image signal belonging to the domain [1] (expressed as r≧g≧b) is inputted, saturation is enhanced by adding value ro to the input gradation level r, as shown in FIG. 19.

On the other hand, in the present embodiment, the saturation enhancement is efficiently carried out by increasing the maximum value and reducing the minimum value, i.e., by increasing the difference of the maximum value and the minimum value.

More specifically, as shown in FIG. 20, when an image signal belonging to the domain [1] (expressed as r≧g≧b) is inputted, the value of b component is reduced. Further, when an image signal belonging to the domain [2] (expressed as r≧b≧g) is inputted, the value of g component is reduced. As a result, saturation of R color can be effectively enhanced.

The following concretely explains saturation enhancement operation of the present embodiment. In the first embodiment above, the gradation levels r', g', b'after color conversion are calculated according to the following expressions (7) through (9).

$$r'=r+ro+yo+mo \tag{7}$$

$$g'=g+go+yo+co \tag{8}$$

$$b'=b+bo+mo+co \tag{9}$$

where r, g and b express gradation levels of R, G and B components of the input color signals, respectively.

Further, the following relations are also found.

In the case of the domain [1] expressed as r≧g≧b:

$$ro=Krg(r-g)^{Nr}$$

$$yo=Kyg(g-b)^{Ny}$$

$$go=bo=mo=co=0$$

In the case of the domain [2] expressed as r≧b>g:

$$ro=Krb(r-b)^{Nr}$$

$$mo=Kmb(b-g)^{Nm}$$

$$go=bo=yo=co=0$$

In the case of the domain [3] expressed as b>r≧g:

$$bo=Kbr(b-r)^{Nb}$$

$$mo=Kmr(r-g)^{Nm}$$

$$ro=go=yo=co=0$$

In the case of the domain [4] expressed as b>g>r:

$$bo=Kbg(b-g)^{Nb}$$

$$co=Kcg(g-r)^{Nc}$$

$$ro=go=yo=mo=0$$

In the case of the domain [5] expressed as g≧b>r:

$$go=Kgb(g-b)^{Ng}$$

$$co=Kcb(b-r)^{Nc}$$

$$ro=bo=yo=mo=0$$

In the case of the domain [6] expressed as g>r>b:

$$go=Kgr(g-r)^{Ng}$$

$$yo=Kyr(r-b)^{Ny}$$

$$ro=bo=mo=co=0$$

The foregoing expressions (7) through (9) may also be expressed as follows by using square matrix $A_{36}$ of 3×6.

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

In the case of the domain [1] expressed as r≧g≧b $$ro=Krg(r-g)^{Nr}$$

$$yo=Kyg(g-b)^{Ny}$$

$$go=bo=mo=co=0$$

In the case of the domain [2] expressed as [2]r≧b≧g $$ro=Krb(r-b)^{Nr}$$

$$mo=Kmb(b-g)^{Nm}$$

$$go=bo=yo=co=0$$

In the case of the domain [3] expressed as b>r≧g $$bo=Kbr(b-r)^{Nb}$$

$$mo=Kmr(r-g)^{Nm}$$

$$ro=go=yo=co=0$$

In the case of the domain [4] expressed as b>g>r $$bo=Kbg(b-g)^{Nb}$$

$$co=Kcg(g-r)^{Nc}$$

$$ro=go=yo=mo=0$$

In the case of the domain [5] expressed as g≧b>r $$go=Kgb(g-b)^{Ng}$$

$$co=Kcb(b-r)^{Nc}$$

$$ro=bo=yo=mo=0$$

In the case of the domain [6] expressed as g>r>b $$go=Kgr(g-r)^{Ng}$$

$$yo=Kyr(r-b)^{Ny}$$

$$ro=bo=mo=co=0$$

In the present embodiment, when $A_{36}$ is expressed as follows, $$A_{36} = \begin{pmatrix} a11 & a12 & a13 & a14 & a15 & a16 \\ a21 & a22 & a23 & a24 & a25 & a26 \\ a31 & a32 & a33 & a34 & a35 & a36 \end{pmatrix}$$

it is required to satisfy:

$$a11=a22=a33=a14=a24=a15=a35=a26=a36=1,$$

and also, a21,a31,a12,a32,a13,a23,a34,a25,a16 should be set as 0 or a negative value.

With this arrangement, r', g' and b' may be expressed as:

$$r'=r+ro+a12\cdot go+a13\cdot bo+yo+a15\cdot mo+a16\cdot co \qquad \text{Formula (20)}$$

$$g'=g+a21\cdot ro+go+a23\cdot bo+a24\cdot yo+mo+a26\cdot co \qquad \text{Formula (21)}$$

$$b'=b+a31\cdot ro+a32\cdot go+bo+a34\cdot yo+a35\cdot mo+co \qquad \text{Formula (22),}$$

and further, since go=bo=mo=co=0 is satisfied under r>g>b, the followings are found.

$$r'=r+ro+yo$$

$$g'=g+a21\cdot ro+a24\cdot yo$$

$$b'=b+a31\cdot ro+a34\cdot yo.$$

Further, by setting a31 to be not more than 0, the B signal is reduced, and the R signal is enhanced. Further, in the case where r>b>g, a21 is set to be not more than 0, and the G signal is reduced and the R signal is enhanced. In this manner, saturation of the R signal is more efficiently enhanced.

Similarly, by setting a12 and a32 to be not more than 0, saturation of the G signal is efficiently enhanced, and by setting a13 and a23 to be not more than 0, saturation of the B signal is efficiently enhanced.

Further, $A_{36}$ satisfies:

and, further preferably satisfies:

$$a11=a22=a33=a14=a24=a15=a35=a26=a36=1,$$

$$a11+a21+a31=0,$$

$$a12+a22+a32=0,$$

$$a13+a23+a33=0,$$

$$a14+a24+a34=0,$$

$$a15+a25+a35=0, \text{ and}$$

$$a16+a26+a36=0$$

With these conditions, it is possible to equalize the gross input luminance (r+g+b) and the gross output luminance (r'+g'+b'). Therefore, saturation may be enhanced without a great change of average luminance of the input color signal.

Further, $A_{36}$ satisfies:

$$A_{36}=\begin{pmatrix} a11 & a12 & a13 & a14 & a15 & a16 \\ a21 & a22 & a23 & a24 & a25 & a26 \\ a31 & a32 & a33 & a34 & a35 & a36 \end{pmatrix}$$

and, further preferably satisfies:

$$a11=a22=a33=a14=a24=a15=a35=a26=a36=1,$$

$$a21=a31=a12=a32=a13=a23=-0.5, \text{ and}$$

$$a34=a25=a16=-2.$$

With these conditions, it is possible to evenly carry out addition/subtraction for each of the RGB signals. Therefore, saturation may be enhanced without changing hues.

Fifth Embodiment

Figure 21:
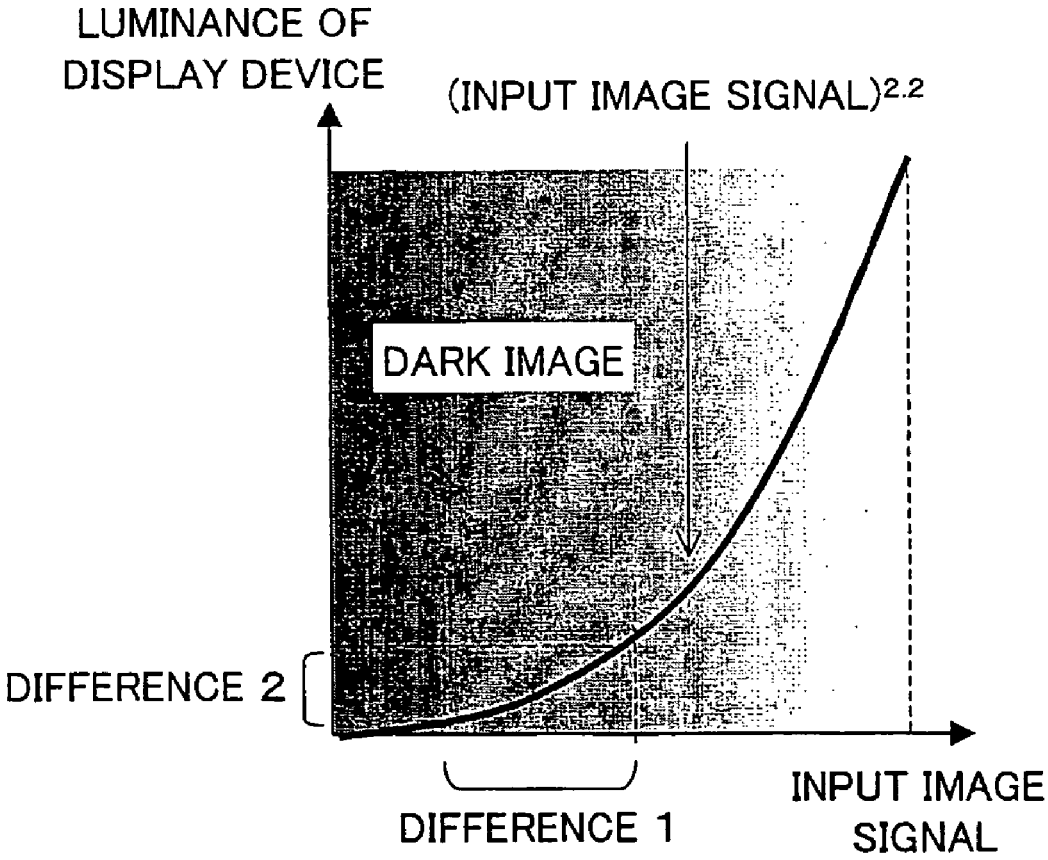
FIG. 21 shows a graph showing a relationship between luminance of an input image signal and the actual luminance of a display device.
Figure 22:
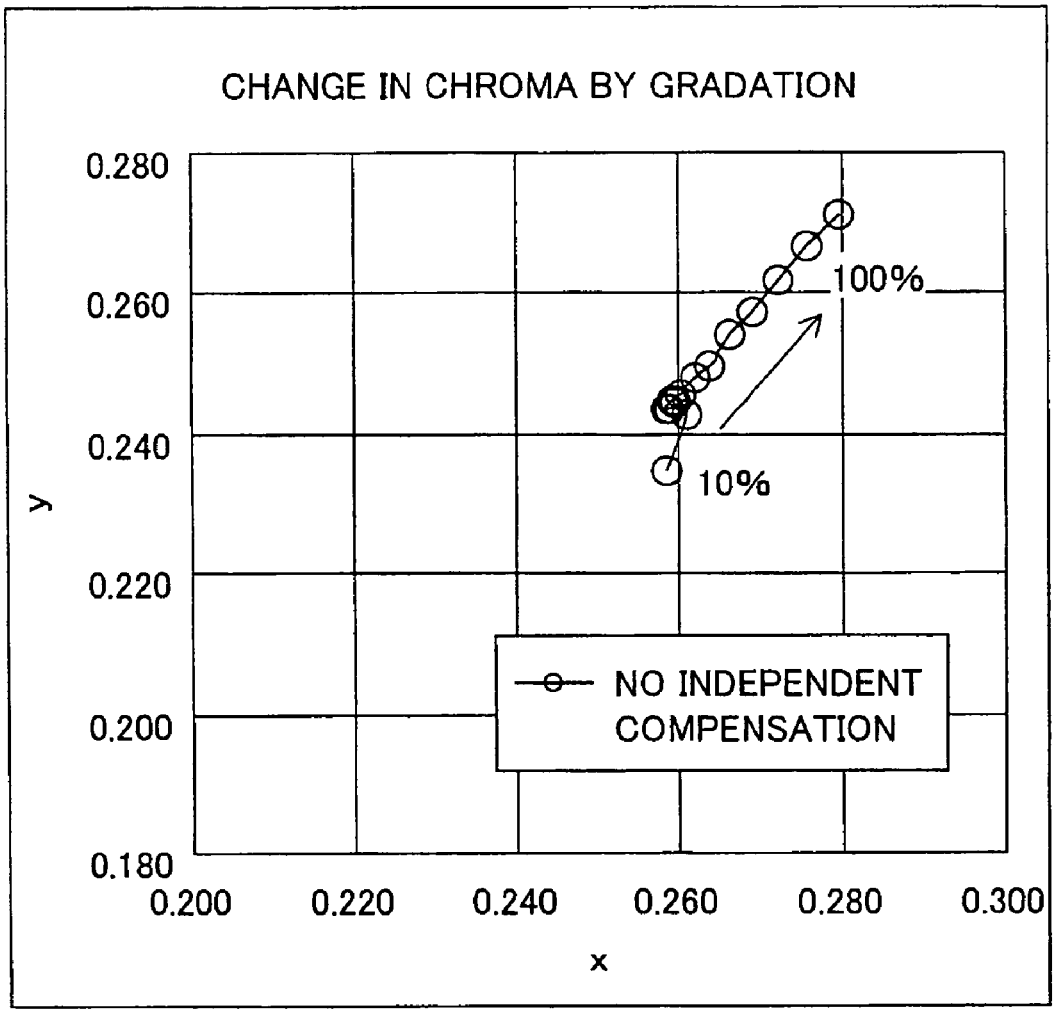
FIG. 22 shows a graph showing a relationship between transmittance and a change in chromaticity.

The following will explain still another embodiment of the present invention with reference to FIGS. 21 and 22. In comparison with the described embodiments above, in the present embodiment, the color conversion operation circuit 101 compensates the rgb values of an input image signal to a luminance value of the panel, before calculating the compensation values ro, go and bo. Otherwise, the display device according to the present embodiment has the same structure as that of the color display device 100 of the first embodiment, and therefore, materials having the equivalent functions as those shown in the drawings pertaining to the first embodiment above will be given the same reference symbols, and explanation thereof will be omitted here.

Though the inputted values of r, g and b denote gradation number of an image signal, it does not necessarily coincide with the actual luminance value of the display device. For example, in a general display device, the luminance of the display device corresponds to the value obtained by raising the respective values of r, g and b to 2.2th power, as shown in FIG. 21. When the difference among the r, g and b are calculated before being compensated to the luminance value, the calculated difference for a low luminance domain will be a larger value than the actual difference, as shown in FIG. 21 in which the value of the difference a is larger than the value of the difference 2.

Consequently, with the increase of the calculated results of ro, go and bo, the enhancement of saturation becomes exceedingly high, thus giving too much color to a dark display.

In view of this problem, in the present embodiment, the inputted rgb values are first compensated to the luminance value of the display device, before calculating the difference thereof.

More specifically, the input color image signal is modified to an output color image signal having the R, G and B gradation levels with the values of r', g' and b', according to the following formula.

$$\begin{pmatrix} r' \\ g' \\ b' \end{pmatrix}=\begin{pmatrix} r \\ g \\ b \end{pmatrix}+A_{36}\begin{pmatrix} ro \\ go \\ bo \\ yo \\ mo \\ co \end{pmatrix}$$

where r, g and b express gradation levels of R, G and B components of the inputted color image signal, and $A_{36}$ expresses square matrix of 3×6. Also, the compensation values are calculated for each domain as follows.

For the domain [1] expressed as (r≧g≧b):

$$ro=Krg(fzr(r)-fzg(g))^{Nr}$$

$$yo=Kyg(fzg(g)-fzb(b))^{Ny}$$

$$go=bo=mo=co=0$$

For the domain [2] expressed as (r>b>g):

$$ro=Krb(fzr(r)-fzb(b))^{Nr}$$

$$mo=Kmb(fzb(b)-fzg(g))^{Nm}$$

$$go=bo=yo=co=0$$

For the domain [3] expressed as (b>r>g):

$$bo=Kbr(fzb(b)-fzr(r))^{Nb}$$

$$mo=Kmr(fzr(r)-fzg(g))^{Nm}$$

$$ro=go=yo=co=0$$

For the domain [4] expressed as (b>g>r):

$$bo=Kbg(fzb(b)-fzg(g))^{Nb}$$

$$co=Kcg(fzg(g)-fzr(r))^{Nc}$$

$$ro=go=yo=mo=0$$

For the domain [5] expressed as (g>b>r):

$$go=Kgb(fzg(g)-fzb(b))^{Ng}$$

$$co=Kcb(fzb(b)-fzr(r))^{Nc}$$

$$ro=bo=yo=mo=0$$

For the domain[6] expressed as (g>r≧b):

$$go=Kgr(fzg(g)-fzr(r))^{Ng}$$

$$yo=Ky\ r(fz\ r(r)-fzb(b))^{Ny}$$

$$ro=bo=mo=co=0.$$

Here, Krg, Krb, Kbr, Kbg, Kgb, Kgr, Kyg, Kyr, Kmb, Kmr and Kcg are variables which respectively change depending on the values of r, g and b; Nr, Ng, Nb, Ny, Nm and Nc are constants not less than 0; and fzr, fzg and fzb are functions which change depending on the values of r, g and b in the corresponding bracket.

In this manner, the compensation values ro, go, . . . may be calculated after modifying the inputted rgb values by using the functions fzr, fzg and fzb. On this account, the compensation values can be prevented from exceedingly increasing. With this structure, it is possible to prevent giving too much color to a dark display as a result of exceeding enhancement of saturation.

Further, the luminance value is preferably compensated individually to each of r, g and b. When the transmittance is changed in a liquid crystal panel, there causes wavelength dispersion, which brings about a change in white balance. Accordingly, the luminance coordinate of white shows such tendency as the solid line of FIG. 22 with respect to changes in transmittance. Note that, in FIG. 22, the vertical axis and the horizontal axis express chromaticity coordinates, showing a line connecting a plurality of plots during a change in transmittance from 10% to 100%. It can be seen in FIG. 22 that the chromaticity increases toward upper right of the figure as the transmittance increases. In other words, as the luminance rises, white becomes more yellowish.

This indicates that the gradation luminance characteristic is different in each of RGB. That is, it is preferable that the function for converting the gradation value to the luminance value is individually determined for each of RGB. Accordingly, in the present embodiment, it is preferable that the functions fzr, fzg and fzb have a function of changing unified input values to varied output values. Further, fzr, fzg and fzb may also be set as follows.

$$fzr=r^{2.2},$$

$$fzg=g^{2.2},$$

$$fzb=b^{2.2}$$

Since a general display panel compensates the gradation levels of R, G and B to luminance values by raising the respective values to 2.2th power, the manner above allows enhancement of saturation in more suitable manner for a general display device.

Further, fzr, fzg and fzb may also be set as follows.

$$fzr=r^2,$$

$$fzg=g^2,$$

$$fzb=b^2$$

With this method, the saturation can be appropriately enhanced with simple operation by raising the gradation levels of R, G and B to the second power.

Sixth Embodiment

Figure 10:
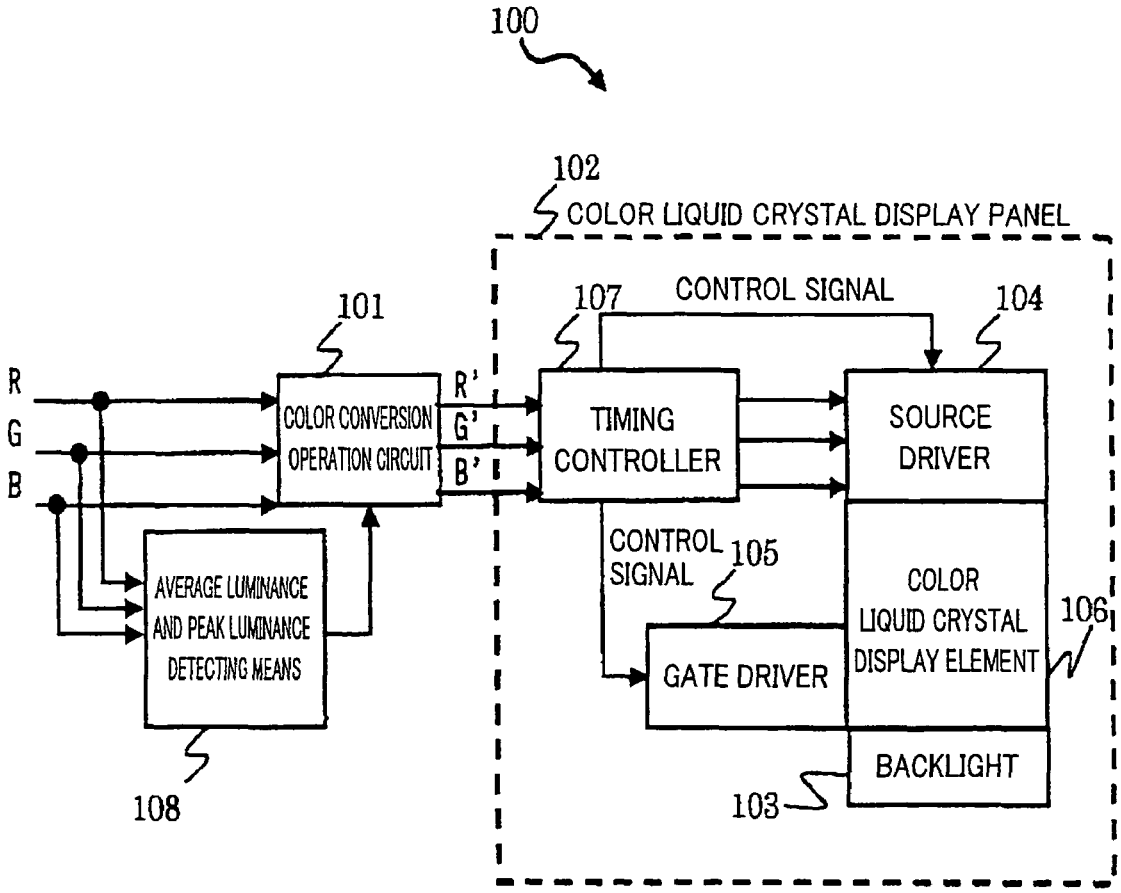
FIG. 10 is a block diagram schematically showing an arrangement of a color display device according to the sixth embodiment of the present invention.
Figure 11:
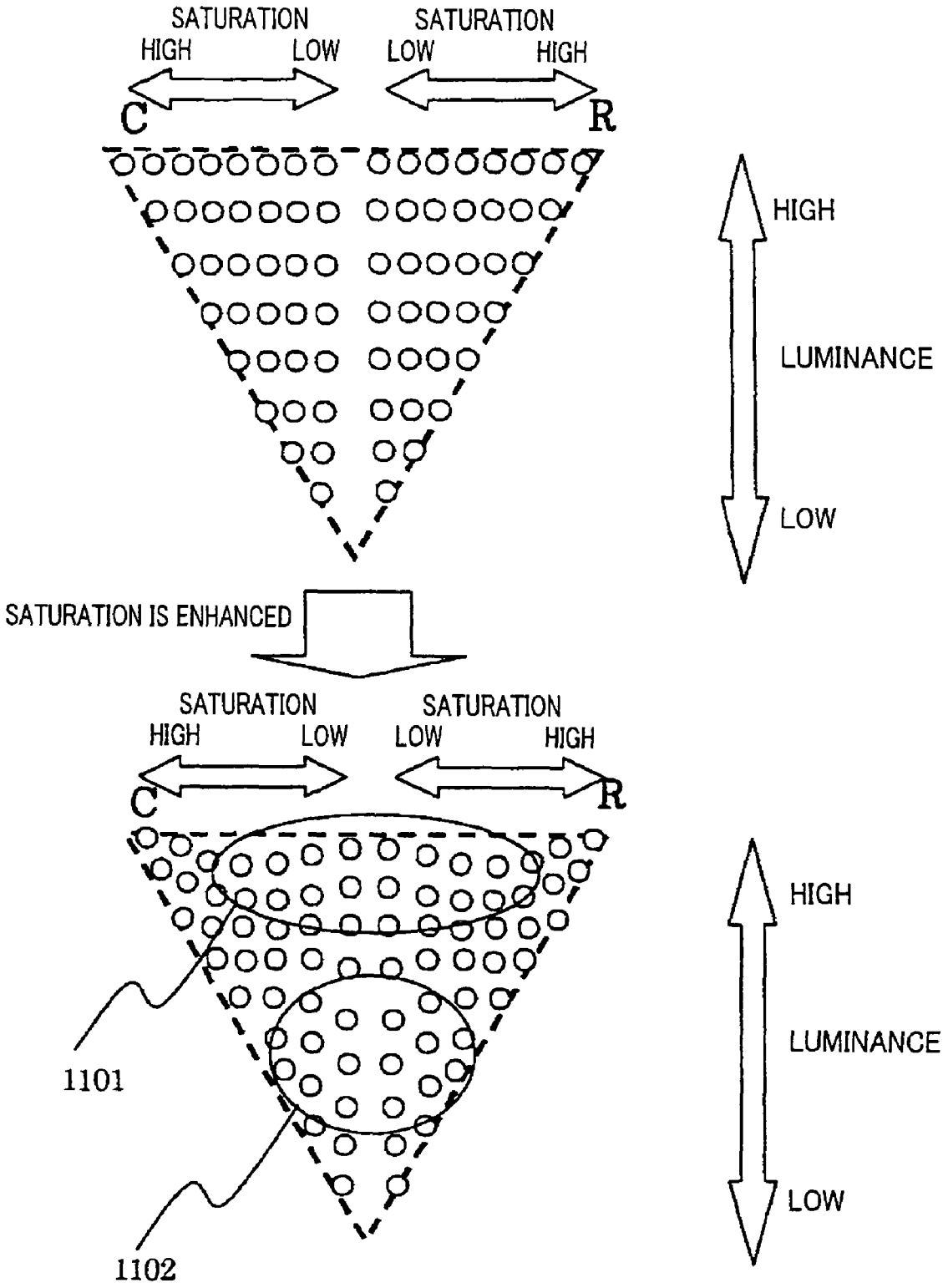
FIG. 11 is a cross-sectional view of a HSL color model for showing a change of gradation level of a signal before and after the color compensation operation in the sixth embodiment of the present invention.

The following will explain still another embodiment of the present invention with reference to FIGS. 10 and 11. In comparison with the first and second embodiments, the display device of the present embodiment further includes an average luminance and peak luminance detecting device 108. Otherwise, the display device according to the present embodiment has a similar structure to that above, and therefore, explanation of equivalent function will be omitted here. The average luminance and peak luminance detecting device 108 calculates the average value and the maximum value of gradation values r, g and b of the R, G and B components, and then outputs the average luminance and the peak luminance to the color conversion operation circuit 101.

Appearance of color images displayed in a liquid crystal display device often relies on the luminance of white rather than the saturation. A typical example of this case is a black background with white texts. In such a display, increasing relative saturation of a monochromatic color by decreasing the luminance of white results in darkening the white texts, thus deteriorating the entire image.

This problem may be solved by setting the function fw (X) as a continuous function which gives a positive value at a high luminance, and gives a negative value at a low luminance. In this manner, the high luminance of the white can be kept while enhancing relative saturation of monochromatic color with respect to mixed colors having at or less than the middle luminance.

FIG. 11 shows a process of a change in gradation in this case. As shown in FIG. 11, the domain 1101 expressing an achromatic color with a high luminance, such as white texts, keeps the luminance, whereas the luminance in the domain 1102 expressing an achromatic color in the vicinity of neutral color is reduced. Therefore, saturation of monochromatic colors can be relatively enhanced. On this account, it is possible to display white texts upon TV programs or a white plate with colorful food, thus improving impression of the entire image.

Further, a superior effect can be obtained by using a function fw (X) which changes depending on the average luminance or the peak luminance of the entire image. More specifically, by identifying image information of a black background with white texts etc. among the information of the average luminance or the peak luminance of the entire image, and selecting an optimal fw (X), it becomes possible to effectively enhance saturation of a monochromatic color while maintaining the high luminance of white.

Seventh Embodiment

Incidentally, in recent years, there has been a new display device provided with a wide color reproduction range as a fundamental function, along with improvement of backlight system or more appropriate designing value for a color filter. A LCD (Liquid Crystal Display) device including a LED (Light Emitting Diode) backlight is one example of such a display device. This display device is capable of displaying a color image with a wider color range than the color range of the input color image signal, thus displaying the input color image signal with a superior brightness.

However, when the input color image signal is displayed with a superior brightness, the flesh color etc. becomes deeper in display than the original color, and therefore the entire display becomes unnatural. In view of this problem, this type of display device needs reduction in saturation of the flesh color etc. In this view, it should be noted that Document 1 above only describes a method of enhancing saturation, and there is no disclosure of methods for decreasing saturation of the entire image or methods for decreasing saturation of specific colors such as the flesh color which becomes deeper in display due to a wider color reproduction range.

One possible strategy to solve this problem is setting the foregoing coefficients Cr, Cg, Cb, Cy, Cm and Cc as negative values. Though this arrangement surely decreases saturation of the entire display, there is a difficulty for decreasing only a specific color (for example only the flesh color), since the method decreases saturation of the whole image, and therefore, a decrease of saturation of the flesh color means a decrease of saturation of monochromatic colors such as red or yellow.

To overcome this defect, the present embodiment converts an input color image signal into an output color image signal in which the RGB components respectively have gradation levels of r', g' and b', which are given by the following expressions:

$$r'=r+ro+yo+mo$$

$$g'=g+go+yo+co$$

$$b'=b+bo+mo+co$$

where r, g and b respectively express gradation levels of RGB components of the inputted color image signal; and, In the case [1] where r≧g≧b:

$$ro=Krg\cdot fnr(r-g)$$

$$yo=Kyg\cdot fny(g-b)$$

$$go=bo=mo=co=0$$

In the case [2] where r>b>g:

$$ro=Krb\cdot fnr(r-b)$$

$$mo=Kmb\cdot fnm(b-g)$$

$$go=bo=yo=co=0$$

In the case [3] where b>r≧g:

$$bo=Kbr\cdot fnb(b-r)$$

$$mo=Kmr\cdot fnm(r-g)$$

$$ro=go=yo=co=0$$

In the case [4] where b>g>r:

$$bo=Kbg\cdot fnb(b\cdot g)$$

$$co=Kcg\cdot fnc(g-r)$$

$$ro=go=yo=mo=0$$

In the case [5] where g≧b>r:

$$go=Kgb\cdot fng(g-b)$$

$$co=Kcb\cdot fnc(b-r)$$

$$ro=bo=yo=mo=0$$

In the case [6] where g>r≧b:

$$go=Kgr\cdot fng(g-r)$$

$$yo=Kyr\cdot fny(r-b)$$

$$ro=bo=mo=co=0$$

where Krg, Krb, Kbr, Kbg, Kgb, Kgr, Kyg, Kyr, Kmb, Kmr, Kcg and Kcb are variables which change depending on values of r, g and b; and fnr(DX), fng(DX), finb(DX), fny(DX), fnm(DX) and fnc(DX) are functions which respectively change depending on calculation result DX (0≦DX≦1) of corresponding brackets.

Further, it is preferable that the functions fng(DX), fnb (DX), fnm(DX) and fnc(DX) are set as follows.

$$fng(DX)=DX^{Ng}$$

$$fnb(DX)=DX^{Nb}$$

$$fnm(DX)=DX^{Nm}$$

$$fnc(DX)=DX^{Nc}$$

With this arrangement, it is possible to adjust the respective saturations of green, blue, magenta and cyan, as with Example 1.

Further, it is preferable that the functions fnr(DX), fng (DX), fnb(DX), fny(DX), fnm(DX) and fnc(DX) return 0 when DX=0, and return a negative value at least once in a range of 0<DX≦1. Namely, the functions fnr(DX), fng(DX), fnb(DX), fny(DX), fnm(DX) and fnc(DX) return a negative value at least at a predetermined value in a range of 0<DX≦1. Ideally, it is preferable that the functions fnr and fny return a negative value when DX=0.25. Reasons for this arrangement will be explained later.

Further, it is preferable that the functions fnr(DX) and fny(DX) are expressed as:

$$fnr(DX)=DX^{Z}-Pr\cdot DX,$$

$$fny(DX)=DX^{Z}-Py\cdot DX,$$

where Pr and Py are constants greater than 0. In this manner, the functions fnr(DX) and fny(DX) may be written in a simpler form which allows easy implementation with hardware.

The following will more specifically explain color compensation operation of the present embodiment. In comparison with the first embodiment, the color conversion operation circuit 101 carries out different operation in figuring out the compensation values ro, go, bo, mo and co. Otherwise, this embodiment has a similar structure to the first embodiment, and therefore explanations of materials having the equivalent functions will be omitted here for ease of explanation.

Figure 24:
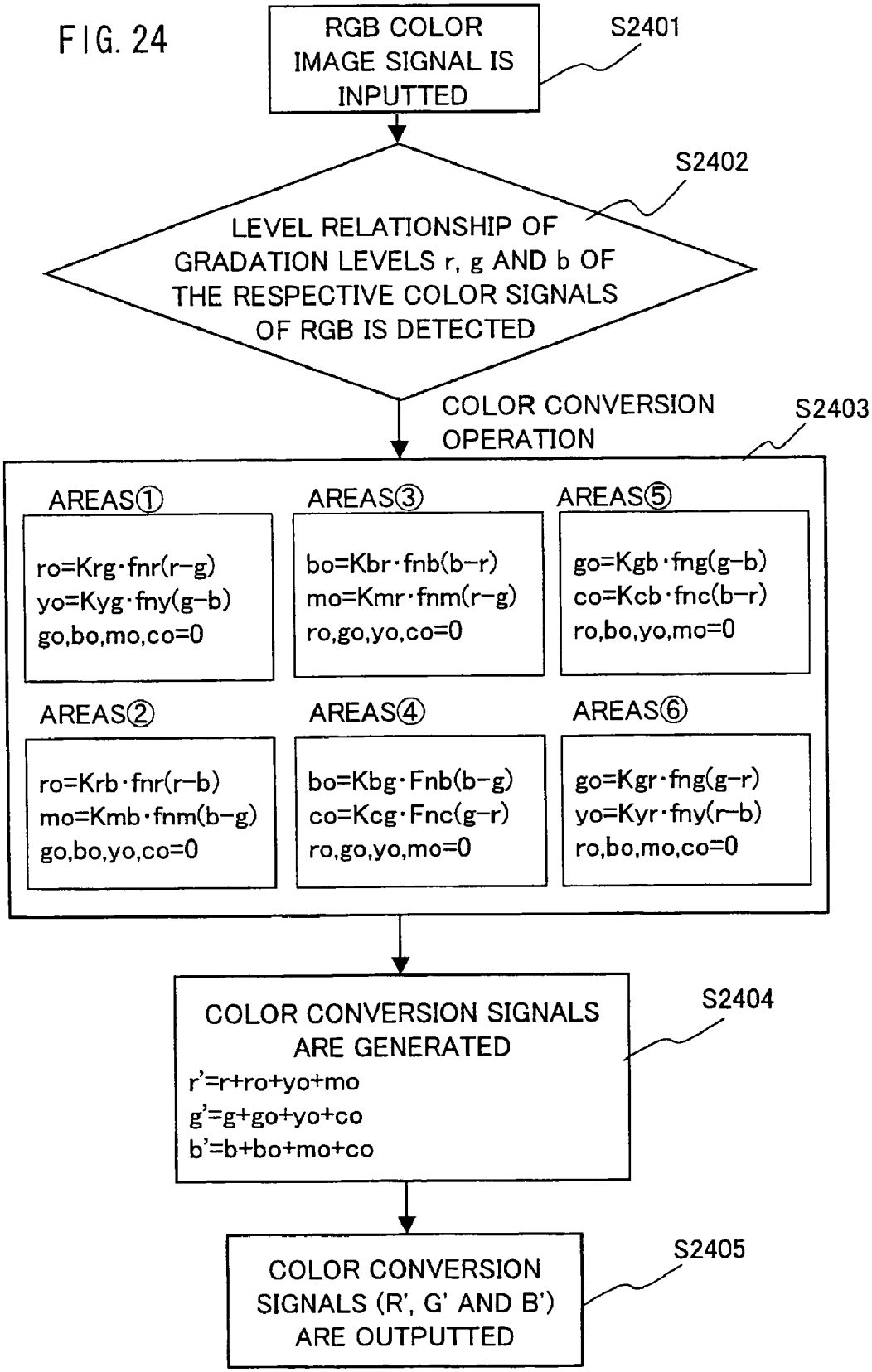
FIG. 24 is a flow chart showing a flow of color conversion operation according to the seventh embodiment of the present invention.

FIG. 24 shows an operation flow of the color conversion operation circuit 101. When a color image signal of RGB is inputted (S2401) as shown in the figure, the color conversion operation circuit 101 determines the level relationship between the gradation levels r, g and b of the respective color signals in the input color image signal (S2402).

More specifically, the color conversion operation circuit 101 determines whether the input signal belongs to which of the six patterns: [1]r≧g≧b, [2]r≧b≧g, [3]b>r≧g, [4]b>g>r, [5]g≧b>r and [6]g>r≧b of the relationship of gradation values r, g and b.

Next, based on the domains detected in Step S2402, compensation values ro, go, bo, yo, mo and co are calculated by the color conversion operation circuit 101 so as to carry out color compensation of the respective color components: R, G, B, Y, M and C (S2403). The compensation values of the respective domains [1] through [6] are calculated according to the following Expressions.

In the case [1] where r≧g≧b:

$$ro=Krg\cdot fnr(r-g)$$

$$yo=Kyg\cdot fny(g-b)$$

$$go=bo=mo=co=0$$

In the case [2] where r≧b>g:

$$ro=Krb\cdot fnr(r-b)$$

$$mo=Kmb\cdot fnm(b-g)$$

$$go=bo=yo=co=0$$

In the case [3] where b>r>g:

$$bo=Kbr\cdot fnb(b-r)$$

$$mo=Kmr\cdot fnm(r-g)$$

$$ro=go=yo=co=0$$

In the case [4] where b>g>r:

$$bo=Kbg\cdot fnb(b-g)$$

$$co=Kcg\cdot fnc(g-r)$$

$$ro=go=yo=mo=0$$

In the case [5] where g≧b>r:

$$go=Kgb\cdot fng(g-b)$$

$$co=Kcb\cdot fnc(b-r)$$

$$ro=bo=yo=mo=0$$

In the case [6] where g>r>b:

$$go=Kgr\cdot fng(g-r)$$

$$yo=Kyr\cdot fny(r-b)$$

$$ro=bo=mo=co=0$$

where Krg, Krb, Kbr, Kbg, Kgb, Kgr, Kyg, Kyr, Kmb, Kmr, Kcg and Kcb are constants or variables; and fnr(DX), fng(DX), fnb(DX), fny(DX), fnm(DX) and fnc(DX) are functions which respectively change depending on calculation result DX of corresponding brackets. Here, Krg, Krb, Kbr, Kbg, Kgb, Kgr, Kyg, Kyr, Kmb, Kmr, Kcg and Kcb are the same as those used in the first, second and third embodiments.

Further, the following functions are used as the functions fng(DX), fnb(DX), fnm(DX) and fnc(DX).

$$fng(DX)=DX^{Ng}$$

$$fnb(DX)=DX^{Nb}$$

$$fnm(DX)=DX^{Nm}$$

$$fnc(DX)=DX^{Nc}$$

However, it should be noted that these functions are the same as those for finding ro, go, bo, yo, mo and co used in the first embodiment unless they are expressed in a different way. For example, in the present embodiment, the compensation value go for the domain [6] is given by: go=Kgr·fng(g−r).

Here, a relation of go=Kgr·(g−r)Ng is found since fng(DX)=DXNg. This function is the same as that for finding the compensation value go used in the first embodiment. Further, by setting Ng, Nb, Nm and Nc to be not more than 1, it is possible to increase the compensation value go etc., which is added to the original gradations for color compensation, thus appropriately enhancing saturation in the vicinity of achromatic colors.

Figure 25:
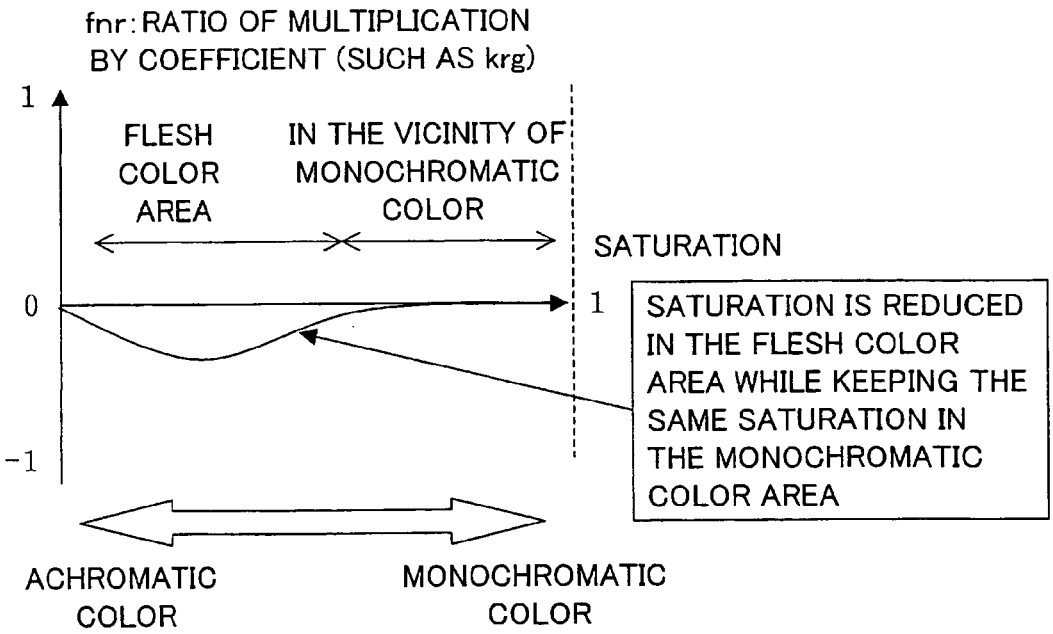
FIG. 25 is a drawing showing an example of a function fnr used in the color conversion operation according to the seventh embodiment.

Further, fnr(DX) and fny(DX) are functions which return 0 when DX=0, and return a negative value at least once in a range of 0<DX<1. Namely, it is preferable that fnr(DX) and fny(DX) are set as shown in FIG. 25, in which the saturation from 0 to the vicinity of the center of flesh color domain is constantly being a negative value and keeps decreasing, and the saturation from the vicinity of the center of flesh color domain to 1 is constantly being a negative value and keeps increasing. Further, fnr(DX) and fny(DX) are preferably set around 0 when the saturation comes to the vicinity of monochromatic color. With the use of such functions, it is possible to reduce saturation of the flesh color while maintaining saturation of monochromatic red and yellow as much as possible.

Generally, a lookup table is used in hardware to deal with such functions. However, lookup tables is not preferable for it requires a large amount of calculation. Then, the following functions are used to carry out enhancement of saturation by a simpler calculation.

$$fnr(DX)=DX2-Pr\cdot DX$$

$$fny(DX)=DX2-Py\cdot DX$$

where Pr and Py are constants greater than 0.

The values of Pr and Py may be set in two ways as follows.

[1]0<Pr, Py<1

[2]Pr, Py≧1

Figure 26:
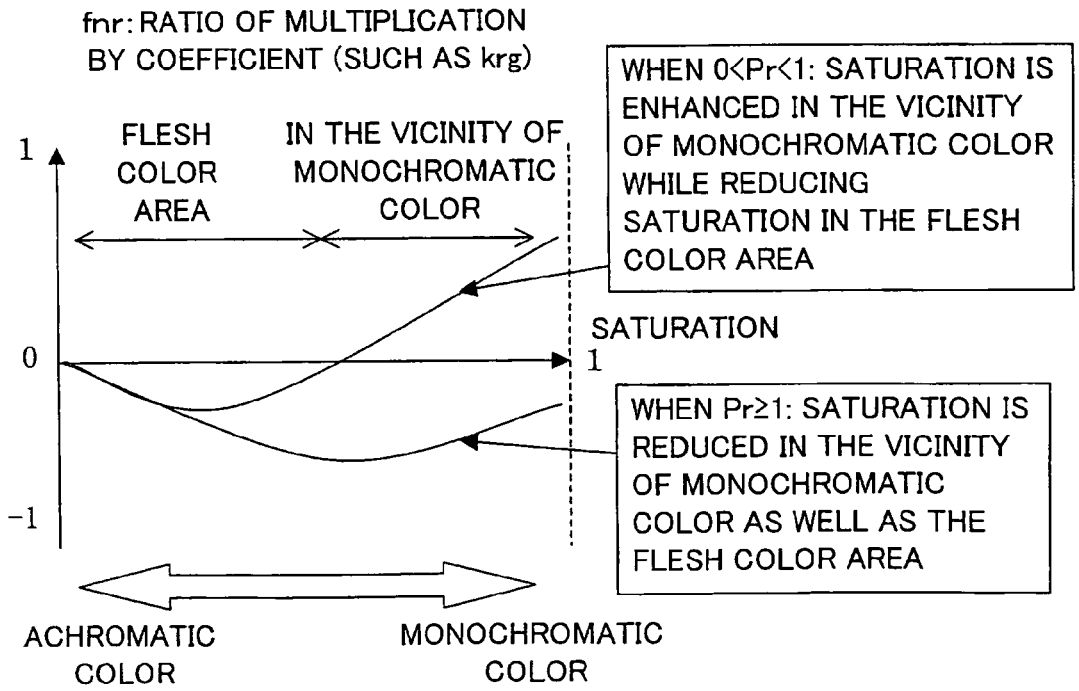
FIG. 26 is a drawing showing another example of the function fnr used in the color conversion operation according to the seventh embodiment.

Degree of enhancement of saturation depends on whether the Pr and Py are set according to [1] or [2]. This theory is explained below with reference to FIG. 26. As shown in FIG. 26, when adopting [1]=0<Pr, Py<1, fnr and fny become negative values in the flesh color domain, and saturation of the flesh color decreases. In this case, saturation in the vicinity of monochromatic colors increases.

On the other hand, when adopting [2]=Pr, Py>1, fnr and fny are constantly being negative values in a saturation range of 0 to 1, and saturations of both the flesh color and monochromatic colors decrease.

Though this example focuses on the flesh color, the same operation may be performed for the other colors. Namely, saturation of a specific color among G, B, M and C may be reduced by using functions fng(DX), fnb(DX), fnm(DX), fnc(DX) which return 0 where DX=0, and return a negative value at a desired domain.

Further, adoption of the following functions enables relatively easy calculation.

$$fng(DX)=DX-Pg\cdot DX$$

$$fnb(DX)=DX-Pb\cdot DX$$

$$fnm(DX)=DX-Pm\cdot DX$$

$$fnc(DX)=DX-Pc\cdot DX$$

where Pg, Pb, Pm and Pc are constants greater than 1.

Eighth Embodiment

Figure 12:
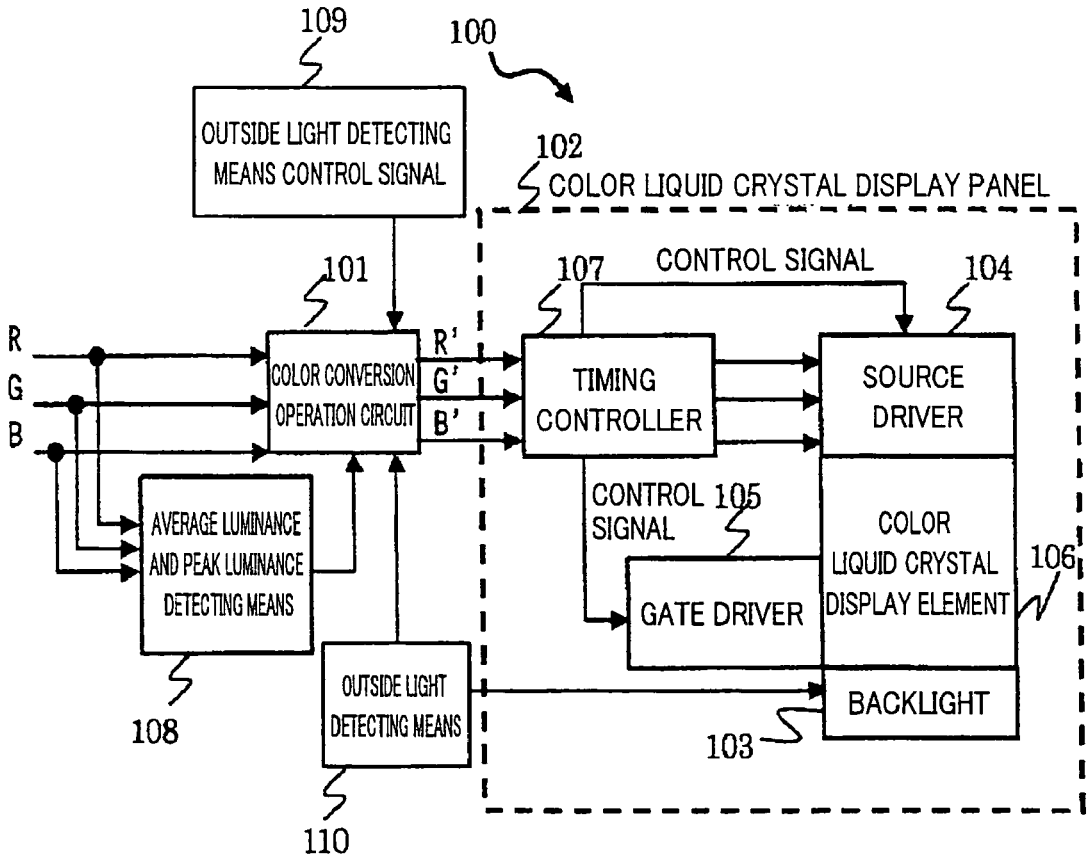
FIG. 12 is a block diagram schematically showing an arrangement of a color display device according to the eighth embodiment of the present invention.
Figure 13:
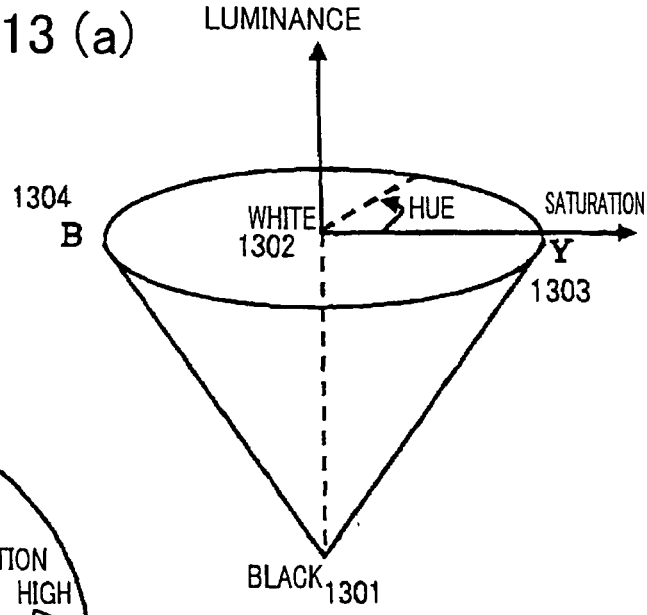
FIG. 13(*a*) shows a perspective view of a HSL color model and FIG. 13(*b*) shows a cross-sectional view of a HSL color model.
Figure 13:
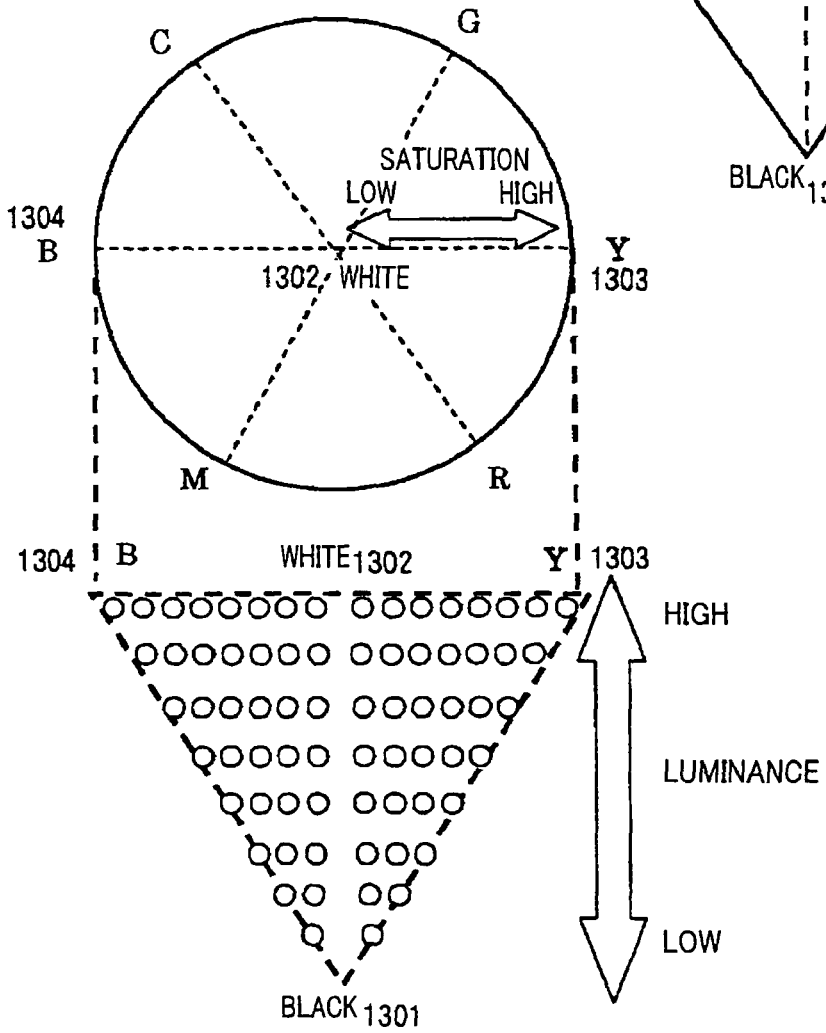
Figure 14:
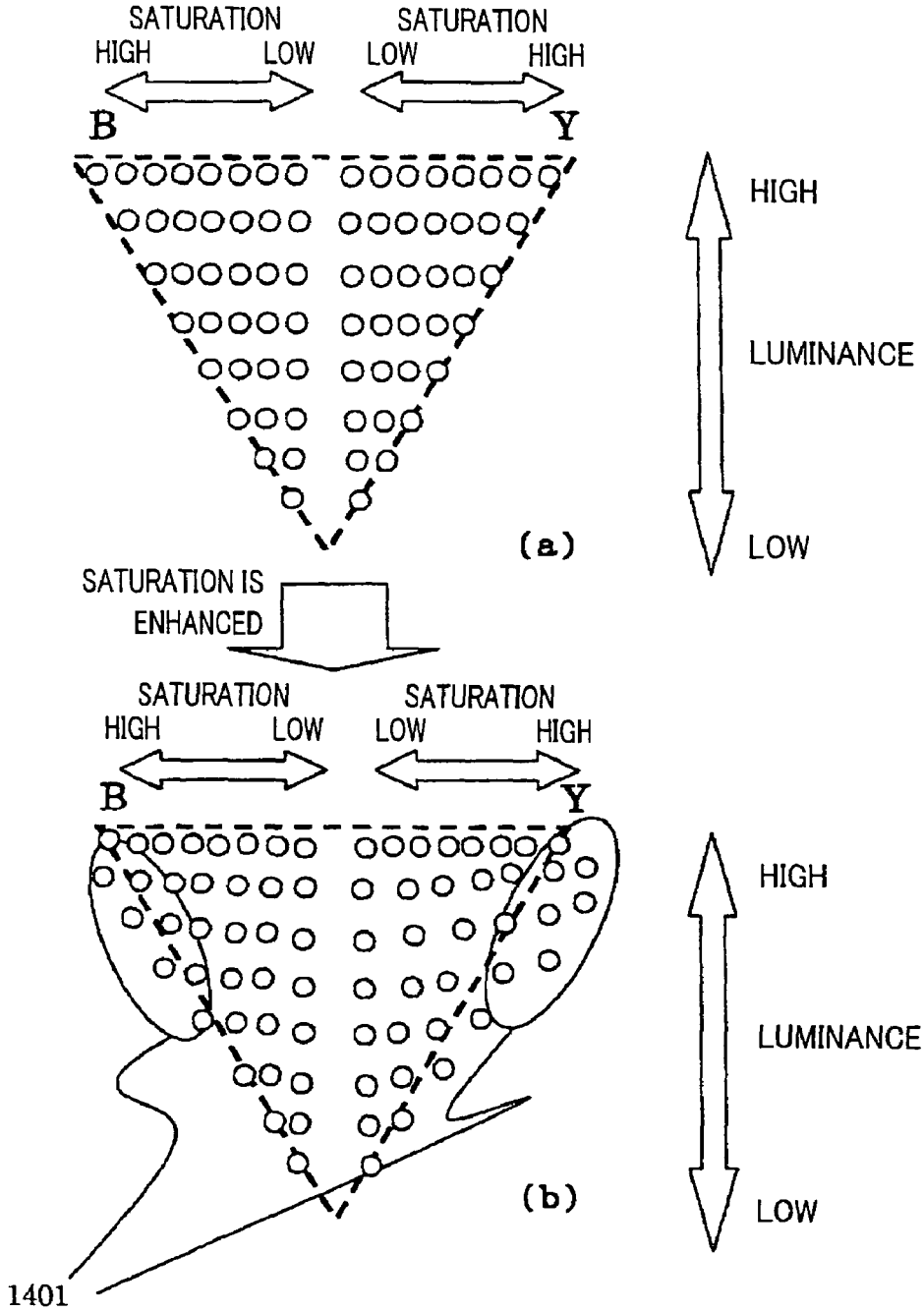
FIG. 14 is a cross-sectional view of a HSL color model for showing a change of gradation level of a signal before and after the color compensation operation.

The following will explain yet another embodiment of the present invention with reference to FIG. 12. In comparison with the sixth embodiment, the display device of the present embodiment further includes a color conversion adjusting device 109 and an outside light detecting device 110. Otherwise, the display device according to the present embodiment has a similar structure to that above, and therefore, explanation of equivalent function will be omitted here. The average luminance and peak luminance detecting device 108 calculates the average value and the maximum value of gradation values r, g and b of the R, G and B components, and then outputs the average luminance and the peak luminance to the color conversion operation circuit 101.

Appearance of color images displayed in a liquid crystal display device greatly relies on environmental factors (brightness or color). Ambient brightness and ambient color change whether the display is carried out in a room with a florescent light or under the sun. For example, under bluish environment by a florescent light, human's eyes become acclimated to the blue color, and therefore they are insensible to blue colors. Also, under very blight environment with sunlight, human's eyes become acclimated to the brightness, and therefore they are insensible to low luminance images etc.

In this view, in the present embodiment, such ambient brightness and colors when viewing displayed images are detected by the outside light detecting device 109, realized by such as a sensor, so as to dynamically control parameters of the calculation formulas of the first through seventh embodiments according to the detection result. Further, this dynamic control of parameters of the calculation formulas of the first through seventh embodiments may also be performed according to all of: the result of outside light detection, the average luminance, and result of peak luminance detection. Further, with this structure in which the dynamic control of parameters of the calculation formulas of the first through seventh embodiments is performed according to such factors as the outside light detected by the outside light detecting device 109, the average luminance, or the peak luminance detected by the outside light detecting device 109, the color conversion adjusting device 108 may be omitted.

Figure 23:
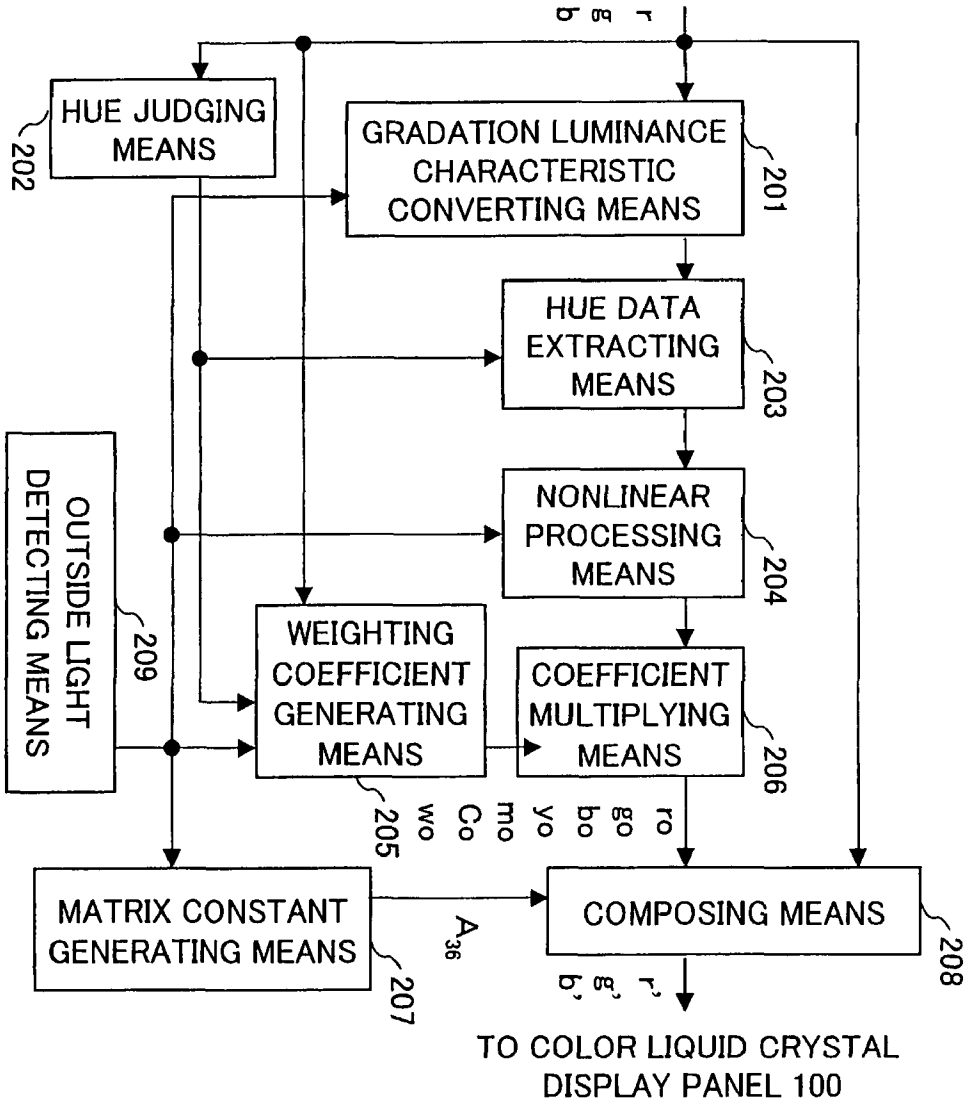
FIG. 23 is a block diagram minutely showing an arrangement of a color display device having an outside light detecting device shown in FIG. 12.

The following will more specifically describe the case using the outside light detecting device of the present embodiment with reference to FIG. 23. FIG. 23 shows minute structure of the color conversion circuit 101 in which the outside light detecting device 209 is added. In order to carry out the operation explained in the fifth embodiment, a gradation luminance characteristic converting device 201 converts the rgb values of the input image signal into a value equal to the luminance of the display device. More specifically, the gradation luminance characteristic converting device 201 uses the functions fzr. fzg and fzb of the fifth embodiment to converts the rgb values of the input image signal to be equal to the luminance value of the display device. However, the color display device of the present embodiment may omit the gradation luminance characteristic converting means 201.

To carry out the operation described in the first embodiment, hue judging device 202 detects gradation levels r, g and b of an input color image signal, and determines whether the input color image signal belongs to which of six domains [1] through [6].

To carry out the operation described in the first, second and fifth embodiments, hue data extracting device 203 extracts the difference among the respective luminance values, which are respectively converted from the gradation levels of r, g and b of the input image signal according to the corresponding one of the domains [1] through [6] determined by the hue judging device 202. When the hue judging device 202 is omitted, the hue data extracting device 203 extracts the difference among the original rgb values of the input image signal.

A nonlinear processing device 204 raises the difference, having been extracted by the hue data extracting device 203, to the power of the coefficients Nr, Ng, Ny, Nm or Nc.

To carry out the operation described in the first, second and third embodiments, a weighting coefficient generating means 205 generates the weighting functions Krg, Krb, Kbr, Kbg, Kgb, Kgr, Kyg, Kyr, Kmb, Kmr, Kcg and Kcb according to the corresponding hue domain determined by the hue judging device 202.

To carry out the operation described in the first or the third embodiment, a coefficient multiplying device 206 carries out calculation to obtain the compensation values ro, go, bo, yo, mo and co by using the weighting functions generated by the weighting function generating device 205, as well as the calculation to obtain the compensation value wo so as to carry out the operation described in the second embodiment.

To carry out the operation described in the fourth embodiment, a matrix constant generating device 207 generates the factors all, a12, a13, . . . a35, and a36 for specifying the matrix $A_{36}$.

A composing device 208 carries out calculation to obtain the values r', g' and b' of gradation levels of the output image signal by using the compensation value generated by the coefficient multiplying device 206, or the matrix $A_{36}$ generated by the matrix constant generating device 207.

The outside light detecting device 209 is a light sensor for detecting ambient brightness or ambient color of the color display device, and controls at least one of the foregoing coefficients Nr, Ng, Nb, Ny, Nm, Nc, Cr, Cg, Cb, Cy, Cm, Cc, Pr, Py and $A_{36}$, and the functions fzr, fzg, fzb, fw, fnr, fng, fnb, fny, fnm and fnc according to the detection result. Note that, the function of the outside light detecting device 209 is not limited to the detection of ambient brightness, but may be detection of other environmental factors of the color display device, such as temperature.

With the foregoing arrangement, the color display device of the present embodiment controls the foregoing coefficients according to the environmental factors, particularly the brightness of outside light, by the outside light detecting device 209. On this account, it is possible to realize adjustment of saturation according to changes of environment.

The color display device of the present embodiment is especially suitable for a semi-transmission liquid crystal panel. This is because, since a semi-transmission liquid crystal panel functions as a transmission liquid crystal panel with the backlight on, and functions as a reflection liquid crystal panel with the backlight off; that is, color of displayed images of a semi-transmission liquid crystal panel changes depending on whether the backlight is on or off. However, the color display device of the present embodiment allows setting of coefficients by the outside light detecting device to be suitable for each of the on and off states of the backlight. In this view, the color display device of the present embodiment is suitable for saturation adjustment for image display of a semi-transmission liquid crystal panel.

Ninth Embodiment

Figure 27:
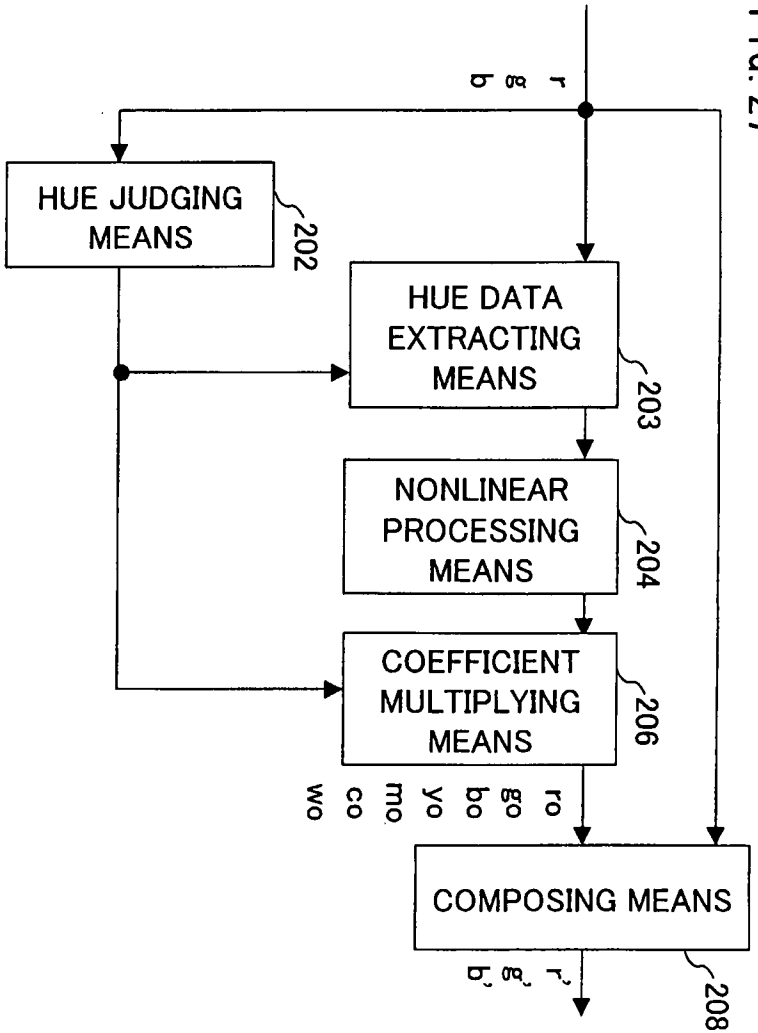
FIG. 27 is a block diagram illustrating an arrangement of a color display device according to the ninth embodiment.

The following will explain still another embodiment of the present invention with reference to FIG. 27. FIG. 27 illustrates a minute arrangement of the color conversion operation circuit 101. The respective blocks shown in FIG. 27 have identical functions to those described in the eighth embodiment.

As explained, the differences between the inputted RGB image signals are extracted by the hue data extracting device 203 in accordance with the hue areas detected by the hue judging device 202. These differences are then raised to the powers of coefficients Nr, Ng, Nb, Ny, Nm, and Nc by the nonlinear processing means 204. Then, the raised differences are multiplied by corresponding constants by the coefficient multiplying device 206 so as to find the compensation values ro, go, bo, yo, mo and co. These compensation values are added to the inputted RGB image signals by the composing device 208. As a result, the gradation levels r', g' and b' of the output image signal are found.

Specifically, the values of r', g' and b' are found by a similar method to that described in the first embodiment. That is, the input values r, g and b are calculated to find the output value r', g' and b' according to following Expressions (7) through (9).

$$r'=r+ro+yo+mo \tag{7}$$

$$g'=g+go+yo+co \tag{8}$$

$$b'=b+bo+mo+co \tag{9}$$

Here, in the case of the domain [1] where r≧g≧b:

$$ro=Cr(r-g)^{Nr},$$

$$yo=Cy(g-b)^{Ny},$$

$$go=bo=mo=co=0,$$

in the case of the domain [2] where r≧b>g:

$$ro=Cb(r-b)^{Nr},$$

$$mo=Cm(b-g)^{Nm},$$

$$go=bo=yo=co=0,$$

in the case of the domain [3] where b>r≧g:

$$bo=Cb(b-r)^{Nb},$$

$$mo=Cm(r-g)^{Nm},$$

$$ro=go=yo=co=0,$$

in the case of the domain [4] where b>g>r:

$$bo=Cb(b-g)^{Nb},$$

$$co=Cc(g-r)^{Nc},$$

$$ro=go=yo=mo=0,$$

in the case of the domain [5] where g>b>r:

$$go=Cg(g-b)^{Ng},$$

$$co=Cc(b-r)^{Nc},$$

$$ro=bo=yo=mo=0, \text{ and}$$

in the case of the domain [6] where g>r≧b:

$$go=Cg(g-r)^{Ng},$$

$$yo=Cy(r-b)^{Ny},$$

$$ro=bo=mo=co=0,$$

where Cr, Cg, Cb, Cy, Cm, Cc, Nr, Ng, Nb, Ny, Nm, and Nc are constants.

In contrast to the first embodiment using the coefficients Krg, Krb, Kbr, Kbg, Kgb, Kgr, Kyg, Kmb, Kmr, Kcg and Kcb, this calculation operation of the present embodiment uses constants Cr, Cg, Cb, Cy, Cm and Cc. The constants Cr, Cg, Cb, Cy, Cm, Cc may be considered values resulting from removal of the weighting functions, that change depending on the values r, g and b, from the coefficients Krg, Krb, Kbr, Kbg, Kgb, Kgr, Kyg, Kmb, Kmr, Kcg, Kcb and Kry. Accordingly, the present embodiment provides no effect of prevention of full saturation of chroma or color given by the weighting functions.

However, by setting the values of Nr, Ng, Nb, Ny, Nm, and Nc in the same manner as that described in the first embodiment, the color control for the flesh color and the achromatic colors etc. can still be obtained without using the weighting functions.

Note that, since the values of r', g' and b' are found without using the weighting functions in the present embodiment, these values may become larger than 1 in some cases. In such cases, the values of r', g' and b' are required to be modified to 1.

Further, as the constants Cr, Cg, Cb, Cy, Cm and Cc increase, the values of r', g' and b' become larger than 1 more often, which causes unnatural vision of the display. Accordingly, it is desirable that the constants Cr, Cg, Cb, Cy, Cm and Cc are set to small values to some extent in view of prevention of the unnatural vision.

Tenth Embodiment

Figure 28:
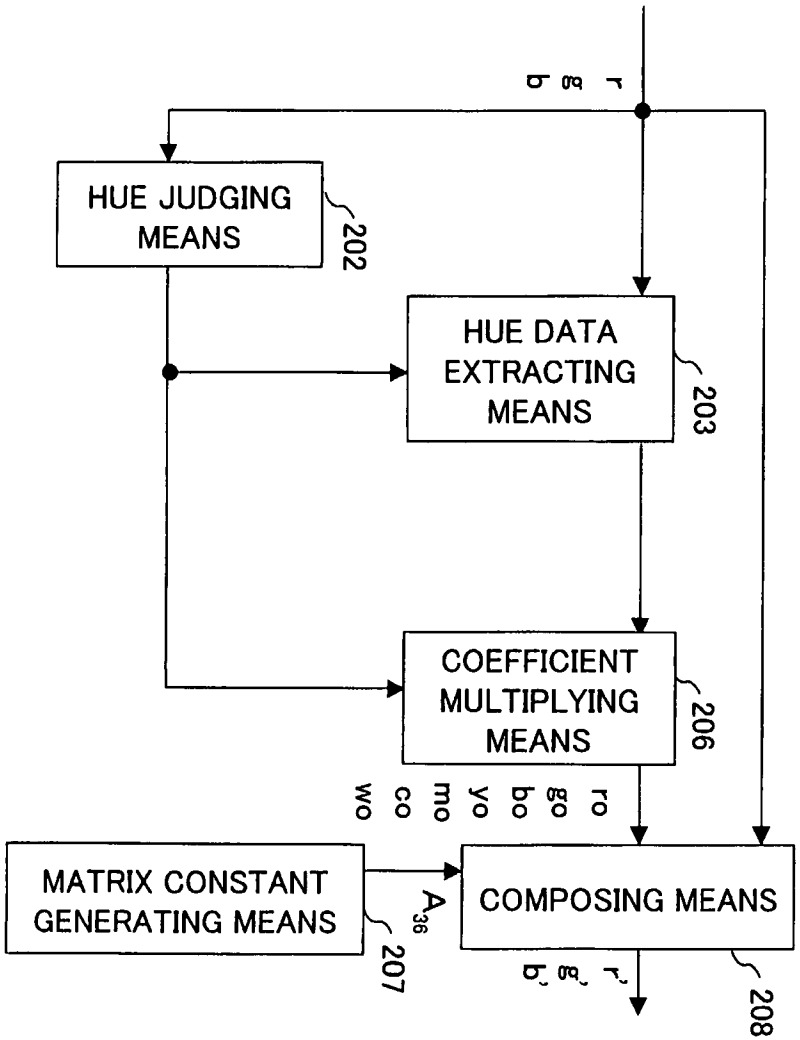
FIG. 28 is a block diagram illustrating an arrangement of a color display device according to the tenth embodiment.

The following will explain yet another embodiment of the present invention with reference to FIG. 28. FIG. 28 illustrates a minute arrangement of the color conversion operation circuit 101. The respective blocks shown in FIG. 27 have identical functions to those described in the eighth embodiment.

As explained, the differences between the inputted RGB image signals are extracted from the hue data extracting means 203 in accordance with the hue areas detected by the hue judging means 202. These differences are multiplied by corresponding coefficients by the coefficient multiplying device 206, so as to find the compensation values ro, go, bo, yo, mo and co. These compensation values are added/subtracted by the composing device 208 to/from the inputted RGB image signals, that are inputted based on the square matrix of $A_{36}$ generated by the matrix constant generating device. As a result, the gradation levels r', g' and b' of the output image signal are found.

Specifically, the values of r', g' and b' are found in a similar manner than that described in the fourth embodiment. That is, the output values r', g' and b' are calculated as follows by using square matrix of $A_{36}$.

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

Here, in the case of the domain [1] where r>g>b:

$$ro=Cr(r-g),$$

$$yo=Cy(g-b),$$

$$go=bo=mo=co=0,$$

in the case of the domain [2] where [2]r≧b>g:

$$ro=Cr(r-b),$$

$$mo=Cm(b-g),$$

$$go=bo=yo=co=0,$$

in the case of the domain [3] where b>r>g:

$$bo=Cb(b-r),$$

$$mo=Cm(r-g),$$

$$ro=go=yo=co=0,$$

in the case of the domain [4] where b>g>r:

$$bo=Cb(b-g),$$

$$co=Cc(g-r),$$

$$ro=go=yo=mo=0,$$

in the case of the domain [5] where g≧b>r:

$$go=Cg(g-b),$$

$$co=Cc(b-r),$$

$$ro=bo=yo=mo=0, \text{ and}$$

in the case of the domain [6] where g>r≧b:

$$go=Cg(g-r),$$

$$yo=Cy(r-b),$$

$$ro=bo=mo=co=0,$$

where Cr, Cg, Cb, Cy, Cm, and Cc are constants.

In contrast to the fourth embodiment using the coefficients Krg, Krb, Kbr, Kbg, Kgb, Kgr, Kyg, Kmb, Kmr, Kcg, Kcb and Kyr, this calculation operation of the present embodiment uses constants Cr, Cg, Cb, Cy, Cm and Cc. Further, the calculation is performed with no control of the coefficients Nr, Ng, Nb, Ny, Nm, and Nc.

Accordingly, the present embodiment provides no effects given by the weighting functions and the control of the coefficients Nr, Ng, Nb, Ny, Nm, and Nc. However, by setting the value of square matrix of $A_{36}$ in the same manner as that described in the fourth embodiment, the same effect can still be obtained.

As with the ninth embodiment, since the values of r', g' and b' are found without using the weighting functions in the present embodiment, these values may become larger than 1 in some cases. In such cases, the values of r', g' and b' are required to be modified to 1. Further, as the constants Cr, Cg, Cb, Cy, Cm and Cc increase, the values of r', g' and b' become larger than 1 more often, which causes unnatural vision of the display. Accordingly, it is desirable that the constants Cr, Cg, Cb, Cy, Cm and Cc are set to small values to some extent in view of prevention of the unnatural vision.

Eleventh Embodiment

Figure 29:
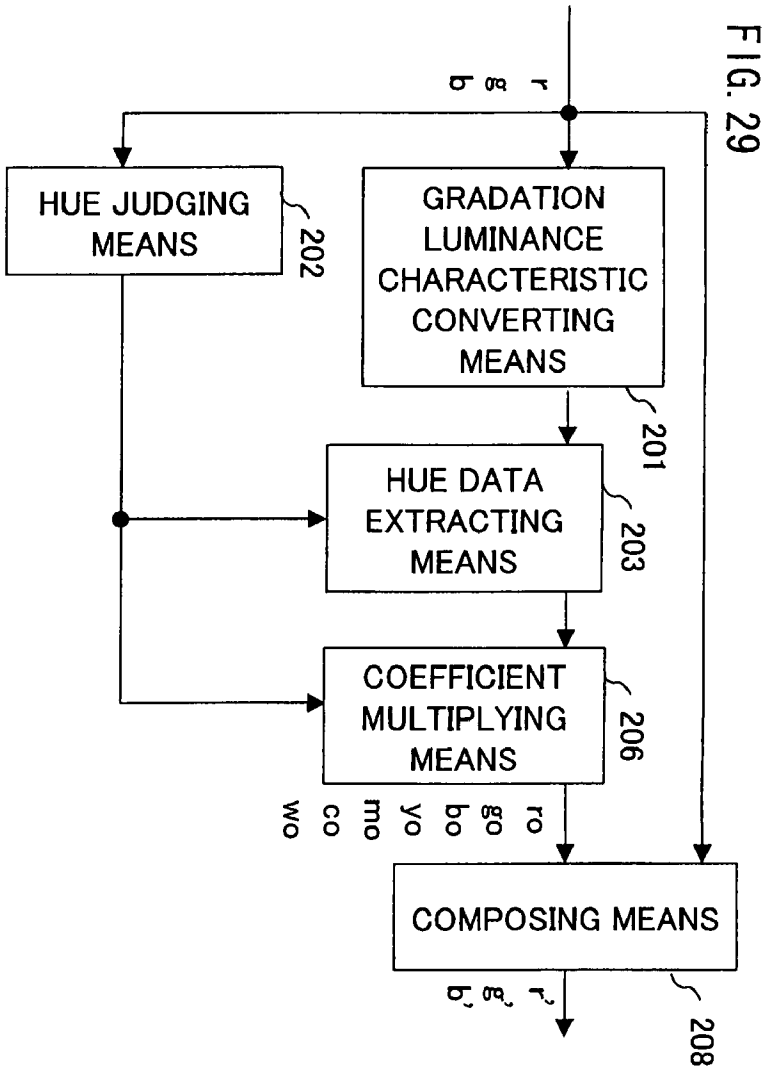
FIG. 29 is a block diagram illustrating an arrangement of a color display device according to the eleventh embodiment.

The following will explain still another embodiment of the present invention with reference to FIG. 29. FIG. 29 illustrates a minute arrangement of the color conversion operation circuit 101. The respective blocks shown in FIG. 29 have identical functions to those described in the eighth embodiment.

As explained, the inputted RGB image signals are converted into luminance values of the display device by the gradation luminance characteristic converting device 201. Then, the difference between these luminance values are extracted by the hue data extracting device 203 in accordance with the hue areas detected by the hue judging device 202. These differences are then multiplied by corresponding constants by the coefficient multiplying device 206 so as to find the compensation values ro, go, bo, yo, mo and co. These compensation values are added to the inputted RGB image signals by the composing device 208. As a result, the gradation levels r', g' and b' of the output image signal are found.

Specifically, the values of r', g' and b' are found in a similar manner than that described in the fourth embodiment. That is, the input values r, g and b are converted to the output values r', g' and b' through calculation in accordance with the following Expressions (7) through (9).

$$r'=r+ro+yo+mo \tag{7}$$

$$g'=g+go+yo+co \tag{8}$$

$$b'=b+bo+mo+co \tag{9}$$

Here, in the case of the domain [1] where (r≧g≧b):

$$ro=Cr(fzr(r)-fzg(g)),$$

$$yo=Cy(fzg(g)-fzb(b)),$$

$$go=bo=mo=co=0,$$

in the case of the domain [2] where (r≧b>g):

$$ro=Cr(fzr(r)-fzb(b)),$$

$$mo=Cm(fzb(b)-fzg(g)),$$

$$go=bo=yo=co=0,$$

in the case of the domain [3] where (b>r≧g):

$$bo=Cb(fzb(b)-fzr(r)),$$

$$mo=Cm(fzr(r)-fzg(g)),$$

$$ro=go=yo=co=0,$$

in the case of the domain [4] where (b>g>r):

$$bo=Cb(fzb(b)-fzg(g)),$$

$$co=Cc(fzg(g)-fzr(r)),$$

$$ro=go=yo=mo=0,$$

in the case of the domain [5] where (g≧b>r):

$$go=Cg(fzg(g)-fzb(b)),$$

$$co=Cc(fzb(b)-fzr(r)),$$

$$ro=bo=yo=mo=0, \text{ and}$$

in the case of the domain [6] where (g>r≧b):

$$go=Cg(fzg(g)-fzr(r)),$$

$$yo=Cy(fz\ r(r)-fzb(b)),$$

$$ro=bo=mo=co=0,$$

Where Cr, Cg, Cb, Cy, Cm and Cc are constants; and fzr, fzg and fzb are functions which change depending on the values of r, g and b in the corresponding bracket.

In contrast to the fifth embodiment using the coefficients Krg, Krb, Kbr, Kbg, Kgb, Kgr, Kyg, Kmb, Kmr, Kcg, Kcb and Kyr, this calculation operation of the present embodiment uses constants Cr, Cg, Cb, Cy, Cm and Cc. Further, the calculation is performed with no control of the coefficients Nr, Ng, Nb, Ny, Nm, and Nc. Furthermore, it is performed without the square matrix of $A_{36}$.

Accordingly, the present embodiment provides no effects given by the weighting functions, the control of the coefficients Nr, Ng, Nb, Ny, Nm, and Nc, and the square matrix of $A_{36}$. However, by setting the values of the functions fzr, fzg and fzb in the same manner as that described in the fifth embodiment, the same effect can still be obtained.

As with the ninth embodiment, since the values of r', g' and b' are found without using the weighting functions in the present embodiment, these values may become larger than 1 in some cases. In such cases, the values of r', g' and b' are required to be modified to 1. Further, as the constants Cr, Cg, Cb, Cy, Cm and Cc increase, the values of r', g' and b' become larger than 1 more often, which causes unnatural vision of the display. Accordingly, it is desirable that the constants Cr, Cg, Cb, Cy, Cm and Cc are set to small values to some extent in view of prevention of the unnatural vision.

Twelfth Embodiment

Figure 30:
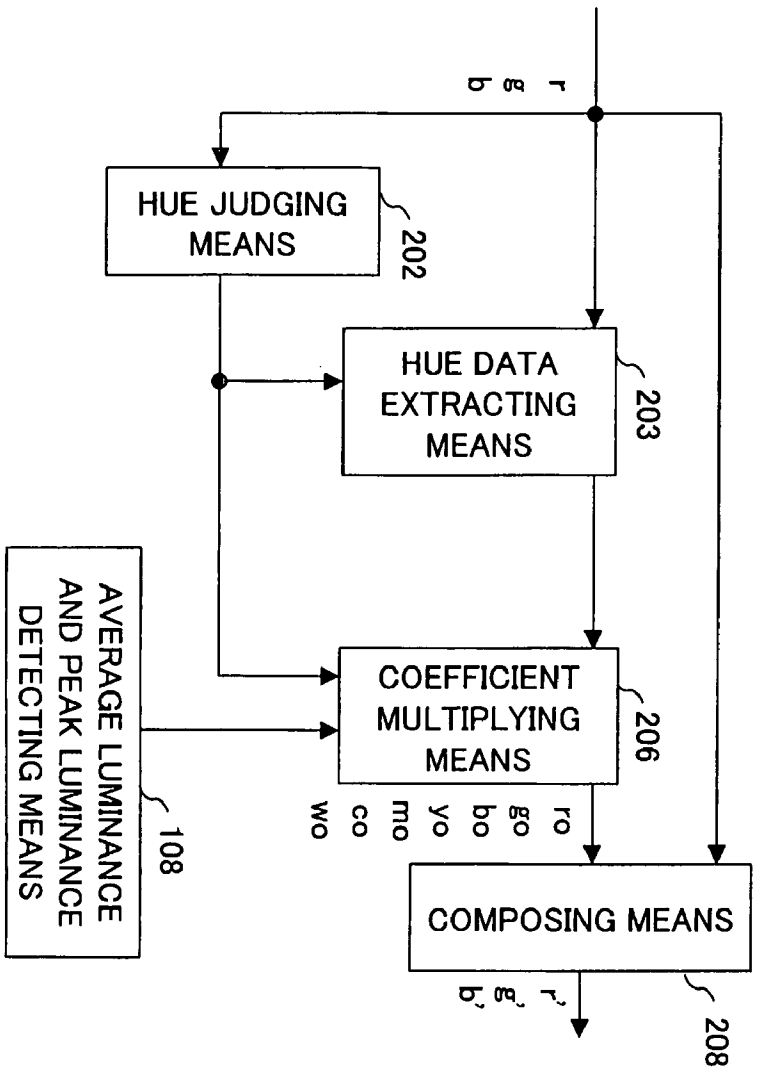
FIG. 30 is a block diagram illustrating an arrangement of a color display device according to the twelfth embodiment.

The following will explain yet another embodiment of the present invention with reference to FIG. 30. FIG. 30 illustrates a minute arrangement of the color conversion operation circuit 101. The respective blocks shown in FIG. 30 have identical functions to those described in the eighth embodiment. Further, the average luminance and peak luminance detecting means is identical to that shown in FIG. 10, that is explained in the sixth embodiment.

As explained, the differences between the inputted RGB image signals are extracted by the hue data extracting means 203 in accordance with the hue areas detected by the hue judging device 202. These differences are then multiplied by corresponding constants by the coefficient multiplying device 206 so as to find the compensation values ro, go, bo, yo, mo and co.

Further, the wo component is calculated by the function fw. The function fw dynamically changes depending on the information obtained by the average luminance and peak luminance detecting device 108. Further, the foregoing compensation values are added to the inputted RGB image signals by the composing device 208. As a result, the gradation levels r', g' and b' of the output image signal are found.

Specifically, the values of r', g' and b' are found in a similar manner than that described in the second embodiment. That is, the input values r, g and b are converted to the output values r', g' and b' through calculation in accordance with the following Expressions (10) through (12).

$$r'=r+ro+yo+mo+wo \quad (10)$$

$$g'=g+go+yo+co+wo \quad (11)$$

$$b'=b+bo+mo+co+wo \quad (12)$$

Here, in the case of the domain [1] where (r≧g≧b):

$$ro=Cr(r-g),$$

$$yo=Cy(g-b),$$

$$wo=fw(b),$$

$$go=bo=mo=co=0,$$

in the case of the domain [2] where (r≧b>g):

$$ro=Cr(r-b),$$

$$mo=Cm(b-g),$$

$$wo=fw(g),$$

$$go=bo=yo=co=0,$$

in the case of the domain [3] where (b>r≧g):

$$bo=Cb(b-r),$$

$$mo=Cm(r-g),$$

$$wo=fw(g),$$

$$ro=go=yo=co=0,$$

in the case of the domain [4] where (b>g>r):

$$bo=Cb(b-g),$$

$$co=Cc(g-r),$$

$$wo=fw(r),$$

$$ro=go=yo=mo=0,$$

in the case of the domain [5] where (g≧b>r):

$$go=Cg(g-b),$$

$$co=Cc(b-r),$$

$$wo=fw(r),$$

$$ro=bo=yo=mo=0, \text{ and}$$

in the case of the domain [6] where (g>r≧b):

$$go=Cg(g-r),$$

$$yo=Cy(r-b),$$

$$wo=fw(b),$$

$$ro=bo=mo=co=0,$$

where Cr, Cg, Cb, Cy, Cm, and Cc are constants, and fw is a function dynamically changes depending on the average luminance and the peak luminance of the image.

In contrast to the second embodiment using the coefficients Krg, Krb, Kbr, Kbg, Kgb, Kgr, Kyg, Kmb, Kmr, Kcg, Kcb and Kyr, this calculation operation of the present embodiment uses constants Cr, Cg, Cb, Cy, Cm and Cc. Further, the calculation is performed with no control of the coefficients Nr, Ng, Nb, Ny, Nm, and Nc.

Accordingly, the present embodiment provides no effects given by the weighting functions, the control of the coefficients Nr, Ng, Nb, Ny, Nm, and Nc. However, by setting the values of the function fw in the same manner as that described in the second embodiment, the same effect can still be obtained. Further, by dynamically changing the function fw depending on the average luminance and the peak luminance as in the sixth embodiment, the same effect can be obtained.

As with the ninth embodiment, since the values of r', g' and b' are found without using the weighting functions in the present embodiment, these values may become larger than 1 in some cases. In such cases, the values of r', g' and b' are required to be modified to 1. Further, as the constants Cr, Cg, Cb, Cy, Cm and Cc increase, the values of r', g' and b' become larger than 1 more often, which causes unnatural vision of the display. Accordingly, it is desirable that the constants Cr, Cg, Cb, Cy, Cm and Cc are set to small values to some extent in view of prevention of the unnatural vision.

Thirteenth Embodiment

Still another embodiment of the present invention is described below. In the foregoing embodiments, each component is extracted by classifying the inputted RGB signals into six domains according to the relationship of their gradation levels, and determining the difference of the respective components depending on the corresponding domain. However, the present invention is not limited to this method. The following describes one alternative, for example.

For example, the following calculation may also be used for extracting the components.

With respect to the gradation levels r, g and b of the input signal, the compensation values ro, go, bo, yo, mo, co and wo may be calculated according to the following equations.

$$ro=Cr\cdot\min(rg, rb),$$

$$go=Cg\cdot\min(gr, gb),$$

$$bo=Cb\cdot\min(br, bg),$$

$$yo=Cy\cdot\min(rb, gb),$$

$$mo=Cm\cdot\min(rg, bg),$$

$$co=Cc\cdot\min(gr, br),$$

where min ( ) is a function for giving the smallest value among those in the bracket, on condition that:

$$rg=r-g,$$

$$rb=r-b,$$

$$gr=g-r,$$

$$gb=g-b,$$

$br=b-r,$ $bg=b-g,$ in which each of rg, rb, gr, gb, br and bg are modified to 0 when they are minus values.

The respective calculated components according to the foregoing equations may be considered the same as those used in the respective embodiments above.

For example, in the case where r>g>b, the values of rg, rb and gb become positive, and the values of gr, br and bg become negative. However, since it is set that negative values are modified to 0, these gr, br and bg become 0.

Further, in the equation of ro for calculating the components, the smaller one of rg and rb in the bracket is chosen. Therefore, in this case where r>g>b, rg is chosen. Accordingly, yo=Cy (g−b), and wo=fw(b). Since all other components contain 0 in their function min( ), they all result in 0.

Further, when calculating ro in consideration of a weighting function, the coefficient for multiplying the difference needs to be changed depending on which of rg and rb is smaller. Specifically, calculation is performed according to the following equations in order to extract components in consideration of the weighting function.

·in the case where $rg<rb$: $ro=Krg\cdot rg$

·in the case where $rg>rb$: $ro=Krb\cdot rb$

·in the case where $gr<gb$: $go=Kgr\cdot gr$

·in the case where $gr>gb$: $go=Kgb\cdot gb$

·in the case where $br<bg$: $bo=Kbr\cdot br$

·in the case where $br>bg$: $bo=Kbg\cdot bg$

·in the case where $rb<gb$: $yo=Kyr\cdot rb$

·in the case where $rb>gb$: $yo=Kyg\cdot gb$

·in the case where $rg<bg$: $mo=Kmr\cdot rg$

·in the case where $rg>bg$: $mo=Kmb\cdot bg$

·in the case where $gr<br$: $co=Kcg\cdot gr$

·in the case where $gr>br$: $co=Kcb\cdot br$ where min ( ) is a function for giving the smallest value among those in the bracket, on condition that:

$rg=r-g,$ $rb=r-b,$ $gr=g-r,$ $gb=g-b,$ $br=b-r,$ $bg=b-g,$ in which each of rg, rb, gr, gb, br and bg are modified to 0 when they are minus values.

Note that, the coefficients Krg, Krb, Kbr, Kbg, Kgb, Kgr, Kyg, Kmb, Kmr, Kcg, Kcb and Kyr are the same as those used in the respective embodiments above. In this manner, the respective components may be extracted without classifying the input RGB signals into six domains.

The present invention is not limited to the embodiments above, but may be altered within the scope of the claims. An embodiment based on a proper combination of technical devices disclosed in different embodiments is encompassed in the technical scope of the present invention.

Further, the color display device of an embodiment of the present invention may also be expressed as: a color display device comprising hue judging means for detecting a relationship between RGB components of an input color image signal in terms of their gradation levels and determining whether the input signal belongs to which of the six patterns of the relationship; and gradation compensating means for carrying out gradation compensation individually for the three components RGB excluding a component with a smallest gradation level, using variables that vary depending on the respective gradation levels of the three components RGB.

The hue judging means is supported by, in one exemplary non-limiting manner, the hue judging device 202 shown in FIG. 23. Further, the gradation compensating means is supported by, in one exemplary non-limiting manner, the hue data extracting device 203, the nonlinear processing device 204, the weighting coefficient generating device 205 and the coefficient multiplying device 206, the matrix constant generating device 207 and the composing device 208, which are shown in FIG. 23.

Note that, the respective blocks or operation processes of the color display device and method described in the foregoing embodiments may be carried out by a program stored in a ROM (Read Only Memory) or a RAM, which is carried out by calculating means such as a CPU for example, and is controlled by inputting means such as a keyboard for example, outputting means such as a display for example, or communicating means such as an interface circuit for example. In this manner, the respective functions and operations of the color display device of an embodiment of the present invention may be realized only by reading out a program from a storage medium and enforcing the program by a computer. Further, by storing the program in a removable medium, the respective functions and operations may be enforced by an arbitrary computer.

The storage medium for storing a program may be a memory (not shown) such as a ROM, or a computer readable medium or program medium, which is read by a program reading device (external storage device; not shown) into which the medium is inserted.

Further, in either case, it is preferable that the program stored in the medium is accessed by a microprocessor for enforcement.

Further, it is also preferable that the program is read out and then is downloaded in a program storage area of a microcomputer before enforcement. The downloading is carried out by a built-in program of the main body of the device.

Here, the program medium above may be a computer readable medium or a storage medium arranged to be removable from the main body, and may be the medium fixedly holds the program code, which can be (a) a tape system such as a magnetic tape, a cassette tape or the like, (b) a disk system which includes a magnetic disk such as a floppy disk®, a hard disk or the like and an optical disk such as a CD-ROM, an MO, an MD, a DVD or the like, (c) a card system such as an IC card (inclusive of a memory card), an optical card or the like, and (d) a semiconductor memory such as a mask ROM, an EPROM, an EEPROM, a flash ROM.

Further, in the case of a configuration accessible to a communications network including the Internet, it is preferable that the medium may be the one fluidly carries the program code so that the program can be downloaded via the communications network.

Note that, in the case of downloading a program from the communications network, the program for carrying out downloading may be either previously stored in the main body of the device or installed from a different storage medium.

As described, a color display device of an embodiment of the present invention determines a relationship between plural color components of an input color image signal in terms of their gradation levels, and carries out calculation based on the relationship for each of the plural color components excluding a component with a smallest gradation level. This is done using variables that are vary depending on the respective gradation levels of the plural color components.

Further, a color display device of an embodiment of the present invention determines a relationship between three color components of an input color image signal in terms of their gradation levels, and carries out a different calculation for each input color image signal depending on whether the input color image signal belongs to which of six patterns of the relationship. The calculation is performed for each of the three color components excluding a component with a smallest gradation level, using variables that vary depending on the respective gradation levels of the three color components.

An embodiment of the present invention carries out color compensation of an input color signal in consideration of RGB components, YMC components, and also white component in some cases, contained in the signal, thus achieving desired color conversion operation.

Further, the color display device is arranged so that the variables are determined so that the gradation levels of the input color image signal after color compensation fall within a range of a color model that expresses the gradation levels of the input color image signal before and after color compensation in terms of distributions of hue, luminance and saturation.

Further, it is preferable that the input color image signal is converted into an output color image signal with the RGB components respectively having gradation levels of r', g' and b', which are given by:

$$r'=r+ro+yo+mo,$$

$$g'=g+go+yo+co,$$

$$b'=b+bo+mo+co,$$

where r, g and b are values obtained by dividing original gradation levels of the three color components of the input color image signal by a maximum gradation value N−1; and in a case [1] where r≧g≧b, $$ro=Krg(r-g)^{Nr},$$

$$yo=Kyg(g-b)^{Ny},$$

$$go=bo=mo=co=0,$$

for case [2] where r≧b>g, $$ro=Krb(r-b)^{Nr},$$

$$mo=Kmb(b-g)^{Nm},$$

$$go=bo=yo=co=0,$$

for case [3] where b>r≧g, $$bo=Kbr(b-r)^{Nb},$$

$$mo=Kmr(r-g)^{Nm},$$

$$ro=go=yo=co=0,$$

for case [4] where b>g>r, $$bo=Kbg(b-gl)^{Nb},$$

$$co=Kcg(g-r)^{Nc},$$

$$ro=go=yo=mo=0,$$

for case [5] where g≧b>r, $$go=Kgb(g-b)^{Ng},$$

$$co=Kcb(b-r)^{Nc},$$

$$ro=bo=yo=mo=0,$$

for case [6] where g>r≧b, $$go=Kgr(g-r)^{Ng},$$

$$yo=Kyr(r-b)^{Ny},$$

$$ro=bo=mo=co=0,$$

where Krg, Krb, Kbr, Kbg, Kgb, Kgr, Kyg, Kyr, Kmb, Kmr, Kcg and Kcb are variables which change depending on values of r, g and b; and Nr, Ng, Nb, Ny, Nm and Nc are constants not less than 0.

Further, it is preferable that the variables are expressed as:

$$Krg=Cr\cdot frg(r,b),\ Krb=Cr\cdot frb(r,g)$$

$$Kgr=Cg\cdot fgr(g,b),\ Kgb=Cg\cdot fgb(g,r)$$

$$Kbr=Cb\cdot fbr(b,g),\ Kbg=Cb\cdot fbg(b,r)$$

$$Kyg=Cy\cdot fyg(r,b),\ Kmb=Cm\cdot fmb(r,g)$$

$$Kmr=Cm\cdot fmr(b,g),\ Kcg=Cc\ fcg(b,r)$$

$$Kcb=Cc\cdot fcb(g,r),\ Kyr=Cy\cdot fyr(g,b)$$

where Cr, Cb, Cg, Cy, Cm and Cc are constants; frg, frb, fgr, fgb, fbr, fbg, fyg, fmb, fmr, fcg, fcb and fyr are functions which respectively change depending on values of r, g and b in corresponding brackets; and the r, g and b are obtained by dividing original gradation levels of the RGB components of the input color image signal by a maximum gradation value N−1.

Further, the variables may be expressed as:

$$Krg=Cr\cdot far(r)\cdot fag(b),\ Krb=Cr\cdot far(r)\cdot fab(g)$$

$$Kgr=Cg\cdot fag(g)\cdot far(b),\ Kgb=Cg\cdot fag(g)\cdot fab(r)$$

$$Kbr=Cb\cdot fab(b)\cdot far(g),\ Kbg=Cb\cdot fab(b)\cdot fag(r)$$

$$Kyg=Cy\cdot far(r)\cdot fab(b),\ Kmb=Cm\cdot far(r)\cdot fag(g)$$

$$Kmr=Cm\cdot fab(b)\cdot fag(g),\ Kcg=Cc\cdot fab(b)\cdot far(r)$$

$$Kcb=Cc\cdot fag(g)\cdot fa\ r(r),\ Kyr=Cy\cdot fag(g)\cdot fab(b)$$

where Cr, Cb, Cg, Cy, Cm and Cc are constants; far, fab and fag are functions which respectively change depending on values of r, g and b in corresponding brackets; and the r, g and b are obtained by dividing original gradation levels of the RGB components of the input color image signal by a maximum gradation value N−1.

Further, the variables may be expressed as:

| | |
|---|---|
| $Krg = Cr \cdot \alpha r \cdot \alpha b$, | $Krb = Cr \cdot \alpha r \cdot \alpha g$, |
| $Kgr = Cg \cdot \alpha g \cdot \alpha b$, | $Kgb = Cg \cdot \alpha g \cdot \alpha r$, |
| $Kbr = Cb \cdot \alpha b \cdot \alpha g$, | $Kbg = Cb \cdot \alpha b \cdot \alpha r$, |
| $Kyg = Cy \cdot \alpha r \cdot \alpha b$, | $Kmb = Cm \cdot \alpha r \cdot \alpha g$, |
| $Kmr = Cm \cdot \alpha b \cdot \alpha g$, | $Kcg = Cc \cdot \alpha b \cdot \alpha r$, |
| $Kcb = Cc \cdot \alpha g \cdot \alpha r$, | $Kyr = Cy \cdot \alpha g \cdot \alpha b$, |
| $\alpha r = f0 \times r^k$ | $(0 \leqq r < Mr)$, |
| $\alpha r = f1 \times (1 - r)^k$ | $(Mr \leqq r \leqq 1)$, |
| $\alpha g = g0 \times gk$ | $(0 \leqq g < Mg)$, |
| $\alpha g = g1 \times (1 - g)^k$ | $(Mg \leqq g \leqq 1)$, |
| $\alpha b = h0 \times b^k$ | $(0 \leqq b < Mb)$, |
| $\alpha b = h1 \times (1 - b)^k$ | $(Mb \leqq b \leqq 1)$, |

where Cr, Cb, Cg, Cy, Cm and Cc are constants, and the r, g and b are obtained by dividing original gradation levels of the RGB components of the input color image signal by a maximum gradation value N−1.

Further, the variables may be expressed as:

| | |
|---|---|
| $Krg = Cr \cdot \alpha r \cdot \alpha b$, | $Krb = Cr \cdot \alpha r \cdot \alpha g$, |
| $Kgr = Cg \cdot \alpha g \cdot \alpha b$, | $Kgb = Cg \cdot \alpha g \cdot \alpha r$, |
| $Kbr = Cb \cdot \alpha b \cdot \alpha g$, | $Kbg = Cb \cdot \alpha b \cdot \alpha r$, |
| $Kyg = Cy \cdot \alpha r \cdot \alpha b$, | $Kmb = Cm \cdot \alpha r \cdot \alpha g$, |
| $Kmr = Cm \cdot \alpha b \cdot \alpha g$, | $Kcg = Cc \cdot \alpha b \cdot \alpha r$, |
| $Kcb = Cc \cdot \alpha g \cdot \alpha r$, | $Kyr = Cy \cdot \alpha g \cdot \alpha b$, |
| $\alpha r = 2 \times r$ | $(0 \leqq r < 0.5)$, |
| $\alpha r = 2 \times (1 - r)$ | $(0.5 \leqq r \leqq 1)$, |
| $\alpha g = 2 \times g$ | $(0 \leqq g < 0.5)$, |
| $\alpha g = 2 \times (1 - g)$ | $(0.5 \leqq g \leqq 1)$, |
| $\alpha b = 2 \times b$ | $(0 \leqq b < 0.5)$, |
| $\alpha b = 2 \times (1 - b)$ | $(0.5 \leqq b \leqq 1)$, |

where Cr, Cb, Cg, Cy, Cm and Cc are constants, and the r, g and b are obtained by dividing original gradation levels of the RGB components of the input color image signal by a maximum gradation value N−1.

Further, the variables may be expressed as:

$$Krg=Cr\cdot fmax(r)\cdot fmin(b),\ Krb=Cr\cdot fmax(r)\cdot fmin(g)$$

$$Kgr=Cg\cdot fmax(g)\cdot fmin(b),\ Kgb=Cg\cdot fmax(g)\cdot fmin(r)$$

$$Kbr=Cb\cdot fmax(b)\cdot fmin(g),\ Kbg=Cb\cdot fmax(b)\cdot fmin(r)$$

$$Kyg=Cy\cdot fmax(r)\cdot fmin(b),\ Kmb=Cm\cdot fmax(r)\cdot fmin(g)$$

$$Kmr=Cm\cdot fmax(b)\cdot fmin(g),\ Kcg=Cc\cdot fmax(b)\cdot fmin(r)$$

$$Kcb=Cc\cdot fmax(g)\cdot fmin(r),\ Kyr=Cy\cdot fmax(g)\cdot fmin(b)$$

where Cr, Cb, Cg, Cy, Cm and Cc are constants; fmax, and fmin are functions which respectively change depending on values of r, g and b in corresponding brackets; and the r, g and b are obtained by dividing original gradation levels of the RGB components of the input color image signal by a maximum gradation value N−1.

Further, the variables may be expressed as:

| | |
|---|---|
| $Krg = Cr \cdot Sr \cdot Tb$, | $Krb = Cr \cdot Sr \cdot Tg$, |
| $Kgr = Cg \cdot Sg \cdot Tb$, | $Kgb = Cg \cdot Sg \cdot Tr$, |
| $Kbr = Cb \cdot Sb \cdot Tg$, | $Kbg = Cb \cdot Sb \cdot Tr$, |
| $Kyg = Cy \cdot Sr \cdot Tb$, | $Kmb = Cm \cdot Sr \cdot Tg$, |
| $Kmr = Cm \cdot Sb \cdot Tg$, | $Kcg = Cc \cdot Sb \cdot Tr$, |
| $Kcb = Cc \cdot Sg \cdot Tr$, | $Kyr = Cy \cdot Sg \cdot Tb$, |
| $Tr = r^k$, | |
| $Sr = (1 - r)^k$, | |

-continued

| |
|---|
| $Tg = g^k$, |
| $Sg = (1 - g)^k$, |
| $Tb = b^k$, |
| $Sb = (1 - b)^k$, |

where Cr, Cb, Cg, Cy, Cm, Cc and k are constants, and the r, g and b are obtained by dividing original gradation levels of the RGB components of the input color image signal by a maximum gradation value N−1.

Further, it is preferable that the constant k is 1.

Further, it is preferable that the Cr, Cb, Cg, Cy, Cm and Cc are constants expressed as 1/(integer power of 2).

Further, the input color image signal may be converted into an output color image signal with the RGB components respectively having gradation levels of r', g' and b', which are given by:

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

where r, g and b respectively express gradation levels of RGB components of the inputted color image signal; and $A_{36}$ expresses square matrix of 3×6; and in the case [1] where r≧g≧b, $$ro=Krg(r-g)^{Nr},$$

$$yo=Kyg(g-b)^{NY},$$

$$go=bo=mo=co=0,$$

in the case [2] where r>b>g, $$ro=Krb(r-b)^{Nr},$$

$$mo=Kmb(b-g)^{Nm},$$

$$go=bo=yo=co=0,$$

in the case [3] where b>r≧g, $$bo=Kbr(b-r)^{Nb},$$

$$mo=Kmr(r-g)^{Nm},$$

$$ro=go=yo=co=0,$$

in the case [4] where b>g>r, $$bo=Kbg(b-g)^{Nb},$$

$$co=Kcg(g-r)^{Nc},$$

$$ro=go=yo=mo=0,$$

in the case [5] where g≧b>r, $$go=Kgb(g-b)^{Ng},$$

$$co=Kcb(b-r)^{Nc},$$

$$ro=bo=yo=mo=0,$$

in the case [6] where g>r≧b, $$go=Kgr(g-r)^{Ng},$$

$$yo=Kyr(r-b)^{NY},$$

$$ro=bo=mo=co=0,$$

where Krg, Krb, Kbr, Kbg, Kgb, Kgr, Kyg, Kyr, Kmb, Kmr, Kcg and Kcb are variables which change depending on values of r, g and b; and Nr, Ng, Nb, Ny, Nm and Nc are constants not less than 0.

Further, the input color image signal may be converted into an output color image signal with the RGB components respectively having gradation levels of r', g' and b', which are given by:

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

where r, g and b respectively express gradation levels of RGB components of the inputted color image signal; and $A_{36}$ expresses square matrix of 3×6; and in the case [1] where r≧g≧b, $$ro=Krg(fzr(r)-fzg(g))^{Nr},$$

$$yo=Kyg(fzg(g)-fzb(b))^{Ny},$$

$$go=bo=mo=co=0,$$

in the case [2] where r≧b>g, $$ro=Krb(fzr(r)-fzb(b))^{Nr},$$

$$mo=Kmb(fzb(b)-fzg(g))^{Nm},$$

$$go=bo=yo=co=0,$$

in the case [3] where b>r≧g $$bo=Kbr(fzb(b)-fzr(r))^{Nb}$$

$$mo=Kmr(fzr(r)-fzg(g))^{Nm}$$

$$ro=go=yo=co=0$$

in the case [4] where b>g>r $$bo=Kbg(fzb(b)-fzg(g))^{Nb}$$

$$co=Kcg(fzg(g)-fzr(r))^{Nc}$$

$$ro=go=yo=mo=0$$

in the case [5] where g≧b>r $$go=Kgb(fzg(g)-fzb(b))^{Ng}$$

$$co=Kcb(fzb(b)-fzr(r))^{Nc}$$

$$ro=bo=yo=mo=0$$

in the case [6] where g>r≧b $$go=Kgr(fzg(g)-fzr(r))^{Ng}$$

$$yo=Kyr(fzr(r)-fzb(b))^{NY}$$

$$ro=bo=mo=co=0$$

where Krg, Krb, Kbr, Kbg, Kgb, Kgr, Kyg, Kyr, Kmb, Kmr, Kcg and Kcb are variables which change depending on values of r, g and b; Nr, Ng, Nb, Ny, Nm and Nc are constants not less than 0, and fzr, fzg, fzb are functions which respectively change depending on values of r, g and b in corresponding brackets.

Further, the input color image signal may be converted into an output color image signal in which the RGB components respectively have gradation levels of r', g' and b', which are given by:

$$r'=r+ro+yo+mo,$$

$$g'=g+go+yo+co,$$

$$b'=b+bo+mo+co,$$

where r, g and b respectively express gradation levels of RGB components of the inputted color image signal; and, in the case [1] where r≧g≧b, $$ro=Krg\cdot fnr(r-g),$$

$$yo=Kyg\cdot fny(g-b),$$

$$go=bo=mo=co=0,$$

in the case [2] where r≧b>g, $$ro=Krb\cdot fnr(r-b),$$

$$mo=Kmb\cdot fnm(b-g),$$

$$go=bo=yo=co=0,$$

in the case [3] where b>r≧g, $$bo=Kbr\cdot fnb(b-r),$$

$$mo=Kmr\cdot fnm(r-g),$$

$$ro=go=yo=co=0,$$

in the case [4] where b>g>r, $$bo=Kbg\cdot fnb(b-g),$$

$$co=Kcg\cdot fnc(g-r),$$

$$ro=go=yo=mo=0,$$

in the case [5] where g≧b>r, $$go=Kgb\cdot fng(g-b),$$

$$co=Kcb\cdot fnc(b-r),$$

$$ro=bo=yo=mo=0,$$

in the case [6] where g>r≧b, $$go=Kgr\cdot fng(g-r),$$

$$yo=Kyr\cdot fny(r-b),$$

$$ro=bo=mo=co=0,$$

where Krg, Krb, Kbr, Kbg, Kgb, Kgr, Kyg, Kyr, Kmb, Kmr, Kcg and Kcb are variables which change depending on values of r, g and b; and fnr(DX), fng(DX), fnb(DX), fny(DX), fnm(DX) and fnc(DX) are functions which respectively change depending on calculation result DX (0≦DX≦1) of corresponding brackets.

As with this arrangement, by setting the coefficients Krg, Krb, Kbr, Kbg, Kgb, Kgr, Kyg, Kyr, Kmb, Kmr, Kcg and Kcb (weighting functions) based on one of the R, G and B component having the maximum luminance and the one of them having the minimum luminance, it is possible to reduce the weighting functions when the gradation level of a color component with a maximum luminance comes closer to the maximum gradation value, or when the gradation level of a color component with the minimum luminance comes close to 0.

Accordingly, it is possible to prevent the defect of color saturation in the case where an output color image signal has a greater gradation level than the maximum gradation value, and also to prevent enhancement of saturation when the input signal is a monochromatic color, thus outputting (displaying) a color image with appropriate gradation.

The foregoing effect offered by the weighting function may also be obtained with the following arrangements.

That is, the color display device of an embodiment of the present invention may be arranged so that the input color image signal is converted into an output color image signal with the three color components respectively having gradation levels of r', g' and b', which are given by:

$$r'=r+ro+yo+mo,$$

$$g'=g+go+yo+co,$$

$$b'=b+bo+mo+co,$$

where r, g and b are values obtained by dividing original gradation levels of the three color components of the input color image signal by a maximum gradation value N−1; and, in a case [1] where r≧g≧b:

$$ro=Cr(r-g)^{Nr},$$

$$yo=Cy(g-b)^{Ny},$$

$$go=bo=mo=co=0,$$

in a case [2] where r≧b>g:

$$ro=Cb(r-b)^{Nr},$$

$$mo=Cm(b-g)^{Nm},$$

$$go=bo=yo=co=0,$$

in a case [3] where b>r≧g:

$$bo=Cb(b-r)^{Nb},$$

$$mo=Cm(r-g)^{Nm},$$

$$ro=go=yo=co=0,$$

in a case [4] where b>g>r:

$$bo=Cb(b-g)^{Nb},$$

$$co=Cc(g-r)^{Nc},$$

$$ro=go=yo=mo=0,$$

in a case [5] where g≧b>r:

$$go=Cg(g-b)^{Ng},$$

$$co=Cc(b-r)^{Nc},$$

$$ro=bo=yo=mo=0, \text{ and}$$

in a case [6] where g>r≧b:

$$go=Cg(g-r)^{Ng},$$

$$yo=Cy(r-b)^{Ny},$$

$$ro=bo=mo=co=0,$$

in which Cr, Cg, Cb, Cy, Cm, Cc, Nr, Ng, Nb, Ny, Nm, and Nc are constants.

Further, the color display device of an embodiment of the present invention may be arranged so that the input color image signal is converted into an output color image signal with the three color components respectively having gradation levels of r', g' and b', which are given by:

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

where r, g and b are values obtained by dividing original gradation levels of the three color components of the input color image signal by a maximum gradation value N−1; and $A_{36}$ expresses square matrix of 3×6; and in a case [1] where r≧g≧b:

$$ro=Cr(r-g),$$

$$yo=Cy(g-b),$$

$$go=bo=mo=co=0,$$

in a case [2] where r≧b>g:

$$ro=Cr(r-b),$$

$$mo=Cm(b-g),$$

$$go=bo=yo=co=0,$$

in a case [3] where b>r≧g:

$$bo=Cb(b-r),$$

$$mo=Cm(r-g),$$

$$ro=go=yo=co=0,$$

in a case [4] where b>g>r:

$$bo=Cb(b-g),$$

$$co=Cc(g-r),$$

$$ro=go=yo=mo=0,$$

in a case [5] where g≧b>r:

$$go=Cg(g-b),$$

$$co=Cc(b-r),$$

$$ro=bo=yo=mo=0, \text{ and}$$

in a case [6] where g>r≧b:

$$go=Cg(g-r),$$

$$yo=Cy(r-b),$$

$$ro=bo=mo=co=0,$$

in which Cr, Cg, Cb, Cy, Cm, and Cc are constants.

Further, the color display device of an embodiment of the present invention may be arranged so that the input color image signal is converted into an output color image signal with the three color components respectively having gradation levels of r', g' and b', which are given by:

$$r'=r+ro+yo+mo$$

$$g'=g+go+yo+co$$

$$b'=b+bo+mo+co$$

where r, g and b are values obtained by dividing original gradation levels of the three color components of the input color image signal by a maximum gradation value N−1; and, in a case [1] where (r≧g≧b):

$$ro=Cr(fzr(r)-fzg(g)),$$

$$yo=Cy(fzg(g)-fzb(b)),$$

$$go=bo=mo=co=0,$$

in a case [2] where (r≧b>g):

$$ro=Cr(fzr(r)-fzb(b)),$$

$$mo=Cm(fzb(b)-fzg(g)),$$

$$go=bo=yo=co=0,$$

in a case [3] where (b>r≧g):

$$bo=Cb(fzb(b)-fzr(r)),$$

$$mo=Cm(fzr(r)-fzg(g)),$$

$$ro=go=yo=co=0,$$

in a case [4] where (b>g>r):

$$bo=Cb(fzb(b)-fzg(g)),$$

$$co=Cc(fzg(g)-fzr(r)),$$

$$ro=go=yo=mo=0,$$

in a case [5] where (g≧b>r):

$$go=Cg(fzg(g)-fzb(b)),$$

$$co=Cc(fzb(b)-fzr(r)),$$

$$ro=bo=yo=mo=0, \text{ and}$$

in a case [6] where (g>r≧b):

$$go=Cg(fzg(g)-fzr(r)),$$

$$yo=Cy(fz\ r(r)-fzb(b)),$$

$$ro=bo=mo=co=0,$$

Where Cr, Cg, Cb, Cy, Cm and Cc are constants; and fzr, fzg and fzb are functions which change depending on the values of r, g and b in corresponding brackets.

Further, the color display device of an embodiment of the present invention may be arranged so that the input color image signal is converted into an output color image signal with the three color components respectively having gradation levels of r', g' and b', which are given by:

$$r'=r+ro+yo+mo$$

$$g'=g+go+yo+co$$

$$b'=b+bo+mo+co$$

where r, g and b are values obtained by dividing original gradation levels of the three color components of the input color image signal by a maximum gradation value N−1; and, $$ro=Cr\cdot min\ (rg,\ rb),$$

$$go=Cg\cdot min\ (gr,\ gb),$$

$$bo=Cb\cdot min\ (br,\ bg),$$

$$yo=Cy\cdot min\ (rb,\ gb),$$

$$mo=Cm\cdot min\ (rg,\ bg),$$

$$co=Cc\cdot min\ (gr,\ br),$$

in which min ( ) is a function for giving a smallest value in a corresponding bracket; and Cr, Cg, Cb, Cy, Cm and Cc are constants, on condition that:

$$rg=r-g,$$

$$rb=r-b,$$

$$gr=g-r,$$

$$gb=g-b,$$

$$br=b-r,$$

$$bg=b-g,$$

in which each of rg, rb, gr, gb, br and bg are modified to 0 when they are minus values.

Further, the color display device of an embodiment of the present invention may be arranged so that the input color image signal is converted into an output color image signal with the three color components respectively having gradation levels of r', g' and b', which are given by:

$$r'=r+ro+yo+mo$$

$$g'=g+go+yo+co$$

$$b'=b+bo+mo+co$$

where r, g and b are values obtained by dividing original gradation levels of the three color components of the input color image signal by a maximum gradation value N−1; and $$ro=Krg\cdot rg \text{ where } rg<rb,$$

$$ro=Krb\cdot rb \text{ where } rg>rb,$$

$$go=Kgr\cdot gr \text{ where } gr<gb,$$

$$go=Kgb\cdot gb \text{ where } gr>gb,$$

$$bo=Kbr\cdot br \text{ where } br<bg,$$

$$bo=Kbg\cdot bg \text{ where } br>bg,$$

$$yo=Kyr\cdot rb \text{ where } rb<gb,$$

$$yo=Kyg\cdot gb \text{ where } rb>gb,$$

$$mo=Kmr\cdot rg \text{ where } rg<bg,$$

$$mo=Kmb\cdot bg \text{ where } rg>bg,$$

$$co=Kcg\cdot gr \text{ where } gr<br,$$

$$co=Kcb\cdot br \text{ where } gr>br,$$

in which Krg, Krb, Kbr, Kbg, Kgb, Kgr, Kyg, Kyr, Kmb, Kmr, Kcg and Kcb are variables which change depending on values of r, g and b, on condition that:

$$rg=r-g,$$

$$rb=r-b,$$

$$gr=g-r,$$

$$gb=g-b,$$

$$br=b-r,$$

$$bg=b-g,$$

in which each of rg, rb, gr, gb, br and bg are modified to 0 when they are minus values.

Further, it is preferable that the functions far(r), fab(b) and fag(g) are continuous functions which give 0 when the r, g and b ($0 \leqq r,g,b \leqq 1$) are 0 or 1.

With this arrangement, the weighting function becomes 0 when the value of the maximum luminance comes closer to the maximum gradation value, and when the value of the minimum luminance comes closer to 0.

Accordingly, it is possible to more securely prevent the defect of color saturation, and also more securely prevent enhancement of saturation when the input signal is a monochromatic color, thus securely outputting (displaying) a color image with appropriate gradation. Particularly, by setting the coefficient k, which is used for finding Tr, Sr, Tg, Sg, Tb and Sb, as 1, it is possible to simplify the process for calculating an output color image signal.

Further, it is preferable that the function fmax is a continuous function which gives 0 when the r, g and b ($0 \leqq r,g,b \leqq 1$) are 1; and the function fmin is continuous function which gives 0 when the r, g and b ($0 \leqq r,g,b \leqq 1$) are 0.

Further, it is preferable that the variables Nr and Ny are not less than 1, and that the variables Ng, Nb, Nm and Nc are not more than 1.

By making Nr and Ny not more than 1, change in luminance in the vicinity of flesh color is reduced, thus appropriately displaying an image of flesh color. Moreover, by making the variables Ng, Nb, Nm and Nc not more than 1, it is possible to increase the compensation value bo etc., which is added to the original gradations for color compensation, thus appropriately enhancing saturation in the vicinity of achromatic colors Further, it is preferable that the $A_{36}$ is expressed as:

$$A_{36} = \begin{pmatrix} a11 & a12 & a13 & a14 & a15 & a16 \\ a21 & a22 & a23 & a24 & a25 & a26 \\ a31 & a32 & a33 & a34 & a35 & a36 \end{pmatrix}$$

where a11=a22=a33=a14=a24=a15=a35=a26=a36=1 and a21, a31, a12, a32, a13, a23, a34, a25 and a16 are 0 or a negative value.

This arrangement of the matrix $A_{36}$ with the foregoing components offers the following effect.

For example, in the case where r>b>g, a21 is set to be not more than 0, and the G signal is reduced and the R signal is enhanced. In this manner, saturation of the R signal is more efficiently enhanced.

Similarly, by setting a12 and a32 to be not more than 0, saturation of the G signal is efficiently enhanced, and by setting a13 and a23 to be not more than 0, saturation of the B signal is efficiently enhanced.

Accordingly, the arrangement of the matrix $A_{36}$ with the foregoing components enables appropriate enhancement of saturation for the input signal having RGB components.

Further, it is preferable that the $A_{36}$ is expressed as:

$$A_{36} = \begin{pmatrix} a11 & a12 & a13 & a14 & a15 & a16 \\ a21 & a22 & a23 & a24 & a25 & a26 \\ a31 & a32 & a33 & a34 & a35 & a36 \end{pmatrix}$$

where a11=a22=a33=a14=a24=a15=a35=a26=a36=1, a11+a21+a31=0, a12+a22+a32=0, a13+a23+a33=0, a14+a24+a34=0, a15+a25+a35=0, and a16+a26+a36=0.

With these conditions, it is possible to equalize the gross input luminance (r+g+b) and the gross output luminance (r'+g'+b'). Therefore, saturation may be enhanced without a great change of average luminance of the input color signal.

Further, it is preferable that the $A_{36}$ is expressed as:

$$A_{36} = \begin{pmatrix} a11 & a12 & a13 & a14 & a15 & a16 \\ a21 & a22 & a23 & a24 & a25 & a26 \\ a31 & a32 & a33 & a34 & a35 & a36 \end{pmatrix}$$

where a11=a22=a33=a14=a24=a15=a35=a26=a36=1, a21=a31=a12=a32=a13=a23=−0.5, and a34=a25=a16=−2.

With these conditions, it is possible to evenly carry out addition/subtraction for each of the RGB signals. Therefore, saturation may be enhanced without causing changes in hue.

Further, it is preferable that the functions fzr, fzg, fzb convert input values identical with each other into output values different from each other. With this arrangement, it is possible to compensate gradation values of the inputted RGB signals with individual luminance values. This enables enhancement of saturation according to gradation luminance characteristics of the respective RGB colors.

Further, in a general display panel, the input gradation levels of RGB are converted into the luminance values by raising each of the respective gradation values of r, g and b to the power of 2.2. Thus, by satisfying: $fzr=r^{2.2}$, $fzg=g^{2.2}$ and $fzb=b^{2.2}$, it is possible to enhance saturation in a suitable way for a general display panel.

Further, by setting the functions as: $fzr=r^2$, $fzg=g^2$ and $fzb=b^2$, the saturation can be appropriately enhanced with simple operation by raising the gradation levels of R, G and B to the second power.

Further, it is preferable that the functions fnr(DX) and fny(DX) each give a negative value at least at a predetermined value in a range of $0<DX \leqq 1$.

In this arrangement, by setting the value of flesh color as the predetermined value, the calculations of compensation values ro and yo for calculating the output color image signal result is minus values. Accordingly, the R component and the B component of the output color image signal become weaker than those in the input color image signal, thus reducing saturation only for flesh color.

Further, since the functions fnr(DX) and fny(DX) each give a negative value at least at a predetermined value in a range of $0<DX \leqq 1$, the functions fnr (DX) and fny (DX) may be arbitrary set except for the range of the predetermined value. Accordingly, when the DX is a value in the vicinity of monochromatic color, the functions fnr (DX) and fny (DX) can be set substantially as 0, so that the compensation values ro and yo for calculating the output color image signal become substantially 0. Therefore, the R component and the B component of the output color image signal become substantially the same values as those in the input color image signal, thus maintaining saturation in the vicinity of monochromatic color.

Further, it is preferable that the functions fnr(DX) and fny(DX) are expressed as:

$$fnr(DX)=DX^2 \cdot Pr \cdot DX,$$

$$fny(DX)=DX^2 \cdot Py \cdot DX,$$

where Pr and Py are constants greater than 0.

In this manner, the functions fnr(DX) and fny(DX) may be written in a simpler form which allows easy implementation with hardware. Therefore, it is possible to reduce saturation of flesh color with a simple operation.

Further, a color display device of an embodiment of the present invention may be arranged so that the color display device determines a relationship between plural color components of an input color image signal in terms of their gradation levels, and carries out calculation based on the relationship, the calculation performing multiplication of each of 1) RGB adjustment components, 2) YMC components as complementary colors of the RGB components and 3) white component, that have been extracted from the plural color components of the input color image signal, by a coefficient, and addition/subtraction of a result of the multiplication to the plural color components.

Further, a color display device of an embodiment of the present invention may be arranged so that the color display device determines a relationship between RGB components of an input color image signal in terms of their gradation levels, and carries out a different calculation for each input color image signal depending on whether the input color image signal belongs to which of six patterns of the relationship. The color display device multiplies each of 1) RGB adjustment components, 2) YMC components as complementary colors of RGB and 3) white component, that have been extracted from the RGB components of the input color image signal, by a coefficient, and then add/subtract the multiplication results to the original three color components.

Further, it is preferable that the color display device carries out the calculation individually for each of the RGB components excluding a component with a smallest gradation level, using variables that vary depending on the respective gradation levels of the RGB components. Further, it is preferable that the color display device compensates white color by using a coefficient which gives a positive value when the white component of the input color image signal has high luminance and gives a negative value when the white component of the input color image signal has low luminance.

Further, it is preferable that the input color image signal is converted into an output color image signal with the RGB components respectively having gradation levels of r', g' and b', which are given by:

$$r'=r+ro+yo+mo+wo,$$

$$g'=g+go+yo+co+wo,$$

$$b'=b+bo+mo+co+wo,$$

where r, g and b respectively express gradation levels of RGB components of the inputted color image signal; and, in the case [1] where r≧g≧b, $$ro=Krg(r-g)^{Nr},$$

$$yo=Kyg(g-b)^{Ny},$$

$$wo=fw(b),$$

$$go=bo=mo=co=0,$$

in the case [2] where r≧b>g, $$ro=Krb(r-b)^{Nr},$$

$$mo=Kmb(b-g)^{Nm},$$

$$wo=fw(g),$$

$$go=bo=yo=co=0,$$

in the case [3] where b>r≧g, $$bo=Kbr(b-r)^{Nb},$$

$$mo=Kmr(r-g)^{Nm},$$

$$wo=fw(g),$$

$$ro=go=yo=co=0,$$

in the case [4] where b>g>r, $$bo=Kbg(b-g)^{Nb},$$

$$co=Kcg(g-r)^{Nc},$$

$$wo=fw(r),$$

$$ro=go=yo=mo=0,$$

in the case [5] where g≧b>r, $$go=Kgb(g-b)^{Ng},$$

$$co=Kcb(b-r)^{Nc},$$

$$wo=fw(r),$$

$$ro=bo=yo=mo=0,$$

in the case [6] where g>r≧b, $$go=Kgr(g-r)^{Ng},$$

$$yo=Kyr(r-b)^{Ny},$$

$$wo=fw(b),$$

$$ro=bo=mo=co=0,$$

where Krg, Krb, Kbr, Kbg, Kgb, Kgr, Kyg, Kyr, Kmb, Kmr, Kcg, Kcb and kw are either constants, or variables changing depending on values of r, g and b; Nr, Ng and Nr are constants not less than 0, and fw is a function which changes depending on the values of r, g and b in the corresponding bracket.

Further, it is preferable that the variables are expressed as:

| | |
|---|---|
| $Krg = Cr \cdot \alpha r \cdot \alpha b$, | $Krb = Cr \cdot \alpha r \cdot \alpha g$, |
| $Kgr = Cg \cdot \alpha g \cdot \alpha b$, | $Kgb = Cg \cdot \alpha g \cdot \alpha r$, |
| $Kbr = Cb \cdot \alpha b \cdot \alpha g$, | $Kbg = Cb \cdot \alpha b \cdot \alpha r$, |
| $Kyg = Cy \cdot \alpha r \cdot \alpha b$, | $Kmb = Cm \cdot \alpha r \cdot \alpha g$, |
| $Kmr = Cm \cdot \alpha b \cdot \alpha g$, | $Kcg = Cc \cdot \alpha b \cdot \alpha r$, |
| $Kcb = Cc \cdot \alpha g \cdot \alpha r$, | $Kyr = Cy \cdot \alpha g \cdot \alpha b$, |
| $\alpha r = f0 \times r^k$ | $(0 \leqq r < Mr)$, |
| $\alpha r = f1 \times (1 - r)^k$ | $(Mr \leqq r \leqq 1)$, |
| $\alpha g = g0 \times g^k$ | $(0 \leqq g < Mg)$, |
| $\alpha g = g1 \times (1 - g)^k$ | $(Mg \leqq g \leqq 1)$, |
| $\alpha b = h0 \times b^k$ | $(0 \leqq b < Mb)$, |
| $\alpha b = h1 \times (1 - b)^k$ | $(Mb \leqq b \leqq 1)$, |

where Cr, Cb, Cg, Cy, Cm and Cc are constants, and the r, g and b are obtained by dividing original gradation levels of the RGB components of the input color image signal by a maximum gradation value N−1.

Further, the variables may be expressed as:

| | |
|---|---|
| $Krg = Cr \cdot \alpha r \cdot \alpha b$, | $Krb = Cr \cdot \alpha r \cdot \alpha g$, |
| $Kgr = Cg \cdot \alpha g \cdot \alpha b$, | $Kgb = Cg \cdot \alpha g \cdot \alpha r$, |
| $Kbr = Cb \cdot \alpha b \cdot \alpha g$, | $Kbg = Cb \cdot \alpha b \cdot \alpha r$, |
| $Kyg = Cy \cdot \alpha r \cdot \alpha b$, | $Kmb = Cm \cdot \alpha r \cdot \alpha g$, |
| $Kmr = Cm \cdot \alpha b \cdot \alpha g$, | $Kcg = Cc \cdot \alpha b \cdot \alpha r$, |
| $Kcb = Cc \cdot \alpha g \cdot \alpha r$, | $Kyr = Cy \cdot \alpha g \cdot \alpha b$, |
| $\alpha r = 2 \times r$ | $(0 \leqq r < 0.5)$, |
| $\alpha r = 2 \times (1 - r)$ | $(0.5 \leqq r \leqq 1)$, |
| $\alpha g = 2 \times g$ | $(0 \leqq g < 0.5)$, |
| $\alpha g = 2 \times (1 - g)$ | $(0.5 \leqq g \leqq 1)$, |
| $\alpha b = 2 \times b$ | $(0 \leqq b < 0.5)$, |
| $\alpha b = 2 \times (1 - b)$ | $(0.5 \leqq b \leqq 1)$, |

where Cr, Cb, Cg, Cy, Cm and Cc are constants, and r, g and b are obtained by dividing the original gradation levels of the R, G and B components of the input image signal by the maximum gradation value N−1.

Further, the variables may be expressed as:

| | |
|---|---|
| Krg = Cr · Sr · Tb, | Krb = Cr · Sr · Tg, |
| Kgr = Cg · Sg · Tb, | Kgb = Cg · Sg · Tr, |
| Kbr = Cb · Sb · Tg, | Kbg = Cb · Sb · Tr, |
| Kyg = Cy · Sr · Tb, | Kmb = Cm · Sr · Tg, |
| Kmr = Cm · Sb · Tg, | Kcg = Cc · Sb · Tr, |
| Kcb = Cc · Sg · Tr, | Kyr = Cy · Sg · Tb, |
| $Tr = r^k$, | |
| $Sr = (1 - r)^k$, | |
| $Tg = g^k$, | |
| $Sg = (1 - g)^k$, | |
| $Tb = b^k$, | |
| $Sb = (1 - b)^k$, | |

where Cr, Cb, Cg, Cy, Cm, Cc and k are constants, and r, g and b are obtained by dividing the original gradation levels of the R, G and B components of the input image signal by the maximum gradation value N−1.

As with this arrangement, by setting the coefficients Krg, Krb, Kbr, Kbg, Kgb, Kgr, Kyg, Kyr, Kmb, Kmr, Kcg and Kcb (weighting functions) based on one of the R, G and B component having the maximum luminance and the one of them having the minimum luminance, it is possible to reduce the weighting functions when the gradation level of a color component with a maximum luminance comes closer to the maximum gradation value, or when the gradation level of a color component with the minimum luminance comes close to 0.

Accordingly, it is possible to prevent the defect of color saturation in the case where an output color image signal has a greater gradation level than the maximum gradation value, and also to prevent enhancement of saturation when the input signal is a monochromatic color, thus outputting (displaying) a color image with appropriate gradation.

The foregoing effect offered by the weighting function may also be obtained with the following arrangements.

That is, the color display device of an embodiment of the present invention may be arranged so that the input color image signal is converted into an output color image signal with the three color components respectively having gradation levels of r', g' and b', which are given by:

$$r'=r+ro+yo+mo+wb$$

$$g'=g+go+yo+co+wo$$

$$b'=b+bo+mo+co+wo$$

where r, g and b are values obtained by dividing original gradation levels of the three color components of the input color image signal by a maximum gradation value N−1; and in a case [1] where (r≧g≧b):

$$ro=Cr(r-g),$$

$$yo=Cy(g-b),$$

$$wo=fw(b),$$

$$go=bo=mo=co=0,$$

in a case [2] where (r≧b>g):

$$ro=Cr(r-b),$$

$$mo=Cm(b-g),$$

$$wo=fw(g),$$

$$go=bo=yo=co=0,$$

in a case [3] where (b>r≧g):

$$bo=Cb(b-r),$$

$$mo=Cm(r-g),$$

$$wo=fw(g),$$

$$ro=go=yo=co=0,$$

in a case [4] where (b>g>r):

$$bo=Cb(b-g),$$

$$co=Cc(g-r),$$

$$wo=fw(r),$$

$$ro=go=yo=mo=0,$$

in a case [5] where (g>b>r):

$$go=Cg(g-b),$$

$$co=Cc(b-r),$$

$$wo=fw(r),$$

$$ro=bo=yo=mo=0, \text{ and}$$

in a case [6] where (g>r≧b):

$$go=Cg(g-r),$$

$$yo=Cy(r-b),$$

$$wo=fw(b),$$

$$ro=bo=mo=co=0,$$

in which Cr, Cg, Cb, Cy, Cm, and Cc are constants; and fw is a function dynamically changes depending on an average luminance and a peak luminance of a whole image.

Further, the color display device may be arranged so that the input color image signal is converted into an output color image signal with the three color components respectively having gradation levels of r', g' and b', which are given by:

$$r'=r+ro+yo+mo+wo$$

$$g'=g+go+yo+co+wo$$

$$b'=b+bo+mo+co+wo$$

where r, g and b are values obtained by dividing original gradation levels of the three color components of the input color image signal by a maximum gradation value N−1; and, $$ro=Cr\cdot min\ (rg, rb),$$

$$go=Cg\cdot min\ (gr, gb),$$

$$bo=Cb\cdot min\ (br, bg),$$

$$yo=Cy\cdot min\ (rb, gb),$$

$$mo=Cm\cdot min\ (rg, bg),$$

$$co=Cc\cdot min\ (gr, br),$$

$$wo=fw\cdot min\ (r, g, b),$$

in which min ( ) is a function for giving a smallest value in a corresponding bracket, on condition that:

$rg=r-g,$ $rb=r-b,$ $gr=g-r,$ $gb=g-b,$ $br=b-r,$ $bg=b-g,$ in which each of rg, rb, gr, gb, br and bg are modified to 0 when they are minus values.

Further, the color display device may be arranged so that the input color image signal is converted into an output color image signal with the three color components respectively having gradation levels of r', g' and b', which are given by:

$r'=r+ro+yo+mo+wo$ $g'=g+go+yo+co+wo$ $b'=b+bo+mo+co+wo$ where r, g and b are values obtained by dividing original gradation levels of the three color components of the input color image signal by a maximum gradation value N−1; and $ro=Krg\cdot rg$ where $rg<rb,$ $ro=Krb\cdot rb$ where $rg>rb,$ $go=Kgr\cdot gr$ where $gr<gb,$ $go=Kgb\cdot gb$ where $gr>gb,$ $bo=Kbr\cdot br$ where $br<bg,$ $bo=Kbg\cdot bg$ where $br>bg,$ $yo=Kyr\cdot rb$ where $rb<gb,$ $yo=Kyg\cdot gb$ where $rb>gb,$ $mo=Kmr\cdot rg$ where $rg<bg,$ $mo=Kmb\cdot bg$ where $rg>bg,$ $co=Kcg\cdot gr$ where $gr<br,$ $co=Kcb\cdot br$ where $gr>br,$ $wo=fw(\min(r, g, b)),$ in which min ( ) is a function for giving a smallest value in a corresponding bracket; Krg, Krb, Kbr, Kbg, Kgb, Kgr, Kyg, Kyr, Kmb, Kmr, Kcg and Kcb are variables which change depending on values of r, g and b; and fw is a function which changes depending on a value in a corresponding bracket, on condition that:

$rg=r-g,$ $rb=r-b,$ $gr=g-r,$ $gb=g-b,$ $br=b-r,$ $bg=b-g,$ in which each of rg, rb, gr, gb, br and bg are modified to 0 when they are minus values.

Further, it is preferable that the constant k is 1.

Further, it is preferable that the function fw changes depending on an average luminance and a peak luminance of a whole image.

Further, the function fw may satisfy: $fw(X)=CwX^{Z}$, where Cw and Z are constants, and X is one of the r, g and b.

Further, the function fw may be expressed as:

| | |
|---|---|
| $fw(X) = Cw_0X$ | $(_0 \leqq X < Mw),$ |
| $fw(X) = Cw_1(1 - X)$ | $(Mw \leqq X \leqq {}_1),$ |

where $Cw_0$, $Cw_1$, Mw are constants.

Further, the color display device of an embodiment of the present invention preferably further includes: a detecting device for detecting environmental changes; and A color converting device for controlling at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, according to a result of detection by the detecting device.

With the additional provision of the detecting device and the color conversion device, it is possible to adjust saturation according to changes in environment. Saturation of images displayed in a color display device is easily changed by outside light. In this view, by using the detecting device as device for detecting light intensity of outside of the color display device, it is possible to adjust saturation according to changes in environment, thus more appropriately adjusting saturation.

Further, the color display device of an embodiment of the present invention preferably further includes: color converting device for controlling at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, depending on whether a backlight of a semi-transmission liquid crystal panel is on or off.

A semi-transmission liquid crystal panel functions as a transmission liquid crystal panel with the backlight on, and functions as a reflection liquid crystal panel with the backlight off; that is, color of displayed images of a semi-transmission liquid crystal panel changes depending on whether the backlight is on or off. In this view, the foregoing arrangement is provided with color converting means for controlling at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, depending on whether a backlight of a semi-transmission liquid crystal panel is on or off. On this account, an embodiment of the present invention provides a color display device suitable for saturation adjustment for image display of a semi-transmission liquid crystal panel.

Although many of the present exemplary embodiments are discussed in conjunction with a liquid crystal display panel as the color display device, it should be understood that the embodiments of present invention also may be used in conjunction with other display devices capable of color display, including but not limited to a cathode ray tube (CRT), a plasma display panel (PDP), etc.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A color display device that determines a relationship between three color components of an input color image signal in terms of gradation levels of the three color components of an input color image signal, and that carries out a different calculation for each input color image signal depending on which of six patterns of the relationship that the input color image signal belongs to, the calculation being performed for each of the three color components excluding a component with a relatively smallest gradation level, using variables varying depending on the relationship among the respective gradation levels of the three color components, wherein the gradation level of the color component with the relatively smallest gradation level remains unchanged before and after the calculation, and wherein:

the input color image signal is converted into an output color image signal with the at least three color components respectively having gradation levels of r', g'and b', which are given by:

$$r'=r+ro+yo+mo,$$

$$g'=g+go+yo+co,$$

$$b'=b+bo+mo+co,$$

where r, g and b are values obtained by dividing original gradation levels of the three color components of the input color image signal by a maximum gradation value N−1; and in a case [1] where r≧g≧b:

$$ro=Krg(r-g)^{Nr},$$

$$yo=Kyg(g-b)^{Ny},$$

$$go=bo=mo=co=0,$$

in a case [2] where r≧b>g:

$$ro=Krb(r-b)^{Nr},$$

$$mo=Kmb(b-g)^{Nm},$$

$$go=bo=yo=co=0,$$

in a case [3] where b>r≧g:

$$bo=Kbr(b-r)^{Nb},$$

$$mo=Kmr(r-g)^{Nm},$$

$$ro=go=yo=co=0,$$

in a case [4] where b>g>r:

$$bo=Kbg(b-g)^{Nb},$$

$$co=Kcg(g-r)^{Nc},$$

$$ro=go=yo=mo=0,$$

in a case [5] where g≧b>r:

$$go=Kgb(g-b)^{Ng},$$

$$co=Kcb(b-r)^{Nc},$$

$$ro=bo=yo=mo=0,$$

in a case [6] where g>r≧b:

$$go=Kgr(g-r)^{Ng},$$

$$yo=Kyr(r-b)^{Ny},$$

$$ro=bo=mo=co=0,$$

in which Krg, Krb, Kbr, Kbg, Kgb, Kgr, Kyg, Kyr, Kmb, Kmr, Kcg and Kcb are variables which change depending on values of r, g and b; and Nr, Ng, Nb, Ny, Nm and Nc are constants not less than 0.

2. The color display device as set forth in claim 1, wherein: the variables are expressed as:

$$Krg=Cr\cdot frg(r,b),Krb=Cr\cdot frb(r,g),$$

$$Kgr=Cg\cdot fgr(g,b),Kgb=Cg\cdot fgb(g,r),$$

$$Kbr=Cb\cdot fbr(b,g),Kbg=Cb\cdot fbg(b,r),$$

$$Kyg=Cy\cdot fyg(r,b),Kmb=Cm\cdot fmb(r,g),$$

$$Kmr=Cm\cdot fmr(b,g),Kcg=Cc\cdot fcg(b,r),$$

$$Kcb=Cc\cdot fcb(g,r),Kyr=Cy\cdot fyr(g,b),$$

where Cr, Cb, Cg, Cy, Cm and Cc are constants; frg, frb, fgr, fgb, fbr, fbg, fyg, fmb, fmr, fcg, fcb and fyr are functions which respectively change depending on values of r, g and b in corresponding brackets; and the r, g and b are obtained by dividing original gradation levels of the three color components of the input color image signal by a maximum gradation value N−1.

3. The color display device as set forth in claim 2, wherein: the Cr, Cb, Cg, Cy, Cm and Cc are constants expressed as 1/(integer power of 2).

4. The color display device as set forth in claim 1, wherein: the variables are expressed as:

$$Krg=Cr\cdot far(r)\cdot fag(b),Krb=Cr\cdot far(r)\cdot fab(g),$$

$$Kgr=Cg\cdot fag(g)\cdot far(b),Kgb=Cg\cdot fag(g)\cdot fab(r),$$

$$Kbr=Cb\cdot fab(b)\cdot far(g),Kbg=Cb\cdot fab(b)\cdot fag(r),$$

$$Kyg=Cy\cdot far(r)\cdot fab(b),Kmb=Cm\cdot far(r)\cdot fag(g),$$

$$Kmr=Cm\cdot fab(b)\cdot fag(g),Kcg=Cc\cdot fab(b)\cdot far(r),$$

$$Kcb=Cc\cdot fag(g)\cdot far(r),Kyr=Cy\cdot fag(g)\cdot fab(b),$$

where Cr, Cb, Cg, Cy, Cm and Cc are constants; far, fab and fag are functions which respectively change depending on values of r, g and b in corresponding brackets; and the r, g and b are obtained by dividing original gradation levels of the three color components of the input color image signal by a maximum gradation value N−1.

5. The color display device as set forth in claim 4, wherein: the functions far(r), fab(b) and fag(g) are continuous functions which give 0 when the r, g and b (0≦r,g,b≦1) are 0 or 1.

6. The color display device as set forth in claim 4, wherein: the Cr, Cb, Cg, Cy, Cm and Cc are constants expressed as 1/(integer power of 2).

7. The color display device as set forth in claim 1, wherein: the variables are expressed as:

| | |
|---|---|
| $Krg = Cr \cdot \alpha r \cdot \alpha b,$ | $Krb = Cr \cdot \alpha r \cdot \alpha g,$ |
| $Kgr = Cg \cdot \alpha g \cdot \alpha b,$ | $Kgb = Cg \cdot \alpha g \cdot \alpha r,$ |
| $Kbr = Cb \cdot \alpha b \cdot \alpha g,$ | $Kbg = Cb \cdot \alpha b \cdot \alpha r,$ |
| $Kyg = Cy \cdot \alpha r \cdot \alpha b,$ | $Kmb = Cm \cdot \alpha r \cdot \alpha g,$ |
| $Kmr = Cm \cdot \alpha b \cdot \alpha g,$ | $Kcg = Cc \cdot \alpha b \cdot \alpha r,$ |
| $Kcb = Cc \cdot \alpha g \cdot \alpha r,$ | $Kyr = Cy \cdot \alpha g \cdot \alpha b,$ |

-continued

| | |
|---|---|
| $\alpha r = f_0 \times r^k$ | $(0 \leqq r < Mr)$, |
| $\alpha r = f_1 \times (1 - r)^k$ | $(Mr \leqq r \leqq 1)$, |
| $\alpha g = g_0 \times gk$ | $(0 \leqq g < Mg)$, |
| $\alpha g = g_1 \times (1 - g)^k$ | $(Mg \leqq g \leqq 1)$, |
| $\alpha b = h_0 \times b^k$ | $(0 \leqq b < Mb)$, |
| $\alpha b = h_1 \times (1 - b)^k$ | $(Mb \leqq b \leqq 1)$, |

where $f_0$, $f_1$, $g_0$, $g_1$, $h_0$, $h_1$, Mr, Mg, Mb and k are constants; Cr, Cb, Cg, Cy, Cm and Cc are constants, and the r, g and b are obtained by dividing original gradation levels of the three color components of the input color image signal by a maximum gradation value N−1.

8. The color display device as set forth in claim 7, wherein:

the Cr, Cb, Cg, Cy, Cm and Cc are constants expressed as 1/(integer power of 2).

9. The color display device as set forth in claim 1, wherein:

the variables are expressed as:

| | |
|---|---|
| $Krg = Cr \cdot \alpha r \cdot \alpha b$, | $Krb = Cr \cdot \alpha r \cdot \alpha g$, |
| $Kgr = Cg \cdot \alpha g \cdot \alpha b$, | $Kgb = Cg \cdot \alpha g \cdot \alpha r$, |
| $Kbr = Cb \cdot \alpha b \cdot \alpha g$, | $Kbg = Cb \cdot \alpha b \cdot \alpha r$, |
| $Kyg = Cy \cdot \alpha r \cdot \alpha b$, | $Kmb = Cm \cdot \alpha r \cdot \alpha g$, |
| $Kmr = Cm \cdot \alpha b \cdot \alpha g$, | $Kcg = Cc \cdot \alpha b \cdot \alpha r$, |
| $Kcb = Cc \cdot \alpha g \cdot \alpha r$, | $Kyr = Cy \cdot \alpha g \cdot \alpha b$, |
| $\alpha r = 2 \times r$ | $(0 \leqq r < 0.5)$, |
| $\alpha r = 2 \times (1 - r)$ | $(0.5 \leqq r \leqq 1)$, |
| $\alpha g = 2 \times g$ | $(0 \leqq g < 0.5)$, |
| $\alpha g = 2 \times (1 - g)$ | $(0.5 \leqq g \leqq 1)$, |
| $\alpha b = 2 \times b$ | $(0 \leqq b < 0.5)$, |
| $\alpha b = 2 \times (1 - b)$ | $(0.5 \leqq b \leqq 1)$, |

where Cr, Cb, Cg, Cy, Cm and Cc are constants, and the r, g and b are obtained by dividing original gradation levels of the three color components of the input color image signal by a maximum gradation value N−1.

10. The color display device as set forth in claim 9, wherein:

the Cr, Cb, Cg, Cy, Cm and Cc are constants expressed as 1/(integer power of 2).

11. The color display device as set forth in claim 1, wherein:

the variables are expressed as:

$$Krg=Cr\cdot fmax(r)\cdot fmin(b),\ Krb=Cr\cdot fmax(r)\cdot fmin(g),$$

$$Kgr=Cg\cdot fmax(g)\cdot fmin(b),\ Kgb=Cg\cdot fmax(g)\cdot fmin(r),$$

$$Kbr=Cb\cdot fmax(b)\cdot fmin(g),\ Kbg=Cb\cdot fmax(b)\cdot fmin(r),$$

$$Kyg=Cy\cdot fmax(r)\cdot fmin(b),\ Kmb=Cm\cdot fmax(r)\cdot fmin(g),$$

$$Kmr=Cm\cdot fmax(b)\cdot fmin(g),\ Kcg=Cc\cdot fmax(b)\cdot fmin(r),$$

$$Kcb=Cc\cdot fmax(g)\cdot fmin(r),\ Kyr=Cy\cdot fmax(g)\cdot fmin(b),$$

where Cr, Cb, Cg, Cy, Cm and Cc are constants; fmax, and fmin are functions which respectively change depending on values of r, g and b in corresponding brackets; and the r, g and b are obtained by dividing original gradation levels of the three color components of the input color image signal by a maximum gradation value N−1.

12. The color display device as set forth in claim 11, wherein:

the function fmax is a continuous function which gives 0 when the r, g and b (0≦r,g,b≦1) are 1; and the function fmin is continuous function which gives 0 when the r, g and b (0≦r,g,b≦1) are 0.

13. The color display device as set forth in claim 11, wherein:

the Cr, Cb, Cg, Cy, Cm and Cc are constants expressed as 1/(integer power of 2).

14. The color display device as set forth in claim 1, wherein:

the variables are expressed as:

| | |
|---|---|
| $Krg = Cr \cdot Sr \cdot Tb$, | $Krb = Cr \cdot Sr \cdot Tg$, |
| $Kgr = Cg \cdot Sg \cdot Tb$, | $Kgb = Cg \cdot Sg \cdot Tr$, |
| $Kbr = Cb \cdot Sb \cdot Tg$, | $Kbg = Cb \cdot Sb \cdot Tr$, |
| $Kyg = Cy \cdot Sr \cdot Tb$, | $Kmb = Cm \cdot Sr \cdot Tg$, |
| $Kmr = Cm \cdot Sb \cdot Tg$, | $Kcg = Cc \cdot Sb \cdot Tr$, |
| $Kcb = Cc \cdot Sg \cdot Tr$, | $Kyr = Cy \cdot Sg \cdot Tb$, |
| $Tr = r^k$, | |
| $Sr = (1 - r)^k$, | |
| $Tg = g^k$, | |
| $Sg = (1 - g)^k$, | |
| $Tb = b^k$, | |
| $Sb = (1 - b)^k$, | |

where Cr, Cb, Cg, Cy, Cm, Cc and k are constants, and the r, g and b are obtained by dividing original gradation levels of the three color components of the input color image signal by a maximum gradation value N−1.

15. The color display device as set forth in claim 14, wherein:

the constant k is 1.

16. The color display device as set forth in claim 14, wherein:

the Cr, Cb, Cg, Cy, Cm and Cc are constants expressed as 1/(integer power of 2).

17. The color display device as set forth in claim 1, wherein:

the variables Nr and Ny are not less than 1.

18. The color display device as set forth in claim 1, wherein:

the variables Ng, Nb, Nm and Nc are not more than 1.

19. The color display device as set forth in claim 1, further comprising:

detector to detect environmental changes; and color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, according to a result of detection by the detector.

20. The color display device as set forth in claim 19, wherein:

the detector detects light intensity of outside of the color display device.

21. The color display device as set forth in claim 1, further comprising:

color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, depending on whether a backlight of a semi-transmission liquid crystal panel is on or off.

22. The color display device as set forth in claim 1, wherein:

the relatively greatest component in gradation level among the three components of RGB is compensated by using both the compensation value of the relatively greatest component and the compensation value of the complementary color of the relatively greatest component and the second relatively greatest component, and the second relatively greatest component in gradation level among the RGB components is compensated by using the compensation value of complementary color of the relatively greatest component and the second relatively greatest component.

23. A color display device, comprising:

a color processor to determine a relationship between three color components of an input color image signal in terms of gradation levels of the three color components of an input color image signal and to process the input color image signal by carrying out a different calculation for each input color image signal depending on which of six patterns of the determined relationship that the input color image signal belongs to, the calculation being performed for each of the three color components excluding a component with a relatively smallest gradation level, using variables varying depending on the relationship among the respective gradation levels of the three color components, wherein the gradation level of the color component with the relatively smallest gradation level remains unchanged before and after the calculation; and a color display panel to display the processed color image signal wherein:

the input color image signal is converted into an output color image signal with the three color components respectively having gradation levels of r', g' and b', which are given by:

$$\begin{pmatrix} r' \\ g' \\ b' \end{pmatrix} = \begin{pmatrix} r \\ g \\ b \end{pmatrix} + A_{36} \begin{pmatrix} ro \\ go \\ bo \\ yo \\ mo \\ co \end{pmatrix}$$

where r, g and b are values obtained by dividing original gradation levels of the three color components of the input color image signal by a maximum gradation value N−1; and $A_{36}$ expresses square matrix of 3×6; and in a case [1] where r≧g≧b:

$$ro=Krg(fzr(r)-fzg(g))^{Nr},$$

$$yo=Kyg(fzg(g)-fzb(b))^{Ny},$$

$$go=bo=mo=co=0,$$

in a case [2] where r≧b>g:

$$ro=Krb(fzr(r)-fzb(b))^{Nr},$$

$$mo=Kmb(fzb(b)-fzg(g))^{Nm},$$

$$go=bo=yo=co=0,$$

in a case [3] where b>r≧g:

$$bo=Kbr(fzb(b)-fzr(r))^{Nb},$$

$$mo=Kmr(fzr(r)-fzg(g))^{Nm},$$

$$ro=go=yo=co=0,$$

in a case [4] where b>g>r:

$$bo=Kbg(fzb(b)-fzg(g))^{Nb},$$

$$co=Kcg(fzg(g)-fzr(r))^{Nc},$$

$$ro=go=yo=mo=0,$$

in a case [5] where g>b>r:

$$go=Kgb(fzg(g)-fzb(b))^{Ng},$$

$$co=Kcb(fzg(b)-fzr(r))^{Nc},$$

$$ro=bo=yo=mo=0,$$

in a case [6] where g>r≧b:

$$go=Kgr(fzg(g)-fzr(r))^{Ng},$$

$$yo=Kyr(fzr(r)-fzb(r))^{Ny},$$

$$ro=bo=mo=co=0,$$

in which Krg, Krb, Kbr, Kbg, Kgb, Kgr, Kyg, Kyr, Kmb, Kmr, Kcg and Kcb are variables which change depending on values of r, g and b, Nr, Ng, Nb, Ny, Nm and Nc are constants not less than 0, and fzr, fzg, fzb are functions which respectively change depending on values of r, g and b in corresponding brackets.

24. The color display device as set forth in claim 23, wherein:

the functions fzr, fig, fzb convert input values identical with each other into output values different from each other.

25. The color display device as set forth in claim 23, wherein:

the functions fzr, fzg, fzb satisfy $fzr=r^{2.2}$, $fzg=g^{2.2}$ and $fzb=b^{2.2}$.

26. The color display device as set forth in claim 23, wherein:

the functions fzr, fzg, fzb satisfy $fzr=r^2$, $fzg=g^2$ and $fzb=b^2$.

27. The color display device as set forth in claim 23, further comprising:

detector to detect environmental changes; and color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, according to a result of detection by the detector.

28. The color display device as set forth in claim 21, further comprising:

color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, depending on whether a backlight of a semi-transmission liquid crystal panel is on or off.

29. A color display device, comprising:

a color processor to determine a relationship between three color components of an input color image signal in terms of gradation levels of the three color components of an input color image signal, and to process the input color image signal by carrying out a different calculation for each input color image signal depending on which of six patterns of the determined relationship that the input color image signal belongs to, the calculation being performed for each of the three color components excluding a component with a relatively smallest gradation level, using variables varying depending on the relationship among the respective gradation levels of the three color components, wherein the gradation level of the color component with the relatively smallest gradation level remains unchanged before and after the calculation; and a color display panel to display the processed color image signal, wherein:

the input color image signal is converted into an output color image signal with the three color components respectively having gradation levels of r', g' and b', which are given by:

$$r'=r+ro+yo+mo,$$

$$g'=g+go+yo+co,$$

$$b'=b+bo+mo+co,$$

where r, g and b are values obtained by dividing original gradation levels of the three color components of the input color image signal by a maximum gradation value N−1; and, $$ro=Cr\cdot min\ (rg, rb),$$

$$go=Cg\cdot min\ (gr, gb),$$

$$bo=Cb\cdot min\ (br, bg),$$

$$yo=Cy\cdot min\ (rb, gb),$$

$$mo=Cm\cdot min\ (rg, bg),$$

$$co=Cc\cdot min\ (gr, br),$$

in which min ( ) is a function for giving a smallest value in a corresponding bracket; and Cr, Cg, Cb, Cy, Cm and Cc are constants, on condition that:

$$rg=r-g,$$

$$rb=r-b,$$

$$gr=g-r,$$

$$gb=g-b,$$

$$br=b-r,$$

$$bg=b-g,$$

in which each of rg, rb, gr, gb, br and bg are modified to 0 when they are minus values.

30. The color display device as set forth in claim 29, further comprising:

a detector to detect environmental changes; and color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, according to a result of detection by the detector.

31. The color display device as set forth in claim 29, further comprising:

color converter to control at least one of the coefficients Nr, Ng, Nb, Ny, Nm, Nc, Cr, Cg, Cb, Cy, Cm, Cc, Pr, Py and a factor of $A_{36}$, and the functions fzr, fzg, fzb, fw, fnr, fng, fnb, fny, fnm and fnc, depending on whether a backlight of a semi-transmission liquid crystal panel is on or off.

32. A color display device, comprising:

a color processor to determine a relationship between three color components of an input color image signal in terms of gradation levels of the three color components of an input color image signal, and to process the input color image signal by carrying out a different calculation for each input color image signal depending on which of six patterns of the determined relationship that the input color image signal belongs to, the calculation being performed for each of the three color components excluding a component with a relatively smallest gradation level, using variables varying depending on the relationship among the respective gradation levels of the three color components, wherein the gradation level of the color component with the relatively smallest gradation level remains unchanged before and after the calculation; and a color display panel to display the processed color image signal wherein:

the input color image signal is converted into an output color image signal with the three color components respectively having gradation levels of r', g' and b', which are given by:

$$r'=r+ro+yo+mo$$

$$g'=g+go+yo+co$$

$$b'=b+bo+mo+co$$

where r, g and b are values obtained by dividing original gradation levels of the three color components of the input color image signal by a maximum gradation value N−1; and $ro=Krg\cdot rg$ where $rg<rb$, $ro=Krb\cdot rb$ where $rg>rb$, $go=Kgr\cdot gr$ where $gr<gb$, $go=Kgb\cdot gb$ where $gr>gb$, $bo=Kbr\cdot br$ where $br<bg$, $bo=Kbg\cdot bg$ where $br>bg$, $yo=Kyr\cdot rb$ where $rb<gb$, $yo=Kyg\cdot gb$ where $rb>gb$, $mo=Kmr\cdot rg$ where $rg<bg$, $mo=Kmb\cdot bg$ where $rg>bg$, $co=Kcg\cdot gr$ where $gr<br$, $co=Kcb\cdot br$ where $gr>br$, in which Krg, Krb, Kbr, Kbg, Kgb, Kgr, Kyg, Kyr, Kmb, Kmr, Kcg and Kcb are variables which change depending on values of r, g and b, on condition that:

$$rg=r-g,$$

$$rb=r-b,$$

$$gr=g-r,$$

$$gb=g-b,$$

$$br=b-r,$$

$$bg=b-g,$$

in which each of rg, rb, gr, gb, br and bg are modified to 0 when they are minus values.

* * * * *